US009791140B2

(12) United States Patent
Zaderej et al.

(10) Patent No.: US 9,791,140 B2
(45) Date of Patent: Oct. 17, 2017

(54) LIGHT MODULE

(71) Applicant: Molex, LLC, Lisle, IL (US)

(72) Inventors: Victor Zaderej, Wheaton, IL (US); Daniel B. McGowan, Glen Ellyn, IL (US); Michael C. Picini, Aurora, IL (US)

(73) Assignee: Molex, LLC, Lisle, IL (US)

( * ) Notice: Subject to any disclaimer, the term of this patent is extended or adjusted under 35 U.S.C. 154(b) by 312 days.

(21) Appl. No.: 14/547,644

(22) Filed: Nov. 19, 2014

(65) Prior Publication Data

US 2015/0070912 A1 Mar. 12, 2015

Related U.S. Application Data

(63) Continuation of application No. 13/054,030, filed as application No. PCT/US2010/027463 on Mar. 16, 2010, now Pat. No. 8,907,550.

(Continued)

(51) Int. Cl.

| | |
|---|---|
| ***F21V 29/00*** | (2015.01) |
| ***F21V 29/71*** | (2015.01) |
| ***F21V 29/77*** | (2015.01) |
| ***F21K 9/00*** | (2016.01) |
| ***F21V 29/505*** | (2015.01) |
| ***F21V 29/70*** | (2015.01) |
| ***F21V 29/80*** | (2015.01) |
| ***F21V 29/83*** | (2015.01) |
| ***F21V 29/85*** | (2015.01) |
| ***F21V 29/87*** | (2015.01) |
| ***F21V 29/89*** | (2015.01) |
| ***F21K 9/23*** | (2016.01) |
| ***F21V 29/74*** | (2015.01) |

(Continued)

(52) U.S. Cl.

CPC ..... *F21V 29/71* (2015.01); *F21K 9/00* (2013.01); *F21K 9/23* (2016.08); *F21V 29/004* (2013.01); *F21V 29/505* (2015.01); *F21V 29/70* (2015.01); *F21V 29/713* (2015.01); *F21V 29/717* (2015.01); *F21V 29/74* (2015.01); *F21V 29/77* (2015.01); *F21V 29/773* (2015.01); *F21V 29/80* (2015.01); *F21V 29/83* (2015.01); *F21V 29/85* (2015.01); *F21V 29/87* (2015.01); *F21V 29/89* (2015.01); *F21V 13/04* (2013.01); *F21V 17/005* (2013.01); *F21Y 2115/10* (2016.08); *Y10S 362/80* (2013.01)

(58) Field of Classification Search

CPC ..... F21V 29/71
USPC ..... 362/373
See application file for complete search history.

(56) References Cited

U.S. PATENT DOCUMENTS

2007/0296350 A1* 12/2007 Maxik ..... H05K 1/189 315/291
2008/0310167 A1 12/2008 Zaderej et al.

FOREIGN PATENT DOCUMENTS

WO WO 2004/053934 A2 6/2004
WO WO 2007/146566 A2 12/2007
WO WO 2008/119230 A1 10/2008

* cited by examiner

*Primary Examiner* — Vip Patel
(74) *Attorney, Agent, or Firm* — Jeffrey K. Jacobs

(57) ABSTRACT

An LED array is mounted on a base that is thermally coupled to a heat spreader. At least one aperture is provided between the support area and an edge of the heat spreader. The heat spreader may be coupled to a thermal pad which has sufficient thermal conductivity and is sufficiently thin to (Continued)

allow the thermal resistivity between the heat spreader and a corresponding heat sink to be below a predetermined value.

12 Claims, 46 Drawing Sheets

Related U.S. Application Data

(60) Provisional application No. 61/186,872, filed on Jun. 14, 2009, provisional application No. 61/174,880, filed on May 1, 2009, provisional application No. 61/160,565, filed on Mar. 16, 2009.

(51) Int. Cl.

| | |
|---|---|
| *F21V 13/04* | (2006.01) |
| *F21V 17/00* | (2006.01) |
| *F21Y 115/10* | (2016.01) |

LIGHT MODULE

This application is a continuation of U.S. application Ser. No. 13/054,030, filed Jan. 13, 2011, which in turn claims priority of PCT Application No. PCT/US10/27463, filed Mar. 16, 2010, which in turn claims priority to U.S. Provisional Application Ser. No. 61/160,565, filed Mar. 16, 2009; to U.S. Provisional Application Ser. No. 61/174,880, filed May 1, 2009 and to U.S. Provisional Application Ser. No. 61/186,872, filed on Jun. 14, 2009, all of which are incorporated herein by reference in their entirety.

FIELD OF THE INVENTION

The present invention relates to field of illumination, more specifically to a light module suitable for use with a light emitting diode.

BACKGROUND OF THE INVENTION

Conventional incandescent lights have been used widely and are available in a number of form factors. One commonly used form factor is known as MR-16, which customarily referred to a small, halogen reflector lamp. The MR-16 lamps are small and therefore are well suited to placement in small enclosures and often used for spot lighting. Due to the inefficiencies of incandescent light sources, however, there has been a substantial push to replace incandescent lamps with light emitting diode (LED) based lamps. This push has caused the creation of LED-based designs for MR16 lamps.

LED technology has rapidly advanced over the past 10 years. What originally was conceptual has progressed to the point that it can be applied in mass-produced applications. While LED technology has rapidly progressed, the rapid progression has created somewhat of a problem for conventional light fixture manufactures.

Typically, a light fixture designer has used a conventional, known light source and focused efforts on shaping the emitted light so as to provide the desired compromise between the total light output (efficiency) and the desired footprint of the emitted light. Issues like thermal management were peripheral. With LEDs, however, issues like changes in the light output over time, the potential need to convert to DC power, and the need for careful thermal management become much more significant. To further complicate this, LED technology continues to evolve at a rapid pace, making it difficult to design a fixture that directly integrates the LEDs into the fixture.

One known issue with LEDs is that it is important to keep the temperature of the LED cool enough so that the potential life of the LED can be maintained. Otherwise, the heat will cause the light output of the LED to quickly degrade and the LED will cease to provide the rated light output long before the LED would otherwise cease to function properly. Therefore, while the heat output of LEDs is not extreme, the relative sensitivity of the LED to the heat causes heat management to become a relatively important issue. Existing designs may not fully account for the heat generated, tend to provide relatively limited lumen output or tend to use expensive thermal management solutions that make the design of the LED replacement bulb extremely costly. Therefore, individuals would appreciate further improvements in LED light modules that could provide a cost effective solution to the issue of heat management.

Integration of LEDs directly into a light fixture structure results in the required disposal of the entire fixture upon the eventual failure of the light source, and/or its related electronic components. This is an undesirable result considered unsustainable in wide spread application of LED technology for general illumination.

It has thus been determined that a need exists for a module that addresses the thermal management issues and can be readily incorporated into a fixture.

SUMMARY OF THE INVENTION

A light module is provided that includes an electrically insulative housing and a thermally conductive heat sink which extends from the insulative housing. The heat sink includes a base and a plurality of fins. The fins extend from an outer surface of the base. A thermal channel can be provided to allow thermal energy to conduct across a relatively thermally insulative portion of the base. A LED module, which may include an array of LEDs, is supported by the base and can be positioned on a support area of a heat spreader so that the heat spreader and the LED module are in thermal communication. The heat spreader may include a plurality of fingers which align with fingers or the fins provided on the heat sink. Between the support area and an edge of the heat spreader is an aperture. The aperture can be aligned with one of a cathode and an anode of the LED. Multiple apertures can be provided, with different apertures aligned with the cathode and the anode. The heat spreader helps ensure thermal energy can be efficiently transferred to the heat sink so that the total system functions appropriately. The thickness of the heat spreader can be less than 2 mm and in an embodiment can be less than 1 mm.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
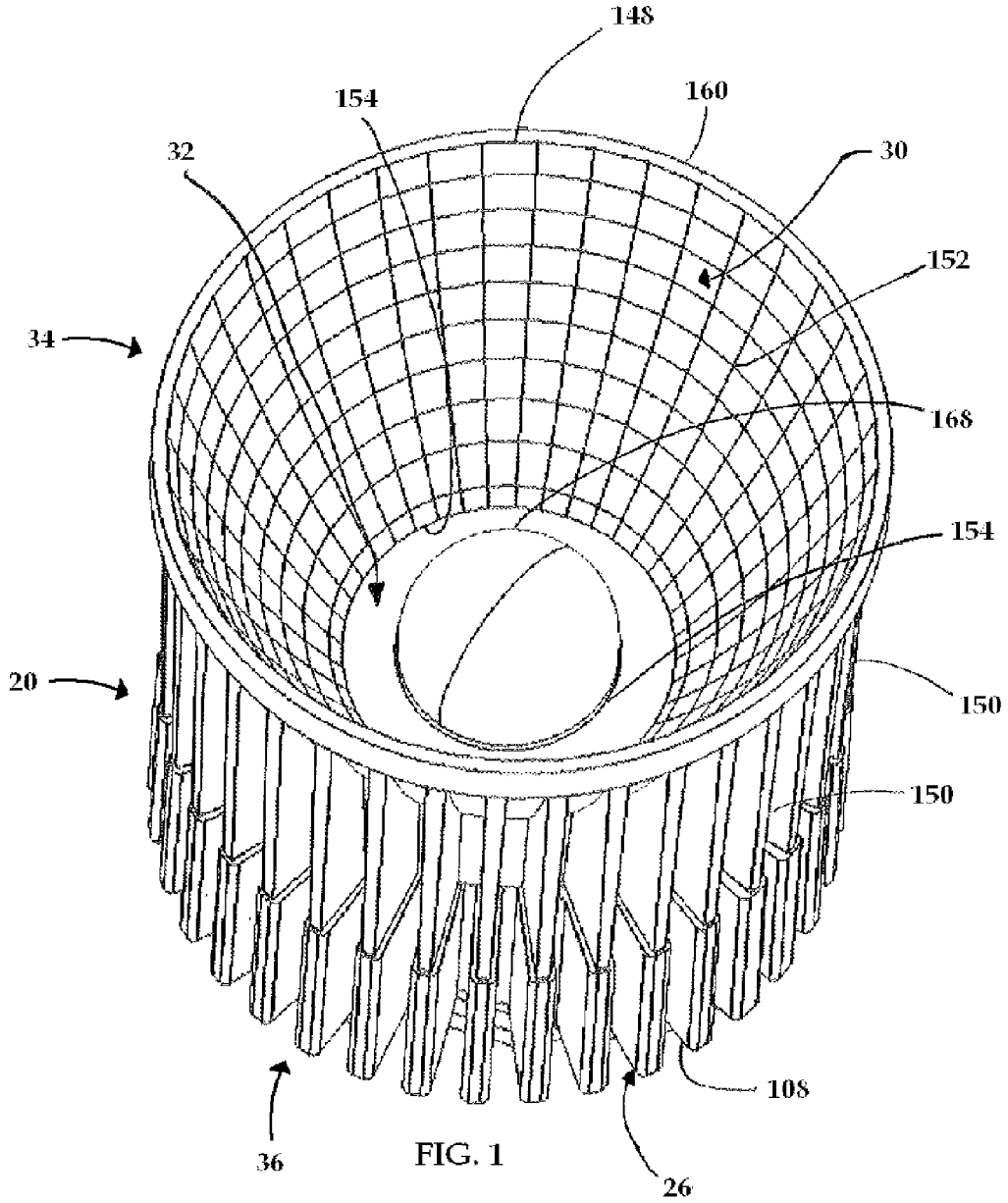
FIG. 1 is a top perspective view of a light module which incorporates the features of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein. Therefore, unless otherwise noted, features disclosed herein may be combined together to form additional combinations that were not otherwise shown for purposes of brevity. Several embodiments of a light module 20, 220, 620, 820 are disclosed herein. While the terms lower, upper and the like are used for ease in describing the present invention, it is to be understood that these terms do not denote a required orientation for use of the disclosed modules.

Each embodiment of the light module 20, 220, 620, 820 includes a LED module 22, 222, 322, 422, 622, 822 and a heat sink 26, 226, 626, 826 for dissipating heat generated by the LED module 22, 222, 322, 422, 622, 822. In each embodiment, the heat sink 26, 226, 626, 826 can be formed of a plated plastic. Plating of plastics is well-known in the art. The plating on the heat sink 26, 226, 626, 826 may be a conventional plating commonly used with plated plastics and the heat sink 26, 226, 626, 826 may be formed via a two shot-mold process. It is also envisioned that the heat sink 26, 226, 626, 826 could be formed as an aluminum piece. The benefit of aluminum is that heat conducts readily throughout the heat sink, thus making it relatively simple to conduct heat away from a heat source. While aluminum acts as a good heat sink due to its acceptable heat transfer properties, it tends to be heavy. In addition, aluminum is more difficult to form into complex shapes and therefore the designs that are possible with aluminum are somewhat limited. Plated plastics can be used to conduct heat with the plating being used to transfer heat along the surface away from the heat source. The conducting of heat away from a heat source is more complex when a plated plastic is used as the plating tends to be the primary path for heat transfer if a desirable performance level is to be achieved. It has been determined that to efficiently use plated plastic, therefore, a simple heat sink design such as would be ample for an aluminum heat sink may not be appropriate to provide the desired performance. The benefit of using a plated plastic design, however, is a housing can provide both the support and thermal dissipation.

As can be appreciated, depending on the thermal load and other design considerations, other materials may also be used as a heat sink. For example, insulative materials with thermal conductivity greater than 5 Kelvin per meter-watt could be used for certain applications and high performance insulative materials with thermal conductivity greater than 20 Kelvin per meter-watt would be beneficial for a wider range of applications. To date, however, insulative materials with such thermal conductivity are relatively expensive and therefore may not prove commercially desirable, even if they would be functionally desirable.

One or more LEDs can be used in the LED module 22, 222, 322, 422, 622, 822 to provide an LED array and the LED(s) can be design to be powered by AC or DC power. The advantage of using AC LEDs is that there is no need to convert conventional AC line voltage to DC voltage. This can be advantageous when cost is a significant driver as the power convertor circuit either tends to be expensive or less likely to last as long as the LED itself can last. Therefore, to get the expected 30,000 to 70,000 hours from a LED fixture, the use of AC LEDs can be beneficial. For applications where there is an external AC to DC conversion (e.g., for applications where it is undesirable to have line voltage), however, DC LEDs may provide an advantage as existing DC LEDs tend to have superior performance. It should be noted that if a LED array is configured for low thermal resistance between the LED array and a mating interface that would engage a heat spreader or heat sink, the system tends to be more effective. An LED array such as available from Bridgelux (with the possibility of having a thermal resistance of less than 1 C/W between the LED array and a bottom surface of the base that supports the LED array) would be suitable.

Attention is now invited to the embodiment of the light module 20 shown in FIGS. 1-15. The light module 20 includes an illumination face 34 that is configured to emit light and a mounting face 36 that is configured to allow the light module 20 to be quickly mounted to a receptacle. The light module 20 include a LED module 22, an insulative housing 24, a heat sink 26, a heat spreader 28, an optional reflector 30, an optional lens cover 32 and a base cover 90.

Figure 4:
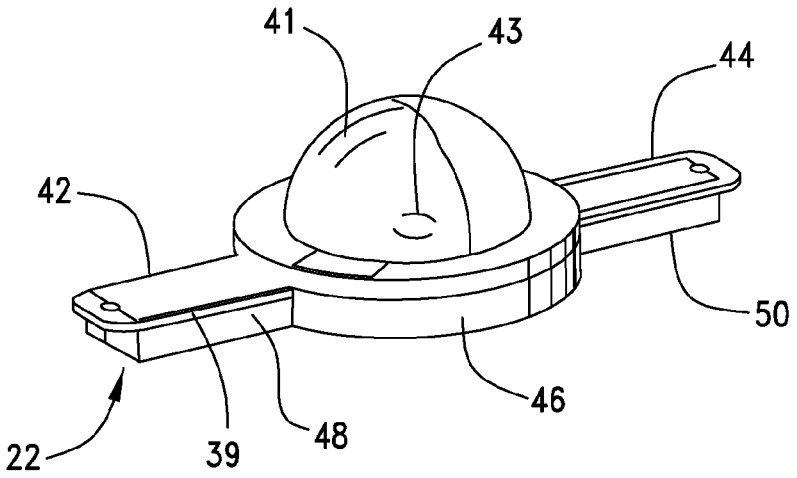
FIG. 4 is a perspective view of a LED module used in the light module of FIG. 1.

As shown in FIG. 4, the LED module 22 includes an insulative base 39, a LED cover 41 seated on the insulative base 39 and covering a LED 43, which may be a single LED or an array, an anode 42 and a cathode 44. The base 39 includes a central section 46 with first and second diametrically opposed arms 48, 50 extending outwardly therefrom. The base 39 houses electronics and the LED 43 is exposed along an upper surface thereof. The anode 42 is seated on top of the first arm 38, and is slightly longer than the first arm 38 such that the anode 42 extends outwardly therefrom. The cathode 44 is seated on the second arm 50, and is slightly longer than the second arm 50 such that the cathode 44 extends outwardly therefrom. A heat puck 52 is provided on the underside of the central section 46. The heat puck 52 may be a conductive element that is integrated into the LED module 22 and attached thereto by a thermally conductive epoxy. In an alternative embodiment, the heat puck 52 can be a dispensed conductive material, such as (without limitation) a thermally conductive epoxy or solder.

Figure 5:
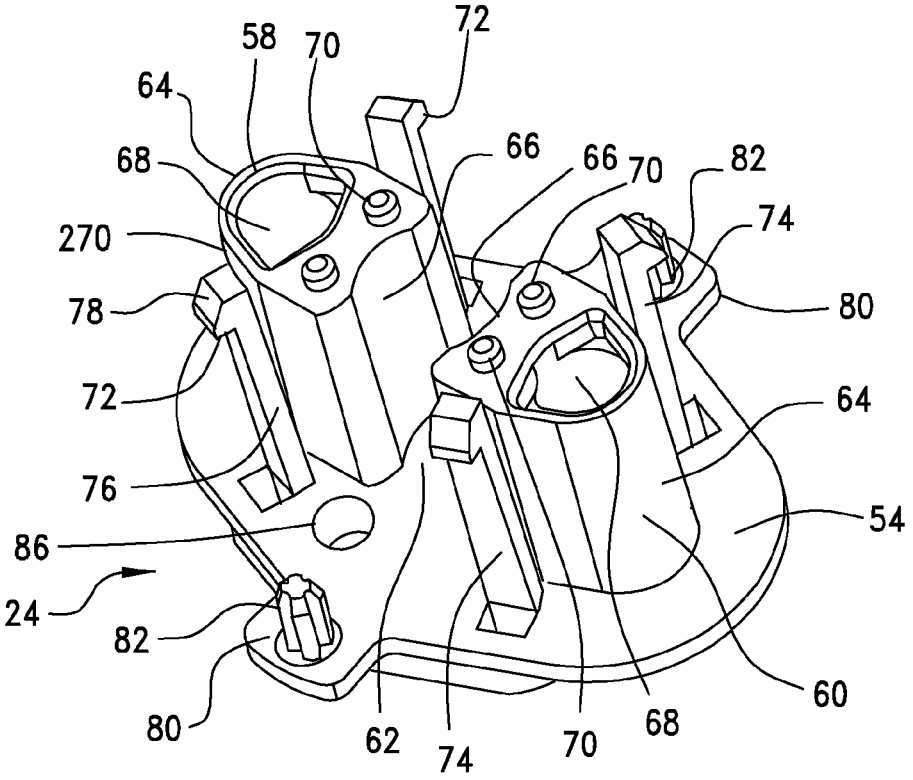
FIG. 5 is a top perspective view of a housing used in the light module of FIG. 1.
Figure 6:
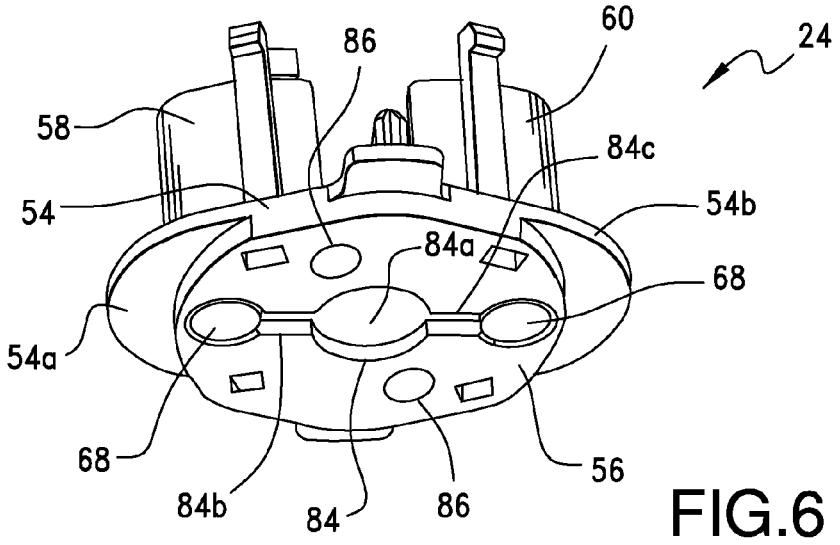
FIG. 6 is a bottom perspective view of a housing used in the light module of FIG. 1.

The housing 24, see FIGS. 5 and 6, is formed from an upper plate 54 and a lower plate 56 which is integrally formed with the upper plate 54. The upper plate 54 is generally oval-shaped and the lower plate 56 is generally circular and extends downwardly from a central area of the upper plate 54. As a result, a first pair of diametrically opposed flanges 54*a*, 54*b*, which are formed by portions of the upper plate 54, extend outwardly from the lower plate 56.

First and second spaced apart extensions 58, 60 extend upwardly from the upper surface of the upper plate 54. As best shown in FIG. 5, each extension 58, 60 has an arcuate wall section 64 and a concave wall section 66. The concave wall sections 66 face each other and are separated by central wall portion 62 of the upper plate 54. A passageway 68 extends through each of the extensions 58, 60 and through the plates 54, 56. At the upper end of each extension 58, 60 proximate to the concave wall section 66, a pair of spaced-apart locating protrusions 70 extend upwardly therefrom and are spaced from the passageway 68.

The first arm 48 of the LED module 22 seats on top of the first extension 58 (with the heat spreader 28 therebetween as described herein) and is positioned between the locating protrusions 70. The second arm 50 of the LED module 22 seats on top of the second extension 60 (with the heat spreader 28 therebetween as described herein) and is positioned between the spaced apart locating protrusions 70. The locating protrusions 70 align the LED module 22 with the housing 24 and aid in positioning the anode 42 and the cathode 44 in the desired locations relative to the housing 24. The edges of the central section 46 of the LED module 22 are positioned over the extensions 58, 60. The heat puck 52 of the LED module 22 is positioned between the concave wall sections 66.

A first pair of holding projections 72 extend from the upper plate 54 and are provided on opposite sides of the first extension 58; a second pair of holding projections 74 extend from the upper plate 54 and are provided on opposite sides of the second extension 60. Each holding projection 72, 74 takes the form of a flexible arm 76 with a head 78 at the end thereof. The holding projections 72, 74 attach the housing 24 to the heat sink 26 as discussed herein.

A second pair of flanges 80 extend outwardly from and are diametrically opposed on the upper plate 54 and have a thickness which is substantially the same as the upper plate 54. An alignment pin 82 extends upwardly from each of the flanges 80. Each alignment pin 82 has a height which is less than the height of the extensions 58, 60.

A wire retaining recess 84 may be provided in the lower surface of the lower plate 56. The wire retaining recess 84 has an enlarged portion 84*a* which is centrally provided on the lower surface and a pair of arms 84*b*, 84*c* which extend outwardly therefrom and are in communication with the respective passageways 68. Apertures 86 for receiving fasteners 88 are provided through the plates 54, 56 for reasons described herein.

Figure 2:
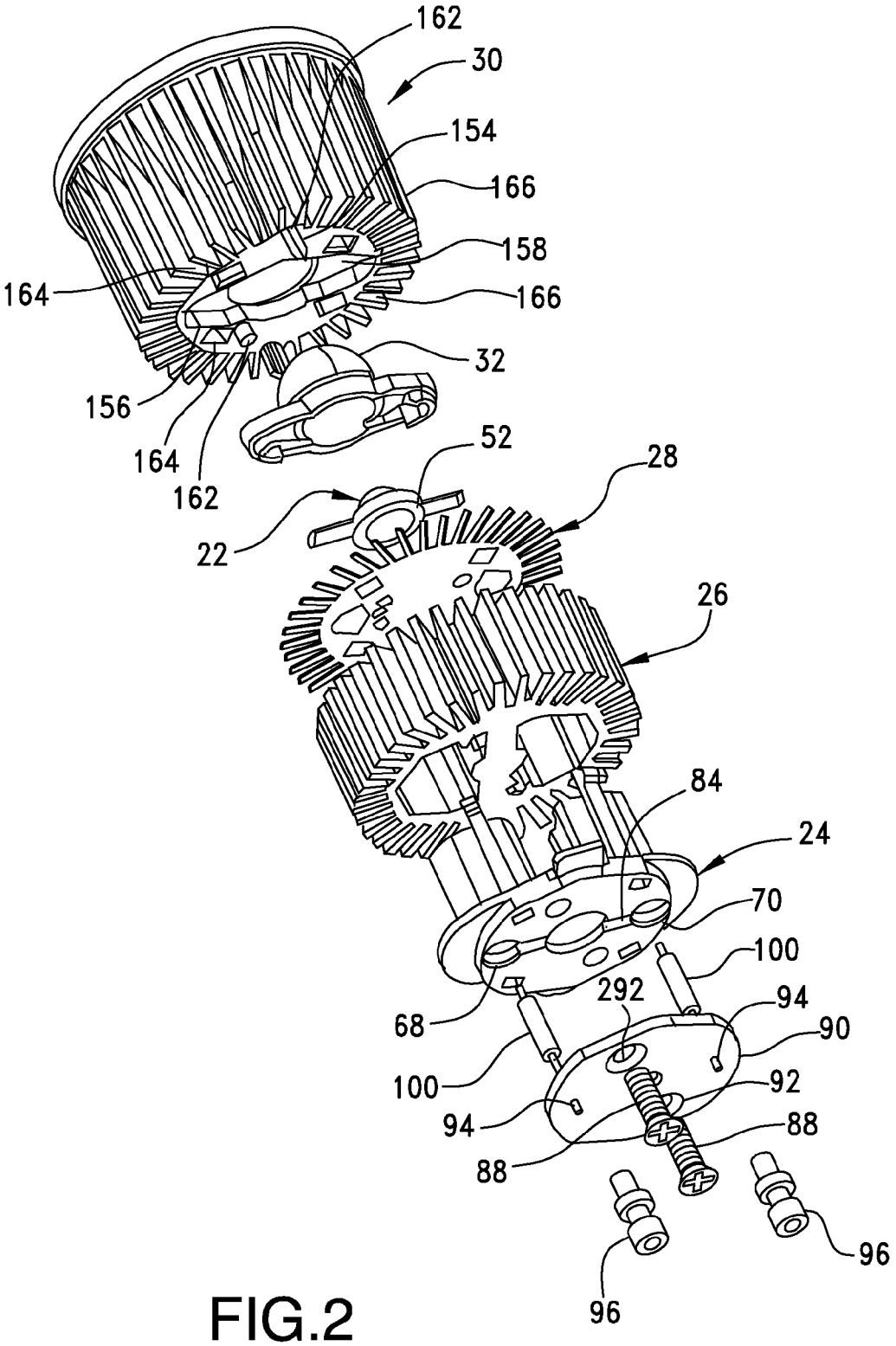
FIG. 2 is an exploded perspective view of the components of the light module of FIG. 1.
Figure 3:
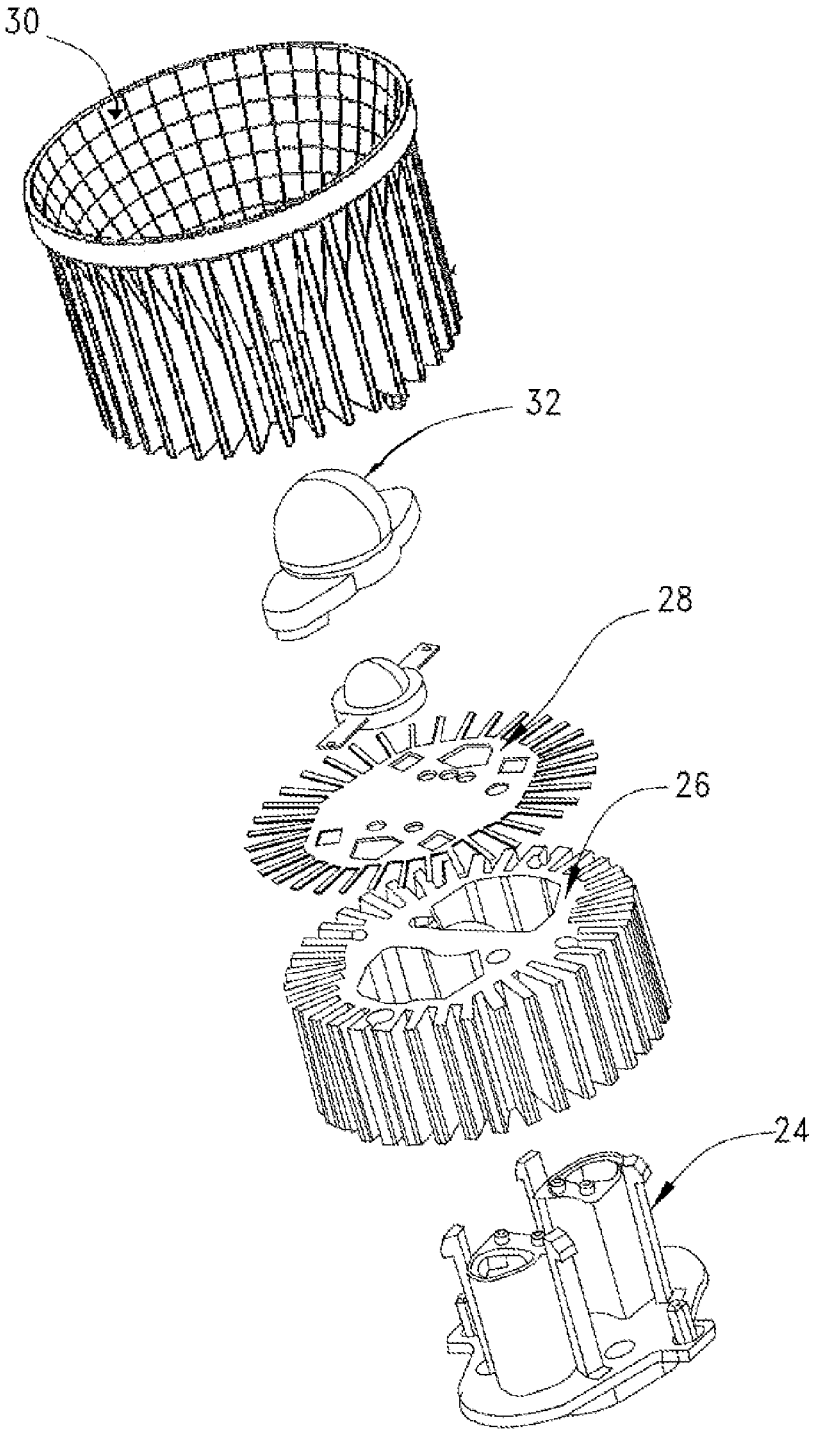
FIG. 3 is an alternate exploded perspective view of the components of the light module of FIG. 1.
Figure 7:
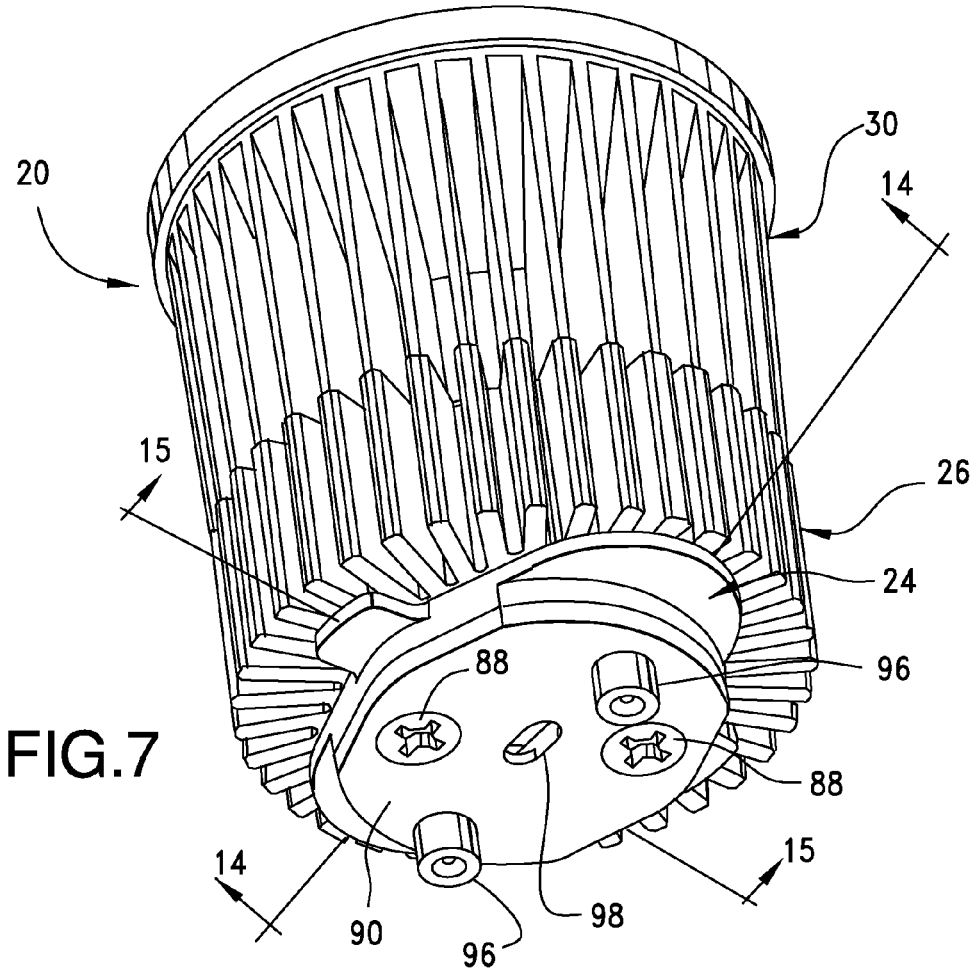
FIG. 7 is a bottom perspective view of the light module of FIG. 1 with a conductive member provided thereon.

A base cover 90, see FIGS. 2 and 7, which is formed as a plate, is attached to the underside of the housing 24 to cover the wire retaining recess 84. A first set of apertures 92 are provided through the base cover 90, which align with the apertures 86 in the plates 54, 56, to allow the fasteners 88 to connect the base cover 90 to the underside of the housing 24. A second set of apertures 94 may be provided through the base cover 90 and are aligned with the passageways 68 in the housing 24. The second set of apertures 94 permit connection of conductive members 96, such as GU 24 pins, to the electronic components of the light module 20. Alternatively, a central wire opening 98 is provided between the first pair apertures 92 and is aligned with the enlarged portion 84*a* of the wire receiving recess 84. A wire would then be routed along the bottom of the housing 24 and passed through the wire opening 98. In practice, it is contemplated that either the wire opening 98 or the second set of apertures 94 will be provided as they provide substitute functionality. If the wire opening 98 is provided, the upper surface of the base cover 90 may include a wire receiving recess (not shown) that is aligned with and mirrors the wire receiving recess 84 in the housing 24 so as to direct wires in the desired direction. In addition, if a wire opening 98 is used, the wire may be sealed to the base cover 90 so as to minimize moisture ingression. In that regard, the conductive elements 96 can be also be sealed to the base cover 90 so as to minimize moisture ingression.

Figure 8:
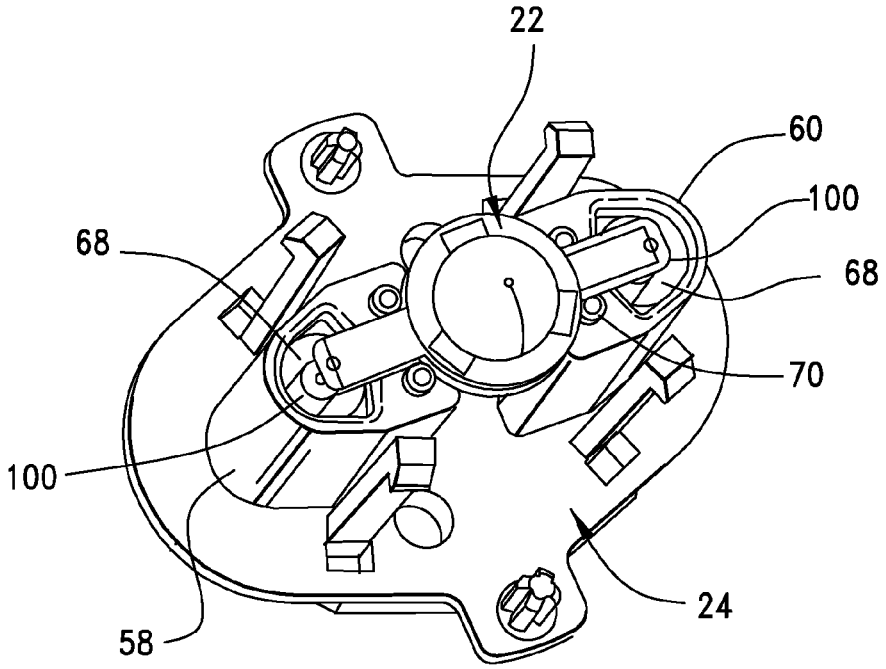
FIG. 8 is a top perspective view of the housing of FIGS. 5 and 6 having the LED module of FIG. 4 attached thereto.
Figure 9:
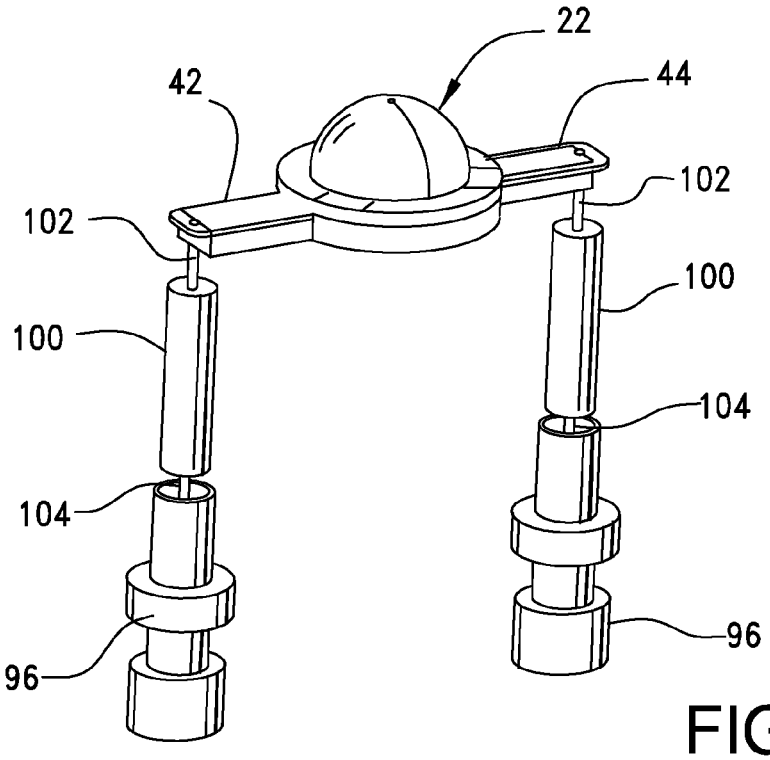
FIG. 9 is a perspective view of the LED module of FIG. 4 attached to electrical components used in the light module of FIG. 1.

As shown in FIG. 8, a resistive element 100 is housed within the passageway 68 of each extension 58, 60. As shown in FIG. 9, a wire 102 extends from the upper end of each resistive element 100 for connection to the anode/cathode 42/44 of the LED module 22. A wire 104 extends from the lower end of each resistive element 100 for connection to the conductive member 96 through the apertures 94/wire opening 98. Two resistive elements 100 can be used, one coupled to the anode 42 and one coupled to the cathode 44 in a similar manner. While the use of two resistive elements 100 increases the number of parts used, it has been determined that such a configuration helps spread out the heat generated by the resistive elements 100 (which may be 1 watt resistors) and therefore provides a more thermally balanced design. It should be noted that the conductive members 296 may be configured to be different sizes so as to provide a polarized fit.

Figure 10:
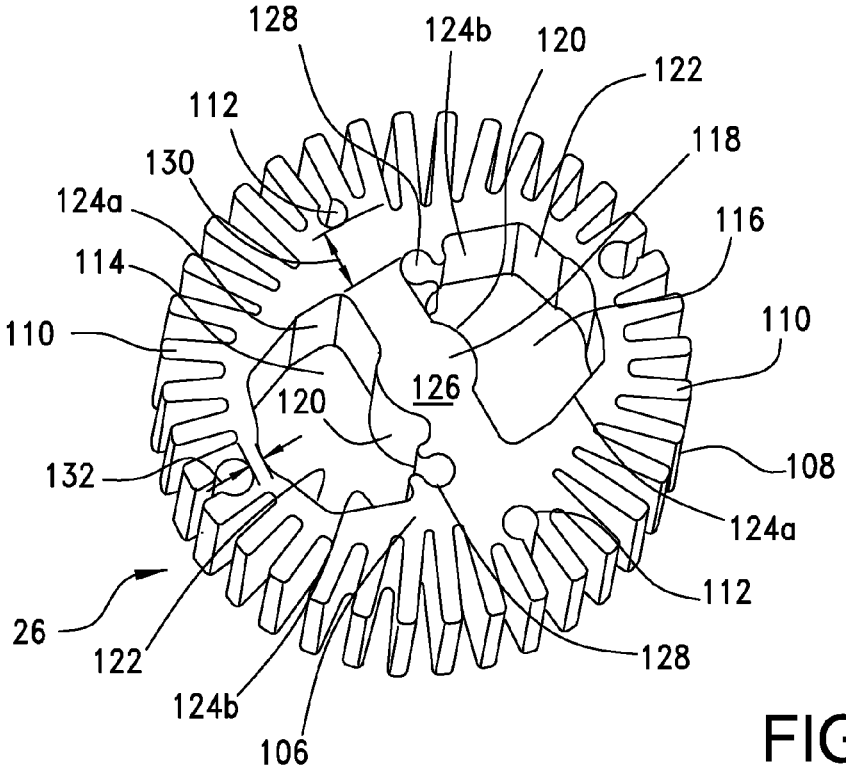
FIG. 10 is a top perspective view of a heat sink used in the light module of FIG. 1.

As best shown in FIG. 10, the heat sink 26 includes a base 106 and a plurality of spaced-apart, elongated fins 108 extending radially outwardly therefrom. The fins 108 extend from the lower end of the base 106 to the upper end of the base 106. As depicted, the heat sink 26 includes straight radial fins 108, however, as can be appreciated, other shapes of fins can be used as desired. The upper surfaces of the fins 108 are flush with the upper surface of the base 106 and, as a result, a plurality of spoke-like fingers 110 are formed by the fins 108. Equi-distantly spaced alignment channels 112 are provided between predetermined ones of the fins 108.

A pair of channels 114, 116 extend through the base 106 from the lower end to the upper end and are separated from each other by a central bridge portion 118. The channels 114, 116 are only open to the upper and lower surfaces of the base 106. That is to say, the walls which form the sides of the channels 114, 116 are uninterrupted. Each channel 114, 116 has an inner generally concave wall section 120 and an outer generally convex wall section 122 which are spaced apart from each other by side wall sections 124*a*, 124*b*. The inner wall sections 120 face each other. As a result, an enlarged central section 126 is provided along the bridge portion 118. In each channel 114, 116, at the corner between the inner wall section 120 and one of the side wall sections 124*b*, a fastening channel 128 is provided into which the fastener 88 is inserted. The heat sink 26 has a first thickness 130 between the ends of the bridge portion 118 and the outer periphery of the base 106, and a second thickness 132 between the apex of the outer wall section 122 and the outer periphery of the base 106. As shown, the second thickness 132 is less than the first thickness 130. Such a configuration aids in providing efficient heat transfer along the heat sink 26, while minimizing the weight of the heat sink 26.

Figure 11:
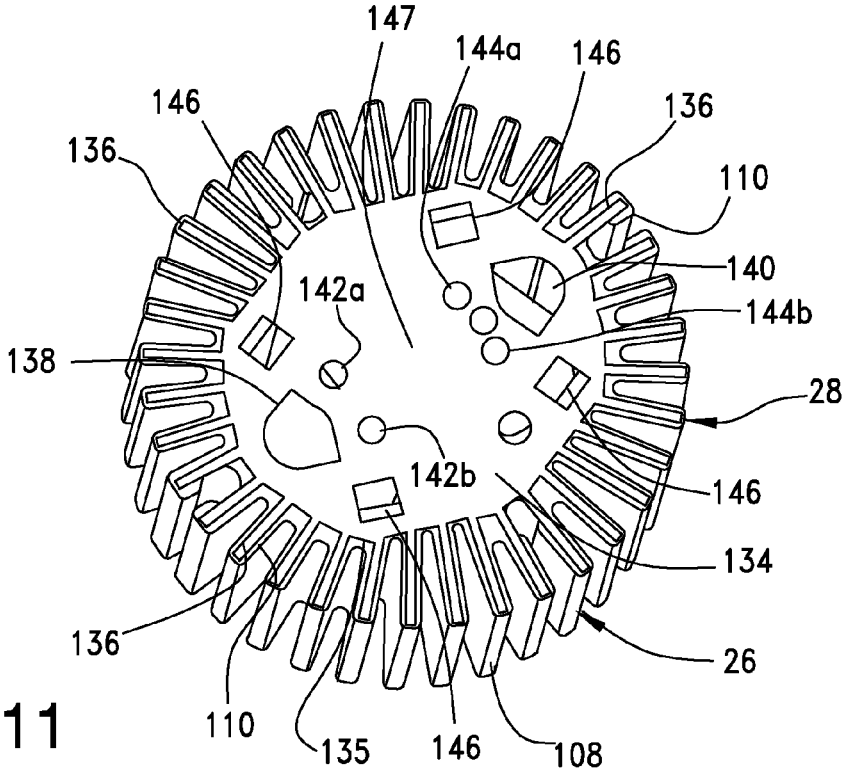
FIG. 11 is a top perspective view of the heat sink of FIG. 10 having a heat spreader attached thereto.
Figure 12:
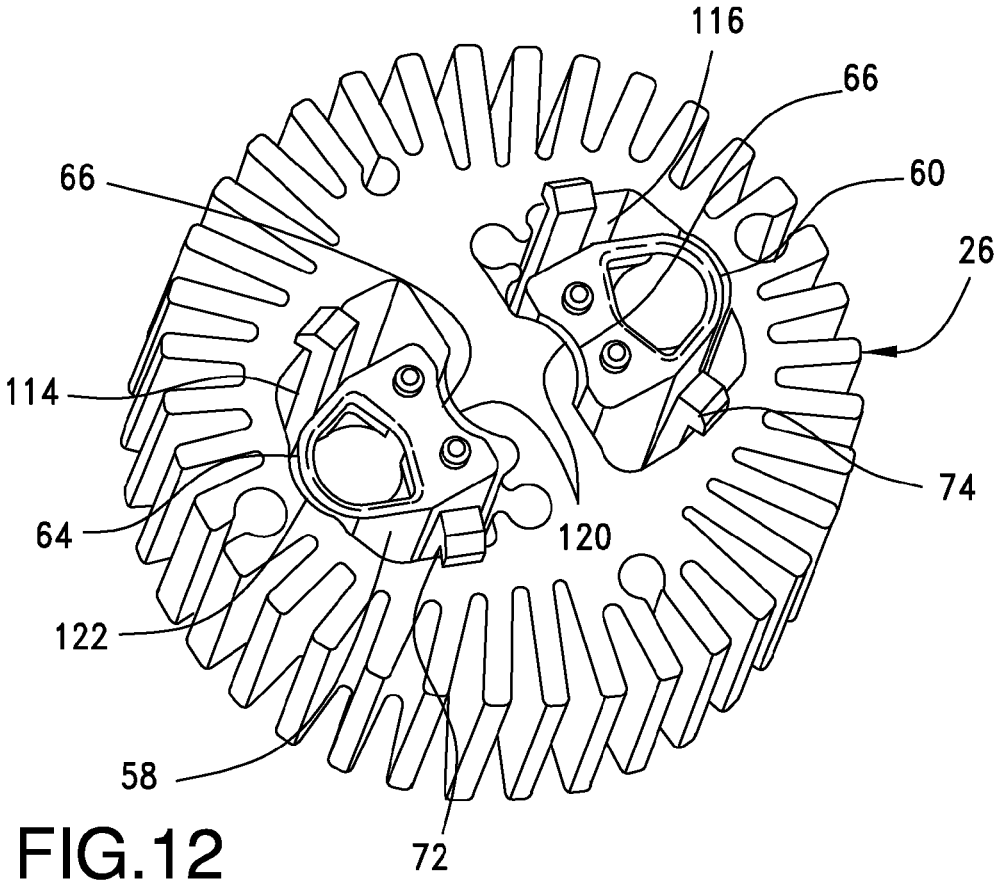
FIG. 12 is a top perspective view of the heat sink of FIG. 10 having the housing of FIGS. 5 and 6 attached thereto.

As shown in FIG. 11, the heat spreader 28 is a thin, thermally conductive plate, and can be formed out of materials such as copper or aluminum or any other material with high thermal conductivity that can help provide a low thermal resistivity between the LED array and the heat sink, which in an embodiment can be less than two (2) degrees Celsius per watt (C/W). As depicted, the heat spreader 28 includes a central body 34 which has an outer edge 135 that conforms to the shape of the upper surface of the base 106 of the heat sink 26 and can include a plurality of spoke-like, spaced-apart fingers 136 which extend from the outer edge 135 and conform to the shape of the spoke-like fingers 110 formed by the fins 108 of the heat sink 226. If desired, the heat spreader 28 is positioned between the underside of the LED module 22 and the upper surface of the heat sink 26 and the fingers 136 of the heat spreader 28 align with the fingers 110 of the heat sink 26. A thermal pad (which can be a thermally conductive adhesive gasket such as, for example, 3M's Thermally Conductive Adhesive Transfer Tape 8810) can be provided between the heat sink and the heat spreader. If the thermal pad is used, it can be formed of the thermally conductive adhesive gasket and can be cut to the desired shape from bulk stock and applied in a conventional manner. If the heat spreader includes fingers, the thermal pad can also include fingers that are aligned with the fingers of the heat spreader. The central body 134 of the heat spreader 28 has a plurality of apertures 138, 140, 142*a*, 142*b*, 144*a*, 144*b*, 146 for reasons described herein. Apertures 138/142*a*/142*b* are spaced apart from apertures 140/144*a*/144*b* to form a bridge section 147 therebetween. Apertures 138, 140 can be sized to conform to and align with the channels 114, 116. Apertures 142*a*, 142*b*, 144*a*, 144*b* can be sized to conform to and align with the locating protrusions 70 of the housing 24; and apertures 146 can be sized to conform to and align with the holding projections 72, 74 of the housing 24.

The heat spreader 28 may have a thickness (from the top surface (which abuts the heat puck 52/LED module 22) to the bottom surface (which abuts the heat sink 26)) which is greater than 0.5 mm. For most applications, it has been determined that when high thermal conductivity materials (e.g., materials with a thermal conductivity of greater than 100 W/m-K) are used for the heat spreader 28, there are reduced benefits to having the heat spreader 28 be greater than about 1.2 mm thick and having a thickness of less than 1.5 mm can be beneficial from a weight standpoint. That being noted, for certain higher wattage applications (e.g., greater than 10 watts) a thicker heat spreader may still provide some advantages.

In use, the heat spreader 28 is positioned between the underside of the LED module 22 and the upper surface of the heat sink 26 and the fingers 136 of the heat spreader 28 align with the fingers 110 of the heat sink 26. In use, the heat spreader 28 abuts the heat puck 52 such that the LED 43 is thermally coupled to the heat spreader 28. If the heat puck 52 is not provided, the heat spreader 28 abuts the underside of the central section 46 of the LED module 22 to thermally couple the LED 43 to the heat spreader 28.

Prior to mounting the LED module 22 on the housing 24, the extensions 58, 60 of the housing 24 are seated within the channels 114, 116 of the heat sink 26 and extend through the apertures 138, 140 of the heat spreader 28. The locating protrusions 70 extend through the apertures 142*a*, 142*b*, 144*a*, 144*b* in the heat spreader 28, and the holding projections 72, 74 extend through the apertures 146. In each channel 114, 116, the concave wall section 66 of the extension 58, 60 abuts against the inner wall section 120 of the heat sink 28 and a portion of the curved wall section 64 of the extension 58, 60 abuts against the outer wall section 122 of the heat sink 26. The holding projections 72, 74 flex inwardly when inserted into the channels 114, 116 and through the heat spreader 28, however, when the heads 78 of the holding projections 72, 74 clear the upper surface of the heat spreader 28, the holding projections 72, 74 resume their original state and the heads 78 engage the upper surface of the heat sink 26. The upper surfaces of the extensions 58, 60 are generally flush with the upper surface of the base 106 of the heat sink 26. As a result, the protrusions 70 extend upwardly from the upper surface of the heat spreader 28. The heat spreader 28 can be mounted on the heat sink 26 prior to or after the housing 24 is engaged with the heat sink 26.

To secure the base cover 90 to the housing 24, the fasteners 88 extend through the apertures 92 in the base cover 90 and through the apertures 86 in the housing 24 and into the fastening channels 128 of the heat sink 26. A portion of the housing 24 is sandwiched between the base cover 90 and the heat sink 26, thus securely fastening the housing 24 to the lower end of the heat sink 26. The base cover 90 supports the conductive members 96. It should be noted that the conductive members 96 can be formed as an integral part of the base cover 90. Alternatively, the conductive members 96 can be a two-piece design that assembles to the base cover 90.

The heat puck 52 (if provided) seats on the bridge portion 147 of the heat spreader 28 and thus is in thermal communication with the enlarged portion 126 of the bridge portion 118 of the heat sink 26. If the heat puck 52 is not provided, the central section 46 of the LED module 22 seats on the bridge portion 147 of the heat spreader 28 and thus is in thermal communication with the enlarged portion 126 of the bridge portion 118 of the heat sink 26. The heat puck 52 and/or the central section 46 can be connected to the heat spreader 28 by a thermally conductive epoxy. The ends of the anode 42 and the cathode 44 of the LED module 22 align with the apertures 138 in the heat spreader 28 and thus with the channels 114, 116 through the heat sink 226.

As shown in FIGS. 1 and 2, the reflector 30 is formed from a wall 148 and a plurality of fins 150 which extend therefrom. The wall 148 has an inner surface 152 that is angled. The upper end of the wall 148 provides the illumination face 34. The reflector 30 can also be thermally conductive (e.g., can be provided with a thermally conductive plating).

The plurality of fins 150 extending radially outwardly from the wall 148 and as depicted, the outer surface of the fins 150 is straight. As shown, the same number of fins 150 are provided on the reflector 30 as are provided on the heat sink 26 and the fins 150 on the reflector 30 are aligned with the fins 108 on the heat sink 26 when the reflector 30 is mounted on the heat sink 26. This provides an advantageous appearance and also minimizes the distance thermal energy needs to travel. A similar effect without the fins 150, 108 being aligned could be also provided if a heat spreader, such as a ring-shaped heat spreader, were positioned between the fins 150, 108 but such a design may be considered to be less attractive.

A pair of alignment pins 162 are diametrically opposed and extend from the lower surface of the wall 148 at the periphery thereof. The lower end of the wall 148 has an aperture 154 and associated first and second recesses 156, 158 which are shaped like the lens cover 32 as described herein. A first pair of recesses 164 extend upwardly from the lower surface of the wall 148 and are proximate to the first recess 156. A second pair of recesses 166 extend upwardly from the lower surface of the wall 148 and are proximate to the second recess 158.

Figure 13:
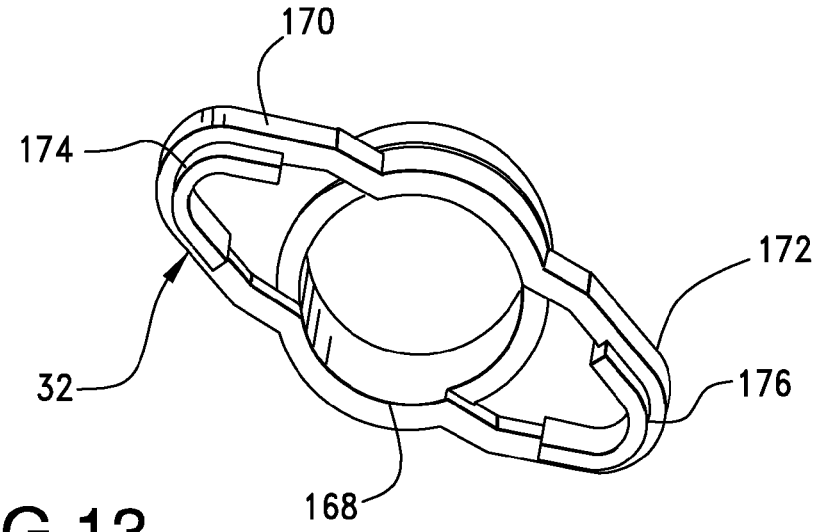
FIG. 13 is a bottom perspective view of a lens cover used in the light module of FIG. 1.
Figure 14:
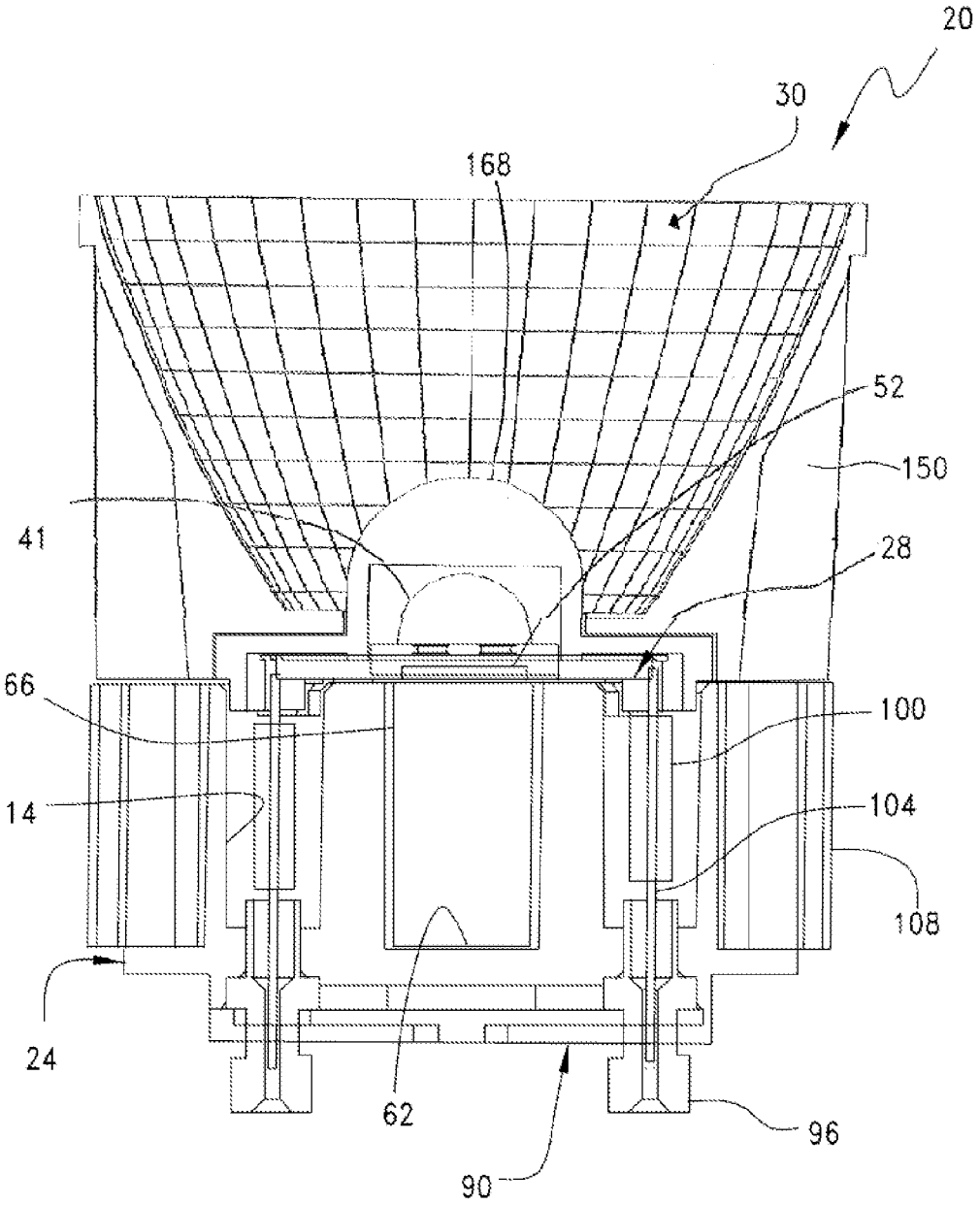
FIG. 14 is a cross-sectional view of the light module taken along line 31-31 in FIG. 7.
Figure 15:
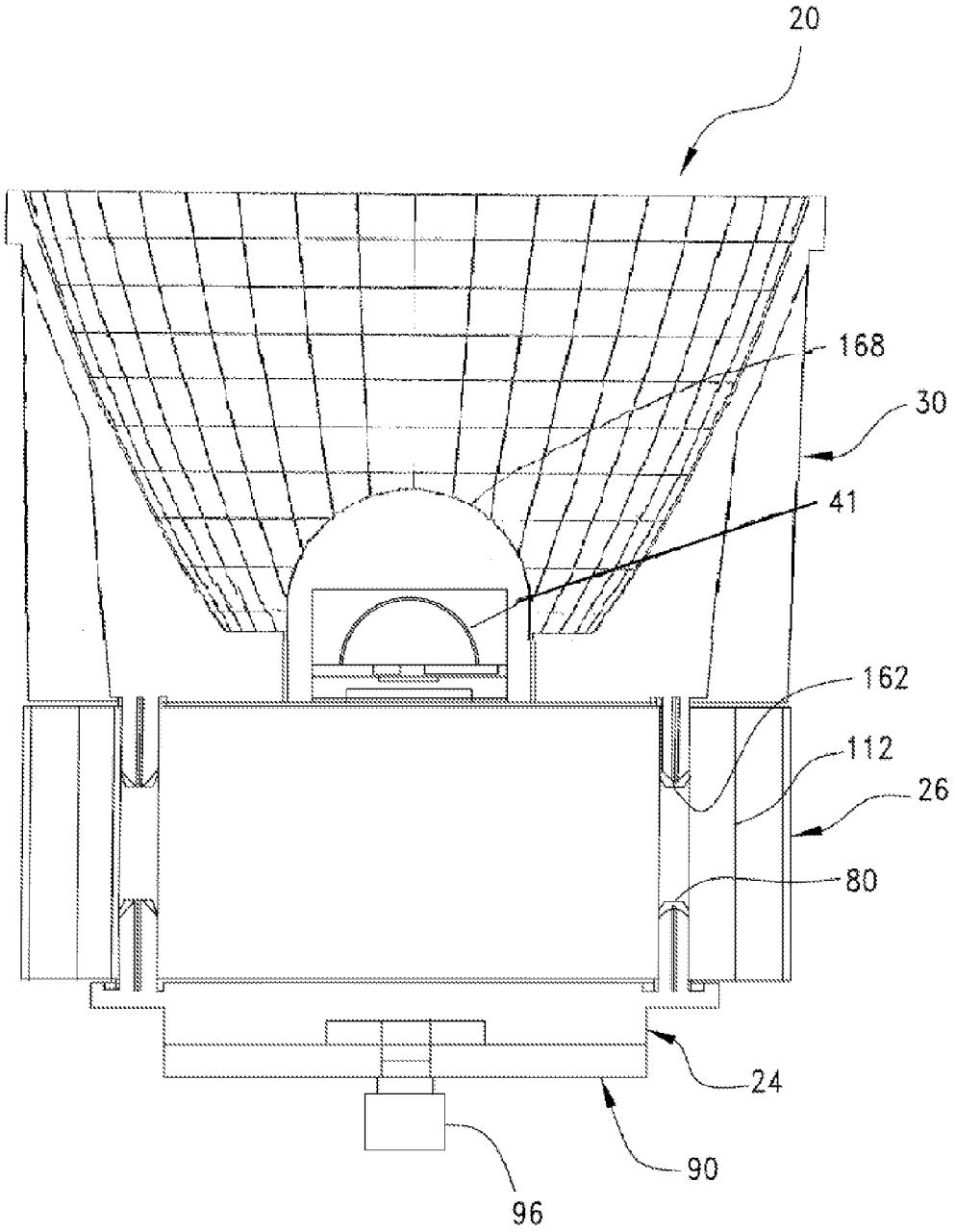
FIG. 15 is a cross-sectional view of the light module taken along line 32-32 in FIG. 7.

As shown in FIG. 13, the lens cover 32 has a concave lens 168 from which a pair of flanges 170, 172 extend outwardly. A shoulder 174, 176 extends downwardly from each flange 170, 172. A recess is provided in the bottom surface of each flange 170, 172 for housing the anode 42 and the cathode 44 of the LED module 22. The lens 168 provides a cavity into which the LED cover 41 is seated. The LED cover 41 and the lens 168 are shaped to provide the desired light output onto the reflector 30 so that light emitted from the lens 168 can be focused by the reflector 30. The shoulders 174, 176 extend through the apertures 138, 140 in the heat spreader 28 and seat on the upper end of the arcuate wall sections 64 of the extensions 58, 60. The lens cover 168 provide electrical isolation for the anode 42 and the cathode 44 of the LED module 22 from the reflector 30. When the lens cover 32 is seated in the reflector 30, the lens 68 seats within the aperture 154 and the flanges 170, 172 seat within the recesses 156, 158.

The lower surface of the reflector 30 seats on top of the heat spreader 28 and the heads 78 of the holding projections 70, 72 extend into the recesses 164, 166. The alignment pins 162 seat within the alignment channels 112. The alignment pins 82, 162 on the housing 24 and on the reflector 30 that are inserted into the alignment channels 112 of the heat sink 26 aid in aligning the heat sink 26 with the housing 24 and the reflector 30. An advantage of having the alignment pins 162 in the reflector 30 is that the desired alignment between the fins 150 on the reflector 30 with the fins 108 on the heat sink 26 can be assured. The reflector 30 is attached to the heat spreader 28 by known means, such as adhesive.

When the LED 43 is being driven, the current passing through the LED 43 generates heat that is passed to the heat puck 52 (if provided), then the heat puck 52 transfer heat to the heat spreader 28. The heat then passes to the heat sink 26 and to the reflector 30 and heat spreads outwardly to the fins 108, 150. The channels 114, 116 provide an effective heat channel to conduct heat to from the upper surface of the heat sink 26 to the lower surface of the heat sink 26 such that heat can be dissipated over the length of the fins 108. As a result, when a plated plastic is used for the heat sink 26, the heat is effectively dissipated over the entire heat sink 26.

The heat puck 52 (if used) and the heat spreader 28 can be configured so as to have sufficient high thermal conductivity so as to be substantially irrelevant to the thermal resistivity of the light module 20. For example, the heat puck 52 can be soldered to the heat spreader 28 and as the solder tends to have a thermal conductivity of greater than 15 W/mK and is layered relatively thin, it tends to not be a significant factor is transferring heat away from the LED 43. Furthermore, as the heat puck 52 (if used) and the heat spreader 28 tend to be made of materials with high thermal conductivity (typically greater than 50 W/mK), there tends to be very little thermal resistance between the heat puck 52 and the outer edge 135 of the heat spreader 28.

As noted above, the heat sink 26 can be a conductive material such as aluminum so as to maximize dissipation of heat generated by the LED module 22. The extensions 58, 60 on the housing 24 provide the desired electrical separation between the AC line voltage and the heat sink 26. As depicted, there are two channels 68 and two extensions 58, 60, each with one of the resistive elements 100. In an alternative embodiment, a single extension may extend through an aperture and support both conductive paths between the conductive elements 96 and the anode 42 and the cathode 44. Furthermore, if the light module 20 is configured for use with a DC LED, then the use of resistive element 100 may be omitted.

Figure 16A:
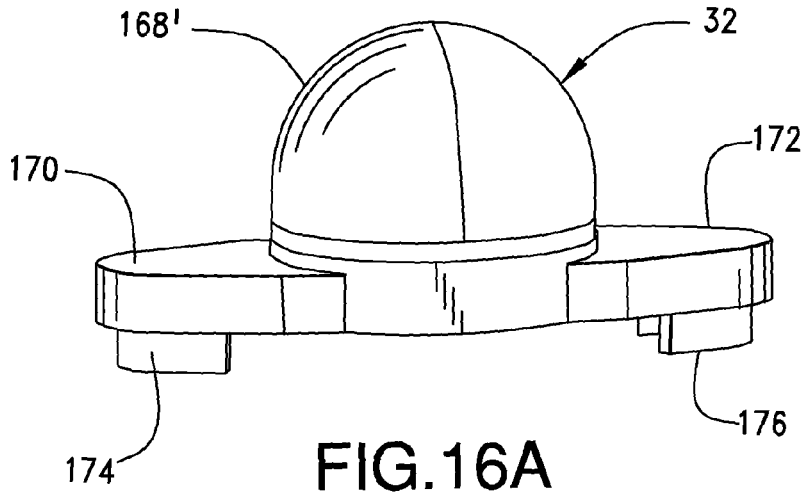
FIGS. 16A, 16B and 16C are perspective view of alternate LED modules that can be used in the light module of FIG. 1.
Figure 16B:
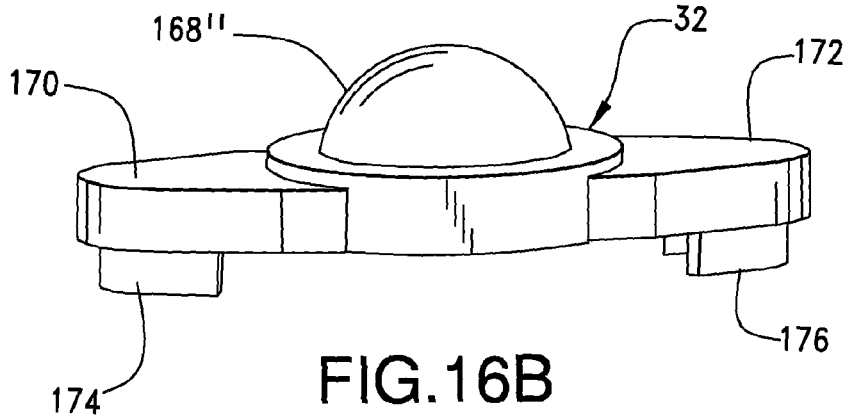
Figure 16C:
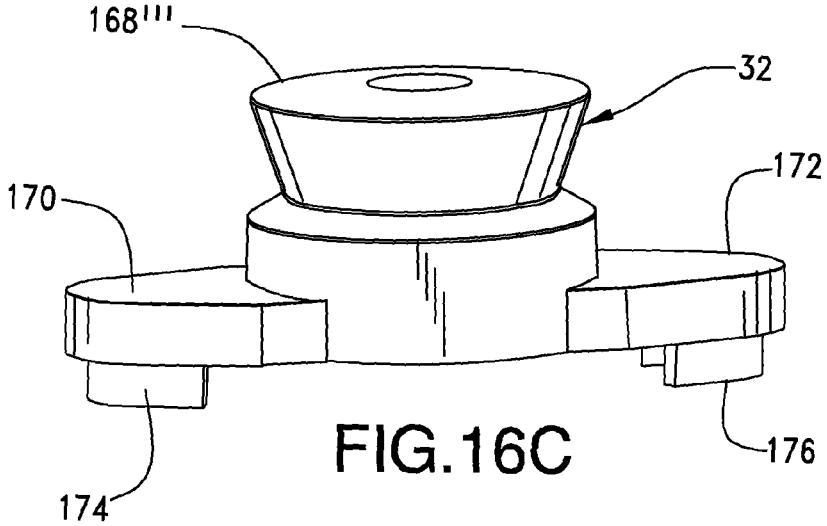
Figure 17:
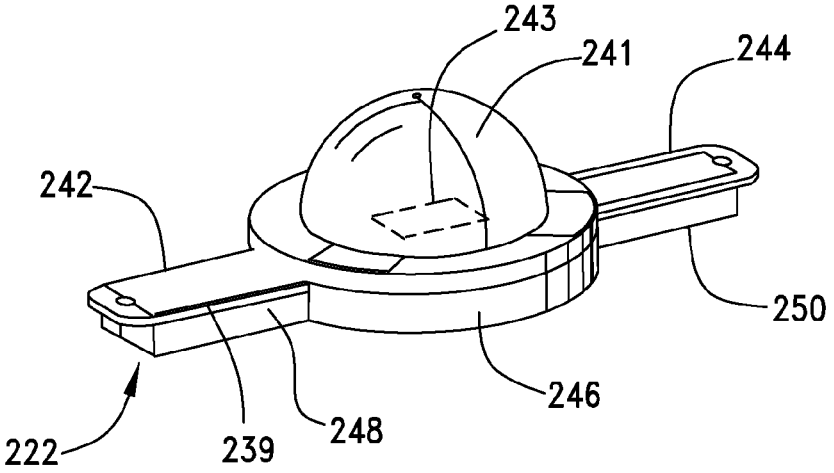
FIG. 17 is a perspective view of a LED module used to house a LED array, which can be used in the light module of FIG. 1.
Figure 18:
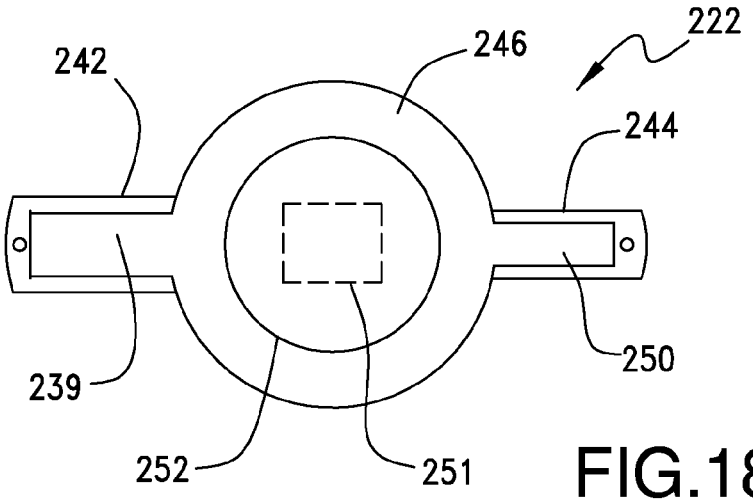
FIG. 18 is a bottom plan view of the LED module of FIG. 17.
Figure 19:
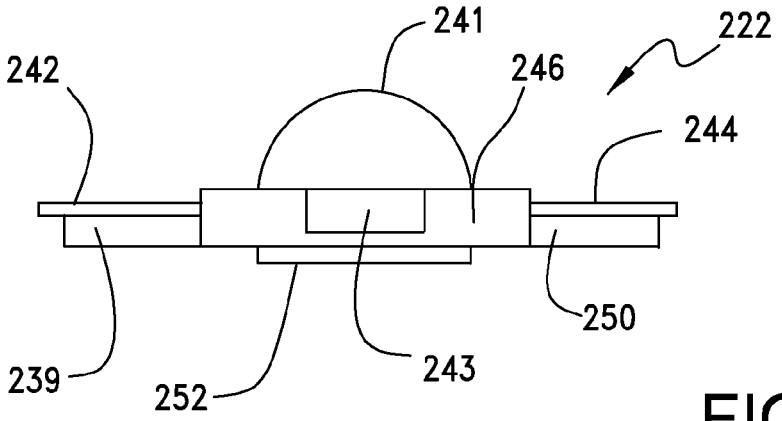
FIG. 19 is a side elevational view of the LED module of FIG. 17.

FIGS. 16A-16C illustrate possible variations in the lens shape, with lens 168' having a exterior portion configured to provide about a 25 degree wide light beam, lens 168" having an exterior portion configured to provide about a 15 degree wide light beam, and lens 168''' with an exterior configured to provide about a 25 degree wide light beam with a brighter center portion. As can be appreciated, in general the exterior shape of the lens could be varied and still provide the desired beam shape as it is a combination of the internal cavity and the external portion but the depicted lens shapes have an attractive appearance when positioned in the provided reflector.

A modified LED module 222 is shown in FIGS. 17-20. The LED module 222 includes an insulative base 239, a LED array 243 provided in the insulative base 239 and exposed along an upper surface thereof, a LED cover 241 seated on the insulative base 239 and covering the LED array 243, an anode 242 electrically coupled to the LED array 243, and a cathode 244 electrically coupled to the LED array 243. The base 239 includes a central section 246 with first and second diametrically opposed arms 248, 250 extending outwardly therefrom. The base 239 houses electronics and the LED 243. The anode 242 is seated on top of the first arm 238, and is slightly longer than the first arm 238 such that the anode 242 extends outwardly therefrom. The cathode 244 is seated on the second arm 250, and is slightly longer than the second arm 250 such that the cathode 244 extends outwardly therefrom. On the lower surface of the central section 246, a first area, which is shown by reference numeral 251, is defined which corresponds to the size of the LED array 243.

A heat puck 252 is provided on the underside of the central section 246. The heat puck 252 may be a conductive element that is integrated into the LED module 222 and attached thereto by a thermally conductive epoxy. The heat puck 252 is thermally coupled to the LED array 243. The heat puck 252 has an area at least as large as the first area 251 of the LED array 243. The heat puck 252 is optional and for designs where the base of the LED module has good thermal conductivity, will not be as beneficial.

The first arm 248 of the LED module 222 seats on top of the first extension 58 (with the heat spreader 28 therebetween as discussed herein) and is positioned between the locating protrusions 70. The second arm 250 of the LED module 222 seats on top of the second extension 60 (with the heat spreader 28 therebetween as discussed herein) and is positioned between the spaced apart locating protrusions 70. The locating protrusions 70 align the LED module 222 with the housing 24 and aid in positioning the anode 242 and the cathode 244 in the desired locations relative to the housing 24 and the heat spreader 28. The edges of the central section 246 of the LED module 222 are positioned over the extensions 58, 60. The heat puck 252 of the LED module 222 is positioned between the concave wall sections 66.

Figure 20:
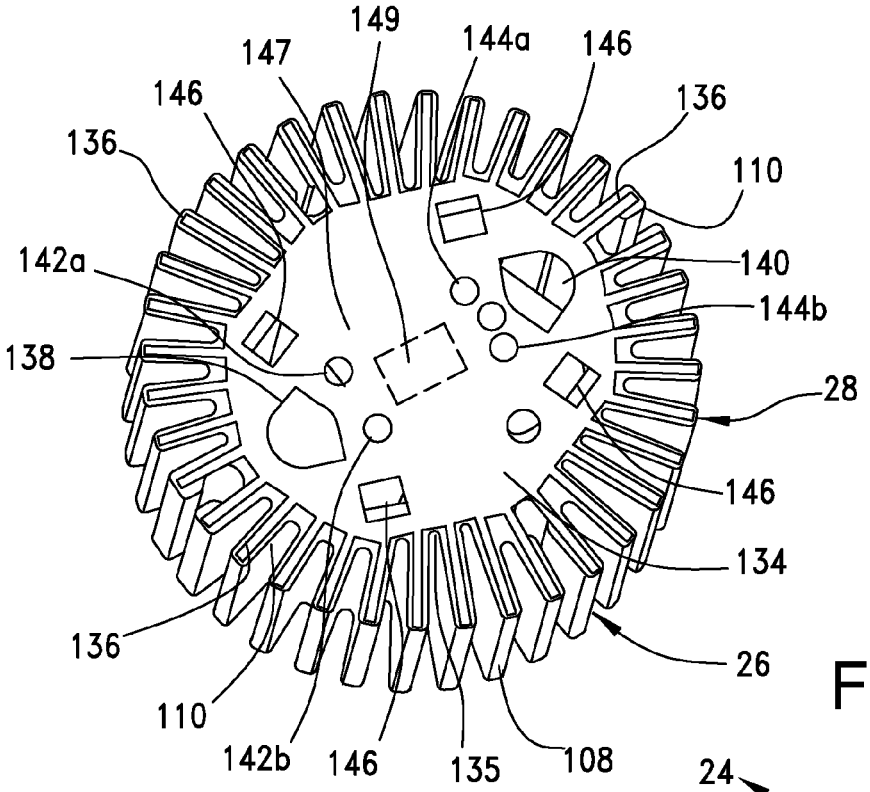
FIG. 20 is a top perspective view of a heat sink for use with the LED module of FIG. 17.
Figure 21:
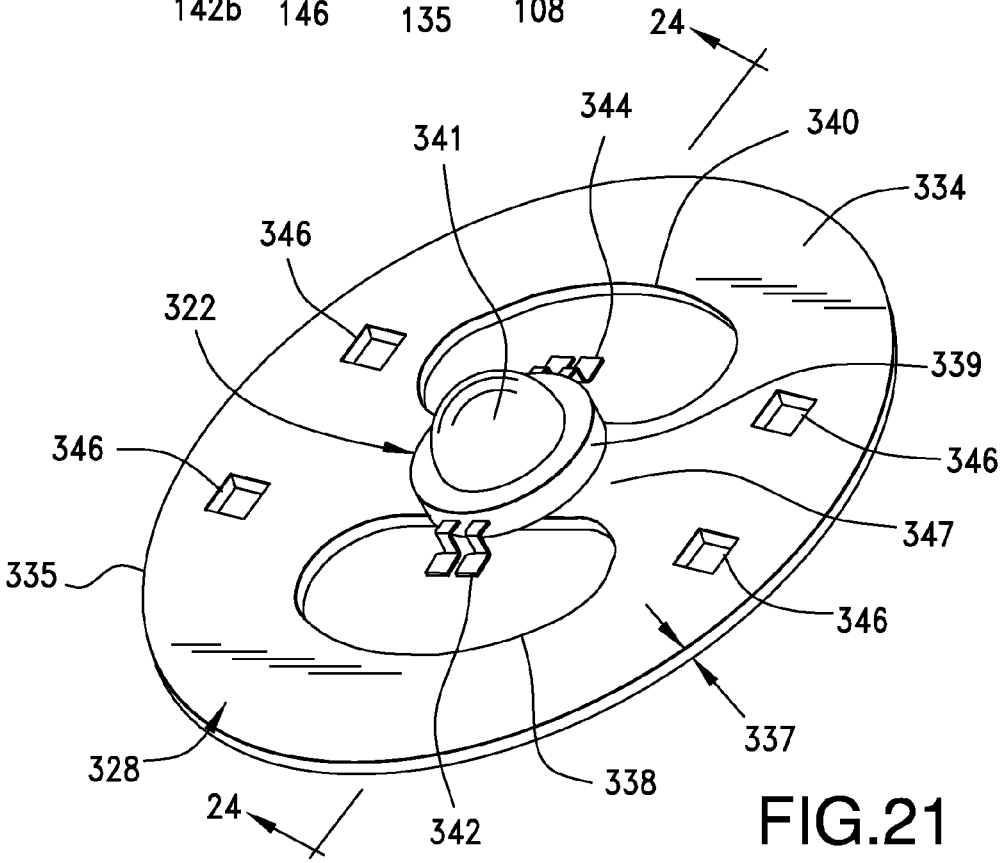
FIG. 21 is a top perspective view of a LED module used to house a LED array and a heat sink, which can be used in the light module of FIG. 1.

As shown in FIG. 20, the bridge section 147 of the heat spreader 28 defines a support area 149 that is at least as large as the first area 251 corresponding to the LED array 243. The heat spreader 28 may be configured as discussed above. In use, the heat spreader 28 is positioned between the underside of the LED module 222 and the upper surface of the heat sink 26 and the fingers 136 of the heat spreader 28 align with the fingers 110 of the heat sink 26. In use, the heat spreader 28 abuts the heat puck 252 such that the LED array 243 is thermally coupled to the heat spreader 28. If the heat puck 252 is not provided, the heat spreader 28 abuts the first area 251 defined on the central section 246 of the LED module 222 to thermally couple the LED array 243 to the heat spreader 28. The heat puck 252 and/or the central section 246 can be connected to the heat spreader 28 by a desirable thermally conductive medium appropriate for joining the two surfaces so as to ensure low thermal resistivity.

The heat puck 252 (if provided) seats on the support area 149 of the heat spreader 28, and thus is in thermal communication with the enlarged portion 126 of the bridge portion 118 of the heat sink 126. If the heat puck 252 is not provided, the central section 246 of the LED module 222 seats on the support area 149 such that the first area 251 abuts the support area 149, and thus the LED array 243 is in thermal communication with the enlarged portion 126 of the bridge portion 118 of the heat sink 226. Therefore, the enlarged portion 126 has an area that is at least as large as the first area 251 corresponding to the LED array 243. The ends of the anode 242 and the cathode 244 of the LED module 222 align with the apertures 138, 140 in the heat spreader 28 and thus with the channels 114, 116 through the heat sink 26.

When the LED array 243 is being driven, the current passing through the LED array 243 generates heat that is passed through to the heat puck 252 (if provided), then to the heat spreader 28. The heat then passes to the heat sink 26 and (if configured appropriately) to the reflector 30 and heat spreads outwardly to the fins 108, 150. In the event that the heat sink is separated in to two regions. The channels 114, 116 (which are an example of a thermal channel) provide an effective heat channel to conduct heat to from the upper surface of the heat sink 26 to the lower surface of the heat sink 26 such that heat can be dissipated over the length of the fins 108. As a result, when a plated plastic is used for the heat sink 26, the heat is effectively dissipated over the entire heat sink 26.

The heat puck 252 (if used) and the heat spreader 28 can be configured so as to have sufficient high thermal conductivity so as to be substantially irrelevant to the thermal resistivity of the light module 20. For example, the heat puck 252 can be soldered to the heat spreader 28 and as the solder tends to have a thermal conductivity of greater than 15 W/mK and is layered relatively thin, it tends to not be a significant factor is transferring heat away from the LED array 243. Furthermore, as the heat puck 252 (if used) and the heat spreader 28 tend to be made of materials with high thermal conductivity (typically greater than 40 W/mK), there tends to be very little thermal resistance between the heat puck 252 and the outer edge 135 of the heat spreader 28.

As noted above, the heat sink 26 can be a conductive material such as aluminum so as to maximize dissipation of heat generated by the LED module 222. The extensions 58, 60 on the housing 24 can be spaced so as provide the desired electrical separation between the AC line voltage and the heat sink 26. However, as can be appreciated, the heat sink 26 can also be a plated plastic.

One of ordinary skill in the art will realize that other forms of a heat sink can be used with this embodiment. For example, heat sink could be a flat plate. It should be noted that the heat sink (with appropriate modifications such as an aperture in the heat sink) can be mounted on either side of the heat spreader 128 (the side facing the LED module 222 or the opposing side). It has been determined that there is a benefit to mounting the heat sink 26 on the opposing side (the side away from the LED module 222) because it tends to be easier to remove a LED module from the heat sink if the LED module is so mounted. Both sides, however, can be effectively used to transfer heat away from the LED module.

Attention is now invited to FIGS. 21-26 which shows an alternate embodiment of a heat spreader 326, a LED module 322 and a heat puck 325 which can be used with the insulative housing 24, the heat sink 26, the reflector 30, the lens cover 32 and the base cover 90 shown in FIGS. 1-17.

Figure 24:
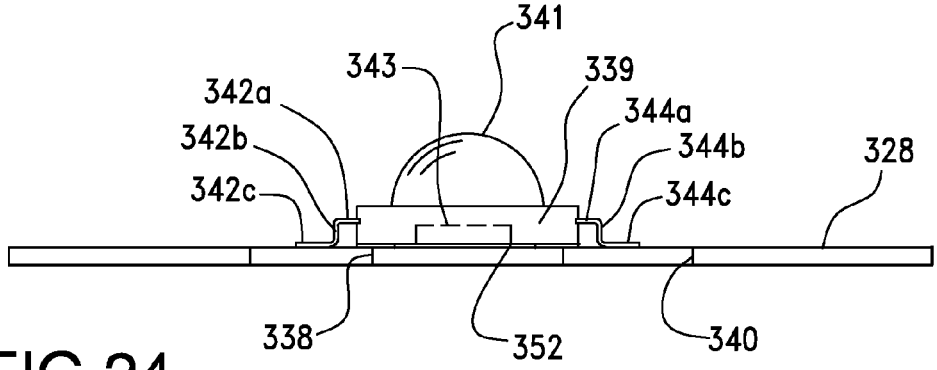
FIG. 24 is a cross-sectional along line 24-24 of FIG. 21.
Figure 25:
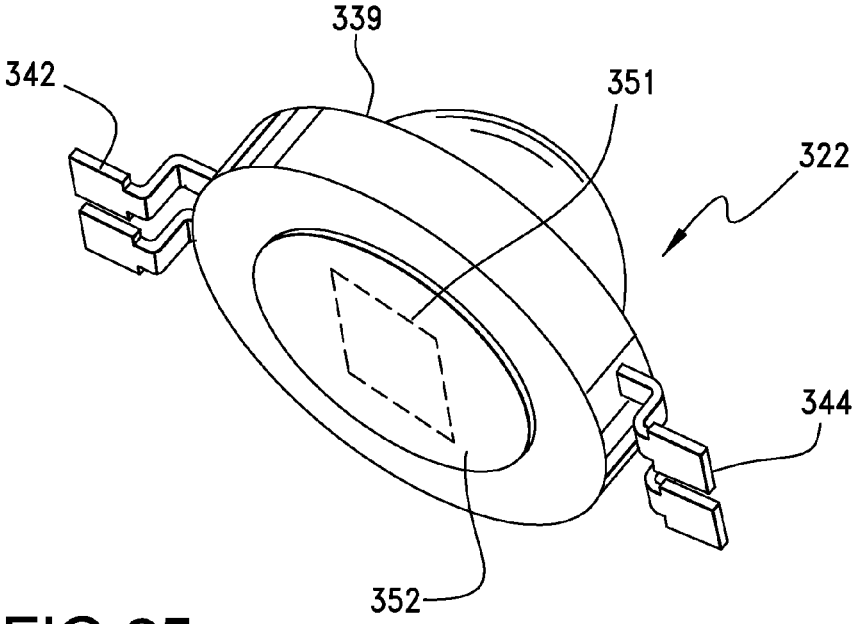
FIG. 25 is a bottom perspective view of the LED module of FIG. 21.
Figure 27:
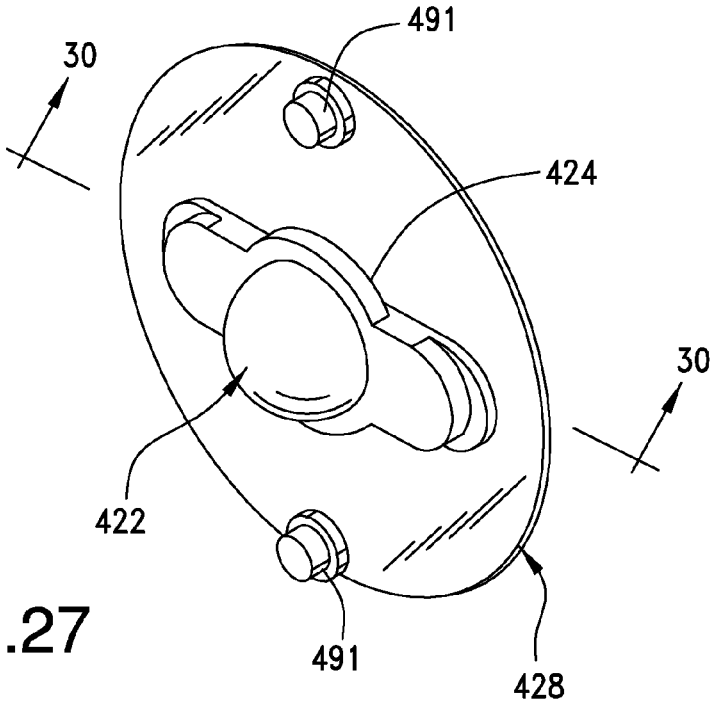
FIG. 27 is a perspective view of a LED module, a heat spreader, and which also includes a thermal pad, all which incorporate the features of the invention.
Figure 28:
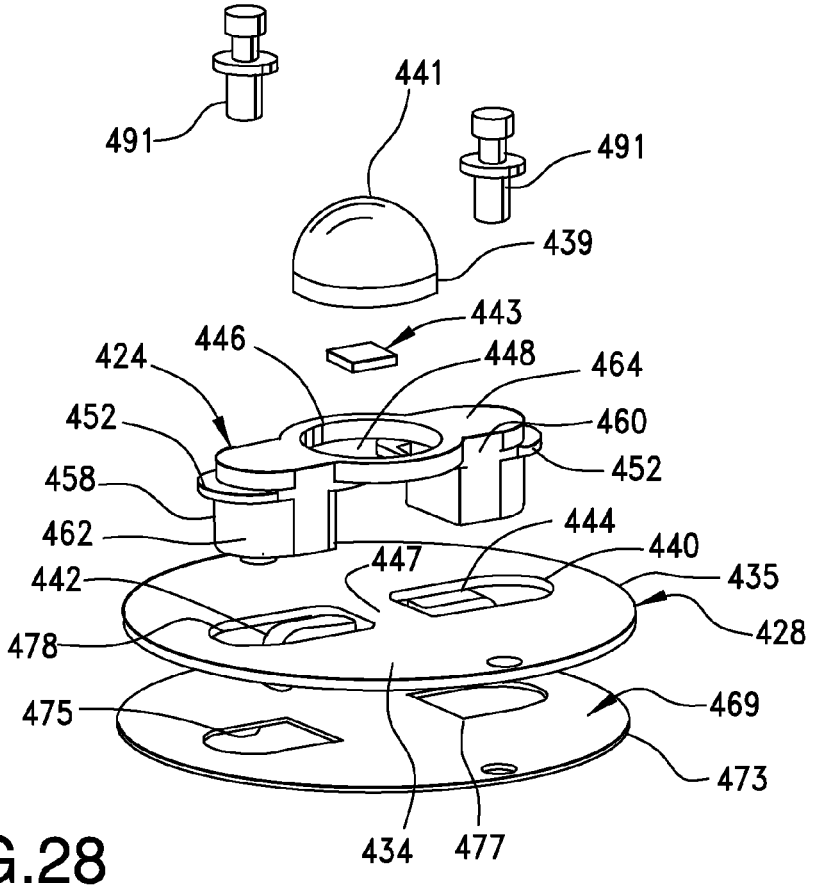
FIG. 28 is an exploded top perspective view of the components shown in FIG. 27.
Figure 29:
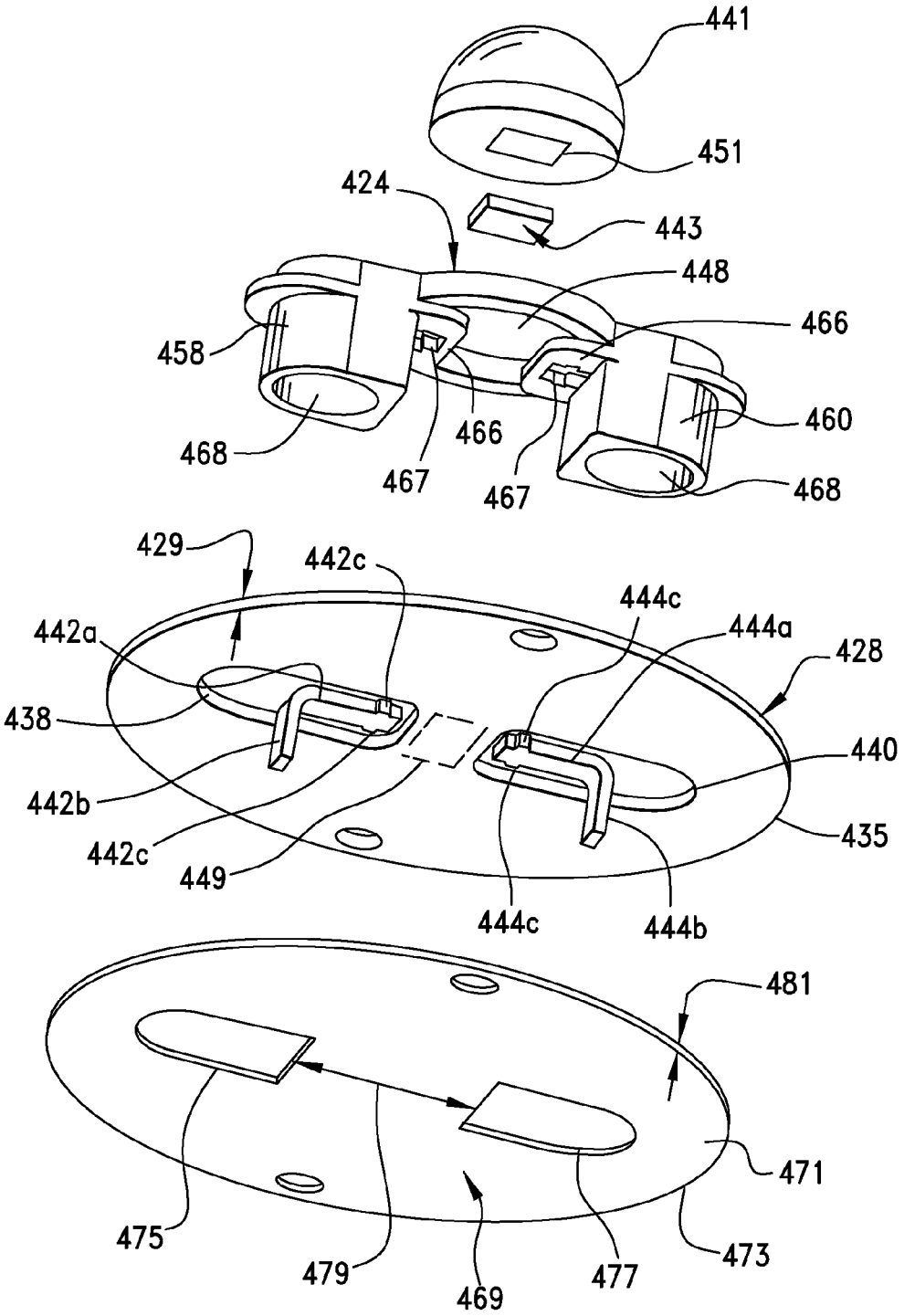
FIG. 29 is an exploded bottom perspective view of the components shown in FIG. 27.
Figure 30:
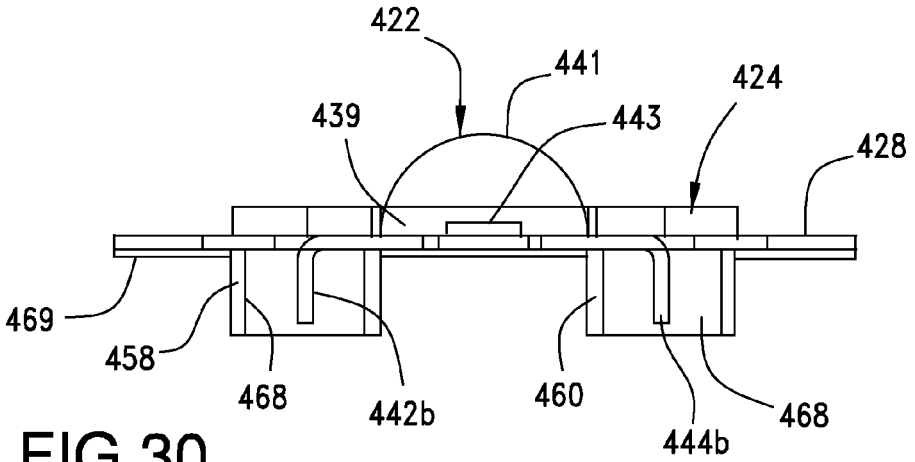
FIG. 30 is a cross-sectional along line 30-30 of FIG. 27.

As shown in FIGS. 24 and 25, the LED module 322 includes an base 339 (which in certain applications may be insulative), a LED array 343 provided in the base 339 and exposed along an upper surface thereof, a LED cover 341 seated on the base 339 and covering the LED array 343, an anode 342 electrically coupled to the LED array 343, and a cathode 344 electrically coupled to the LED array 340. The base 339 can house electronics and the LED array 343. The anode 342 is shown as being Z-shaped and has an upper leg 342*a* extending outwardly from the base 339, an intermediate leg 342*b* extending generally perpendicularly downwardly from the upper leg 342*a*, and a lower leg 342*c* which extends perpendicularly from the intermediate leg 342*b*. The upper leg 342*a* and the lower leg 342*c* are parallel to each other. The cathode 344 is also shown as being Z-shaped and has an upper leg 344*a* extending outwardly from the base 339, an intermediate leg 344*b* extending generally perpendicularly downwardly from the upper leg 344*a*, and a lower leg 344*c* which extends perpendicularly from the intermediate leg 344*b*. The upper leg 344*a* and the lower leg 344*c* are parallel to each other. It should be noted, however, that any desirable shape could be used. On the lower surface of the base 339, a first area, which is shown by reference numeral 351, is defined which corresponds to the size of the LED array 343. Apertures 346 are provided and sized to conform to the holding projections 72, 74 of the housing 24.

A heat puck 352, see FIG. 25, is provided on the underside of the base 339. The heat puck 352 may be a conductive element that is integrated into the LED module 322 and attached thereto by a thermally conductive epoxy. The heat puck 352 is thermally coupled to the LED array 343. The heat puck 352 has an area at least as large as the first area 351 of the LED array 343 and abuts the first area 351. In certain embodiments where the base is thermally conductive, there may be no need to include the heat puck as the base can be considered to integrate the heat puck.

Figure 22:
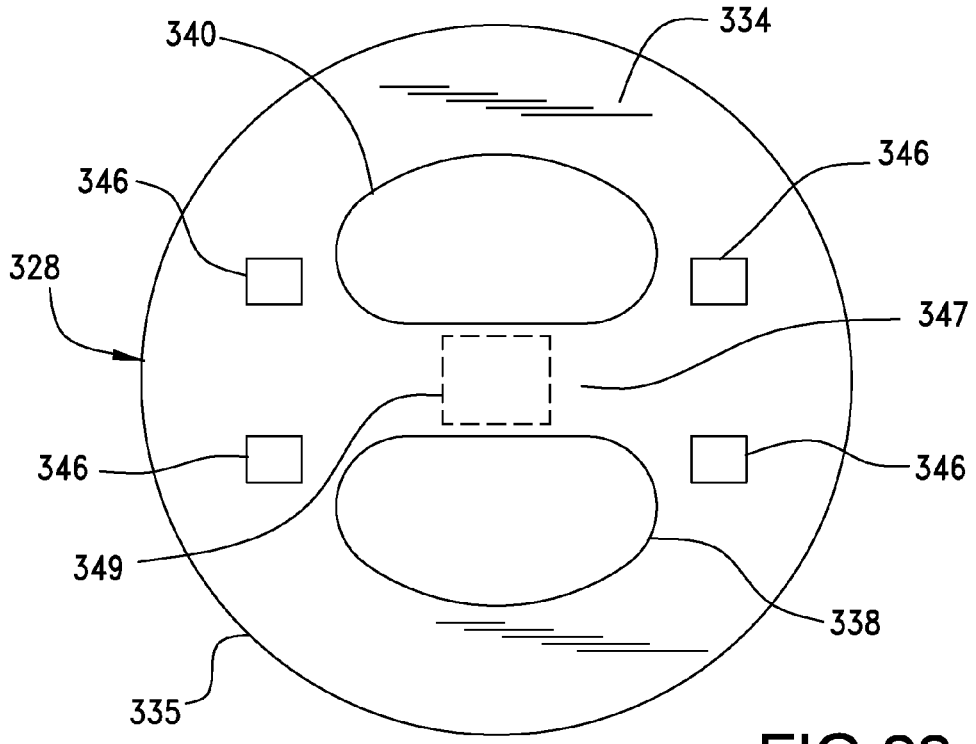
FIG. 22 is a top plan view of the heat sink of FIG. 21.
Figure 26:
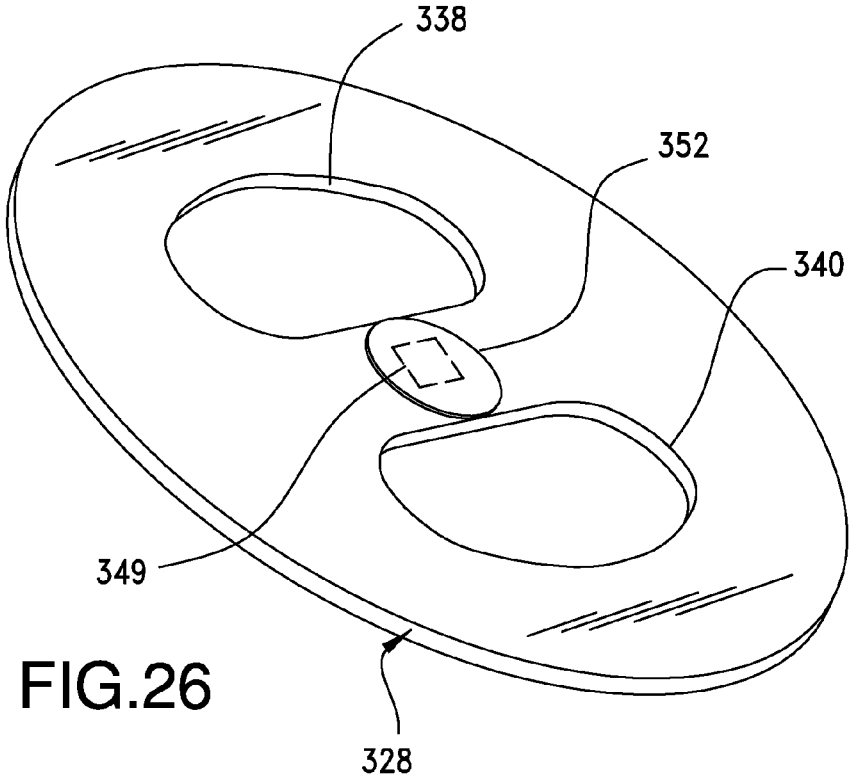
FIG. 26 is a bottom perspective view of the heat sink of FIG. 21 having a heat puck mounted thereon.
Figure 23:
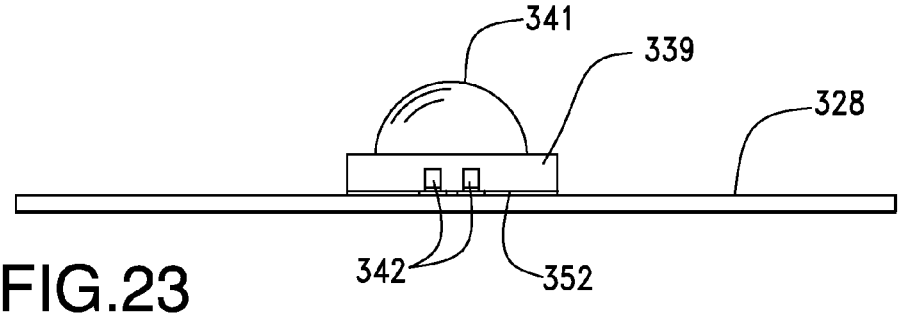
FIG. 23 is a side elevational view of the LED module and heat sink shown in FIG. 21.

As can be appreciated from FIG. 22, the heat spreader 328 can be configured as discussed above. The heat spreader 328 includes a body 334 which has an outer edge 335 that conforms to the shape of the upper surface of the base 106 of the heat sink 26. The central body 334 has a pair of spaced apart apertures 338, 340 therethrough which align with the channels 114, 116 for the acceptance of the extensions 58, 60 and the locating protrusions 70 therethrough. Aperture 338 is spaced away from aperture 340 to form a bridge section 347 therebetween. The bridge section 347 defines a support area 349 that is at least as large as the first area 351 corresponding to the LED array 343. Apertures 338, 340 are sized to conform to the extensions 58, 60 and the locating protrusions 70 of the housing 24, and apertures 346 are sized to conform to the holding projections 72, 74 of the housing 24. Each aperture 338, 340 are sized to so as to define a second area that is at least two times the first area 351, and is preferably four times the first area 351.

In use, the heat spreader 328 is positioned between the underside of the base 339 (or the heat puck 325 if so included) and the upper surface of the heat sink 26. The extensions 58, 60 of the housing 24 are seated within the channels 114, 116 of the heat sink 26 and extend through the apertures 338, 340 of the heat spreader 328. The locating protrusions 70 extend through the apertures 338, 340 of the heat spreader 228, and the holding projections 72, 74 extend through the apertures 346. As can be appreciated, the base 339 or heat puck 352 seats on the support area 349 of the heat spreader 328, and thus is in thermal communication with the enlarged portion 126 of the bridge portion 118 of the heat sink 26. This allows heat to be moved from the LED module to the heat sink, where it can be safely dissipated.

The upper leg 342*a* of the anode 342 seats on top of the first extension 58 and is positioned between the locating protrusions 70. The legs 342*b*, 342*c* extend into the channel 68 of the first extension 58. Likewise, upper leg 344*a* of the cathode 344 seats on top of the second extension 60 and is positioned between the locating protrusions 70. The legs 344*b*, 344*c* extend into the channel 68 of the second extension 60. The base 339 of the LED module 322 seats between the extensions 58, 60. The heat puck 352 is positioned between the concave wall sections 66 and seats on the heat spreader 328. As a result, the heat spreader 328 is thermally coupled to the LED array 343. Suitable means for providing power to the LED module 322 is routed through the apertures 338, 340 for connection to the lower legs 342*c*, 344*c* of the anode 342 and the cathode 344.

If the heat puck 352 is not provided, the support area 349 of the heat spreader 328 directly abuts the first area 351 defined on the base 339 of the LED module 322 to thermally couple the LED array 343 to the heat spreader 328. Thus, the LED array 343 is in thermal communication with the enlarged portion 126 of the bridge portion 118 of the heat sink 26. The base 339 can be connected to the heat spreader 328 by a thermally conductive epoxy (or other desirable materials, depending on the construction of the base 339). Therefore, the enlarged portion 126 has an area that is at least as large as the first area 351 corresponding to the LED array 343.

When the LED array 343 is being driven, the current passing through the LED array 343 generates heat that is passed through to the heat spreader 328. The heat then passes to the heat sink 26 and to the reflector 30 and heat spreads outwardly to the fins 108, 150. As noted above, the channels 114, 116 provide an effective heat channel to conduct heat to from the upper surface of the heat sink 26 to the lower surface of the heat sink 26 such that heat can be dissipated over the length of the fins 108. As a result, when a plated plastic is used for the heat sink 26, the heat is effectively dissipated over the entire heat sink 26.

The heat puck 352 and the heat spreader 328 can be configured so as to have sufficient high thermal conductivity so as to be substantially irrelevant to the thermal resistivity of the light module 220, as noted above. In an embodiment, for example, the thermal resistance between the LED array 343 and the heat spreader 328 can be less than two (2) degrees Celsius per watt and in an embodiment can be less than one (1) degree Celsius per watt if a highly thermally efficient LED array is used, such as an LED array that is available from BRIDGELUX.

The heat spreader 328 may have a thickness 337 (from the top surface (which abuts the heat puck 352/LED module 322) to the bottom surface (which abuts the heat sink 26)) which is greater than 0.5 mm and for some applications can be less than 1.5 mm, as noted above. As noted above, one of ordinary skill in the art will realize that other forms of a heat sink can be used with this embodiment. Thus, unless otherwise noted this application is not intended to be limiting in that regard.

Attention is invited to FIGS. 27-30 which shows another alternate embodiment of a heat spreader 426 and a LED module 422 which can be used with the heat sink 26. In this embodiment, the heat puck on the base of the LED module has been eliminated, but a thermal pad 469 is provided.

The LED module 422 includes an insulative base 439, a LED array 443 provided in the insulative base 439 and exposed along an upper surface thereof, a LED cover 441 seated on the insulative base 439 and covering the LED array 443, an anode 442 electrically coupled to the LED array 443, and a cathode 444 electrically coupled to the LED array 440. The base 439 houses electronics, the LED array 443, the anode 442 and the cathode 444. On the lower surface of the base 439, a first area, which is shown by reference numeral 4351, is defined which corresponds to the size of the LED array 443.

The base 439 is mounted on a housing 424 that mounts to the heat spreader 428, which in turn is mounted to the thermal pad 469 and heat sink 26. The housing 424 has a central section 446 which has aperture 448 provided therethrough. The LED module 422 seats in the aperture 448. First and second extensions 458, 460 extend from the central section 446. Each extension 458, 460 has a main body portion 462 which is generally cylindrical in shape and is closed at its upper end by a top wall 464. The main body portion 462 is perpendicular to the central section 446 and extends downwardly therefrom. A passageway 468 extends within each of the extensions 458, 460 and commences at the lower end of the main body portion 462 and terminates at the top wall 464. An inner flange 466 extends inwardly from the main body portion 462 and is positioned beneath the central section 446. The flange 466 extends past the perimeter of the aperture 448, such that when the base 439 is viewed from above, each flange 466 can be seen through the aperture 448. A passageway 467 is formed in each flange 466 and each passageway 467 is in communication with the passageway 468 through the respective extension 458, 460. In each extension 458, 460, the passageway 467 is perpendicular to the passageway 468. An outer flange 452 extends outwardly from each main body portion 462 and is aligned with the respective inner flange 466.

The anode 442 is generally L-shaped and has an upper leg 442*a* and a lower leg 442*b* extending generally perpendicularly downwardly from the upper leg 442*a*. The upper leg 442*a* seats within the passageway 467 of the first extension 458 and the lower leg 442*a* seats within the passageway 468 of the first extension 458. The upper leg 442*a* has a retention feature, shown as tangs 442*c* which extend outwardly therefrom, which seat within like formed recesses in the passageway 467 of the first extension 458. The cathode 444 is generally L-shaped and has an upper leg 444*a* and a lower leg 444*b* extending generally perpendicularly downwardly from the upper leg 444*a*. The upper leg 444*a* seats within the passageway 467 of the second extension 460 and the lower leg 444*a* seats within the passageway 468 of the second extension 460. The upper leg 444*a* has a retention feature, shown as tangs 444*c* which extend outwardly therefrom, which seat within like formed recesses in the passageway 467 of the second extension 458. As a result, an end portion of the upper leg 442*a* of the anode 442 and the upper leg 444*a* of the cathode 444 is exposed when the base 439 is viewed from above.

The heat spreader 428 can be formed in a manner as discussed above. The heat spreader 428 includes a body 434 which has an outer edge 435 that conforms to the shape of the upper surface of the base 106 of the heat sink 26. The central body 434 has a pair of spaced apart apertures 438, 440 therethrough which align with the channels 114, 116 of the heat sink 26. Aperture 438 is spaced away from aperture 440 to form a bridge section 447 therebetween. The bridge section 447 defines a support area 449 that is at least as large as the LED array 443. Apertures 438, 440 are sized to generally conform to the extensions 458, 460. The inner flange 466 and lower portion of the main body 462 of each extension 458, 460 passes through the respective apertures 438, 440 and into the channels 114, 116 of the heat sink 26. If desired, cover 90 can be attached to the lower ends of the extensions 458, 460. The outer flange 452 seats on the upper surface of the heat spreader 428. Suitable means for providing power to the LED module 422 is routed through the extension 458, 460 for connection to the second legs 442*b*, 444*b* of the anode 442 and the cathode 444. Each aperture 438, 440 is sized to so as to define a second area that is at least two times the first area 451, and is preferably four times the first area 451.

The thermal pad 469 is a thin thermally conductive material and has a thickness which can be less than 1 mm, and in an embodiment can be less than 0.5 mm. The thermal pad 469 includes a body 471 which has an outer edge 473. The central body 471 has a pair of spaced apart apertures 475, 477 therethrough which align with the apertures 438, 440 of the heat spreader 428 and the channels 114, 116 of the heat sink 26. The apertures 475, 477 are spaced apart by a bridge section 479 which aligns with bridge section 447 of the heat spreader 428. The thermal pad 469 can help insure that there is electrical separation between the anode 442/cathode 444 and the heat sink 26.

The heat spreader 428 and a corresponding heat sink will tend to have a substantial area of overlap. Naturally, with all other things equal, increasing the area will tend to help reduce thermal resistivity between the heat spreader 428 and the heat sink 26. The thermal pad 452 is thin and has a relatively high thermal conductivity, then even areas of overlap that are only 3 or 5 times the size of the LED array 443 may be sufficient to provide a thermal resistivity between the LED array 443 and a corresponding heat sink that sufficiently low.

In general, the heat spreader 428 has a desired thickness 429 and in an embodiment may be greater than 0.5 mm. The thermal pad 469 also has a thickness 481 and it is desirable to reduce the thickness where possible as the thermal pad 469, if a thermally efficient system is desired, tends to have a thermal conductivity that is more than one order of magnitude less than the thermal conductivity of the heat spreader 428. In an embodiment, the thickness 469 can be about or less than 1.0 mm and in other embodiments may be less than 0.5 mm thick.

The heat spreader 428 and thermal pad 469 can be fastened to the heat sink 26 with fasteners 491, which may be conventional screws or a push-pin type connector or some other fastener that allows the heat spreader 428 and thermal pad 469 to be firmly coupled within apertures (not shown) in the heat sink 26. If desired, the reflector 30 and the lens cover 32 can be used in this embodiment.

Figure 31:
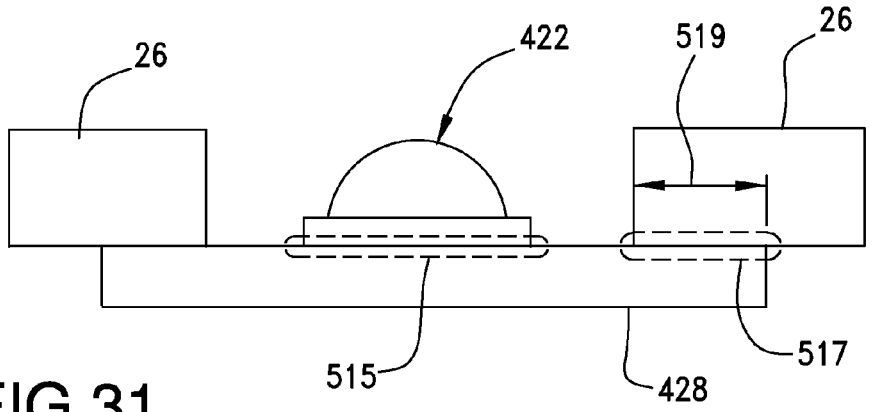
FIG. 31 is a representational view of the interaction between the LED module, the heat sink and the heat spreader.
Figure 32:
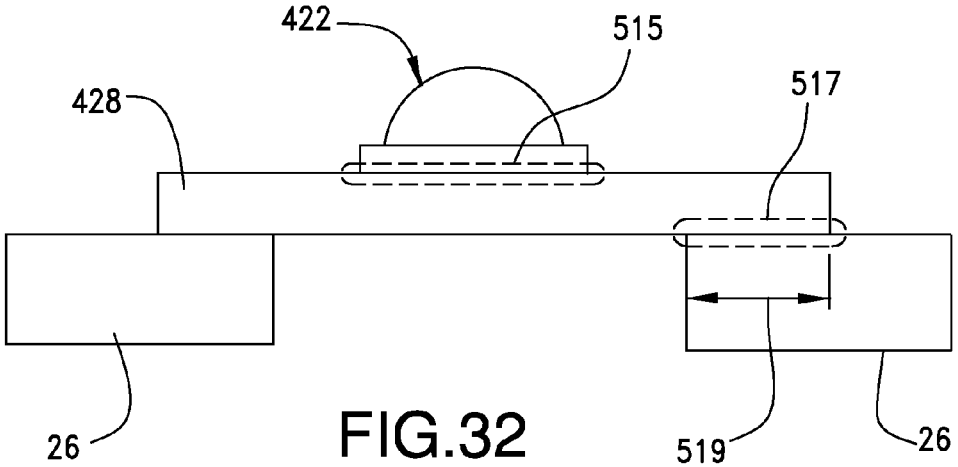
FIG. 32 is an alternate representational view of the interaction between the LED module, the heat sink and the heat spreader.
Figure 33:
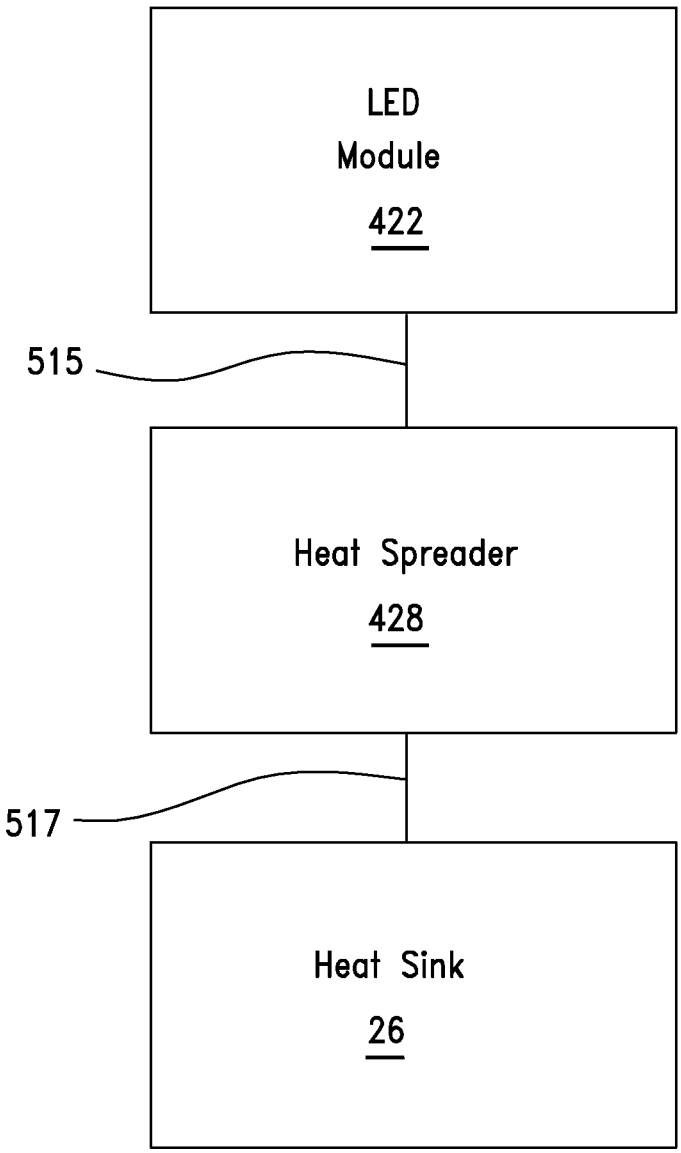
FIG. 33 is a flow chart showing a possible relationship between the LED module, the heat sink and the heat spreader.
Figure 34:
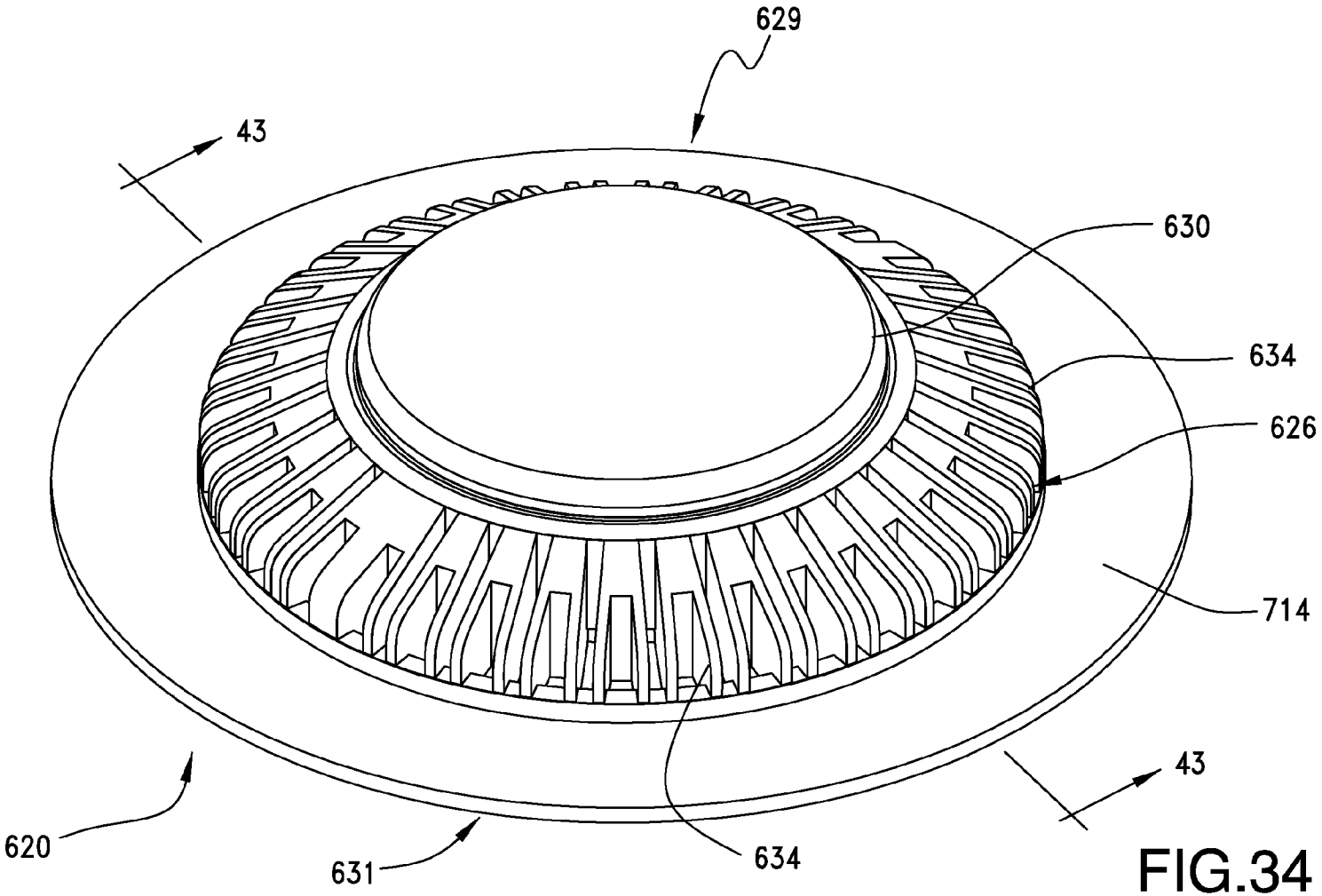
FIG. 34 is a top perspective view of a light module which incorporates the features of the invention.

As can be appreciated from FIGS. 31-32, therefore, there are two primary heat transfer regions that are beneficial to control if a heat spreader (for example heat spreader 428) is to be used with a desirable level of effectiveness. A first region 515 is between the LED module (for example LED module 422) and the heat spreader. A second region 517 is between the heat spreader and the heat sink (for example heat sink 26). The heat spreader is used to move heat away from the LED module so that it can be transferred to the heat sink, and for applications where the heat spreader is about 1 mm thick and made of a material with a higher thermal conductivity (greater than 40 W/mK) (e.g., aluminum, copper, etc.), the thermal resistivity of the heat spreader will not greatly add to the total thermal resistance of the system. Preferably, the second region will have an area that is at least twice the area of the first region and in practice, even if a cross-section contact dimension 519 is not large, it is possible to have the second region to have an area that is four times (or more) greater than the first region because the path the contact sweeps over can be substantial.

For many applications it may be desirable to have the heat spreader and the LED module be removably mounted to the heat sink. In such applications and configuration, one parameter in ensuring sufficient heat is transferred away from the LED module is to provide an area 519 between the heat spreader and the heat sink that is sufficient to ensure that for a given thermal pad thermal conductivity (which tends to be between 0.5 and 10 W/mK for commonly available thermal pads) and thickness (preferably not more than 1.0 mm), the thermal resistivity is below a desired threshold so that the total resistance is below a desired threshold. The desired threshold can vary depending on the temperatures of the surrounding environment and the heat that needs to be dissipated. In lower powered embodiments, the thermal resistivity between the LED module and the heat sink can be below 10 C/W and for more challenging environments and higher power applications, the thermal resistivity may be below 5 C/W or even below 3 C/W. For very high performance designs, the thermal resistance can be below 2 C/W. The benefit of the designs depicted in FIGS. 21-30 is that the area of the heat spreader 228, 328, 428 that transfers heat to the heat sink 26 (the heat transfer area) can be substantially larger than the first area 251, 351, 451, even if the apertures that allow power to be delivered to the LED array 243, 343, 443 have an area that is four or more times larger than the first area 251, 351, 451 (which helps allow for ease in delivering power to the array 243, 343, 443).

In an embodiment, for example, where the thermal resistance between the LED array and the bottom surface of the base of the LED module was less than 1 C/W (and the base was composed of a metal), then the base could be coupled to a copper heat spreader that was 1.5 mm with a thin thermally conductive adhesive and if an efficient thermal pad (for example, about 0.5 mm thick and have a thermal conductivity of about 3 W/mK) was used and the heat spreader had sufficient contact area, the thermal resistance between the LED array and a mating heat sink could be less than 2 C/W.

Attention is now invited to the embodiment of the light module 620 shown in FIGS. 34-43. The light module 620 includes an illumination face 629 that is configured to emit light and a mounting face 631 that is configured to allow the light module 620 to be quickly mounted to a receptacle. The light module 620 include a LED module 622, an insulative housing 624, a heat sink 626, a heat spreader 628, a lens cover 630 and a base cover 633. Because this embodiment is a low profile light module 620, the reflector of the prior embodiments has been eliminated.

Figure 38:
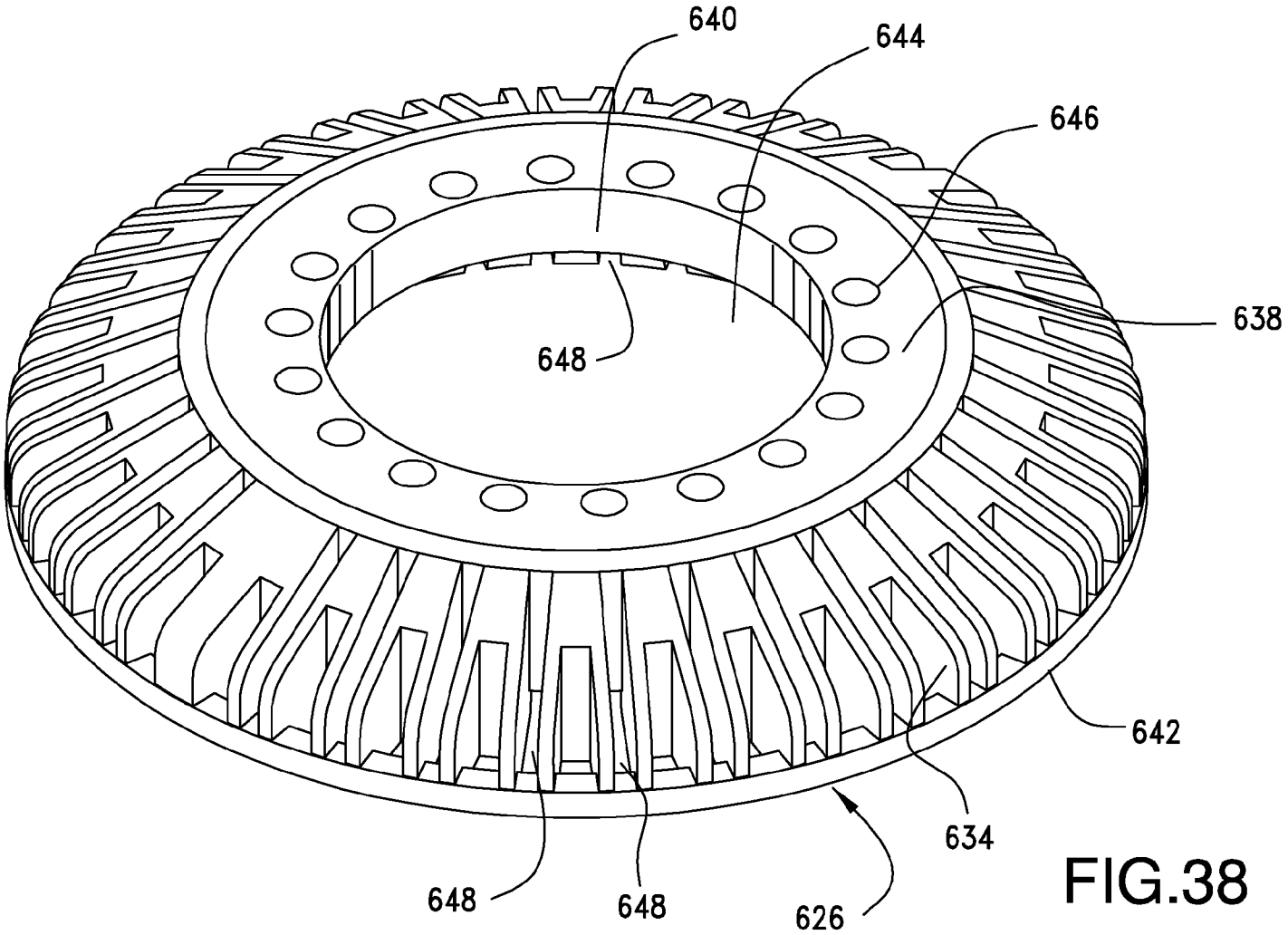
FIG. 38 is a top perspective view of a heat sink used in the light module of FIG. 34.
Figure 39:
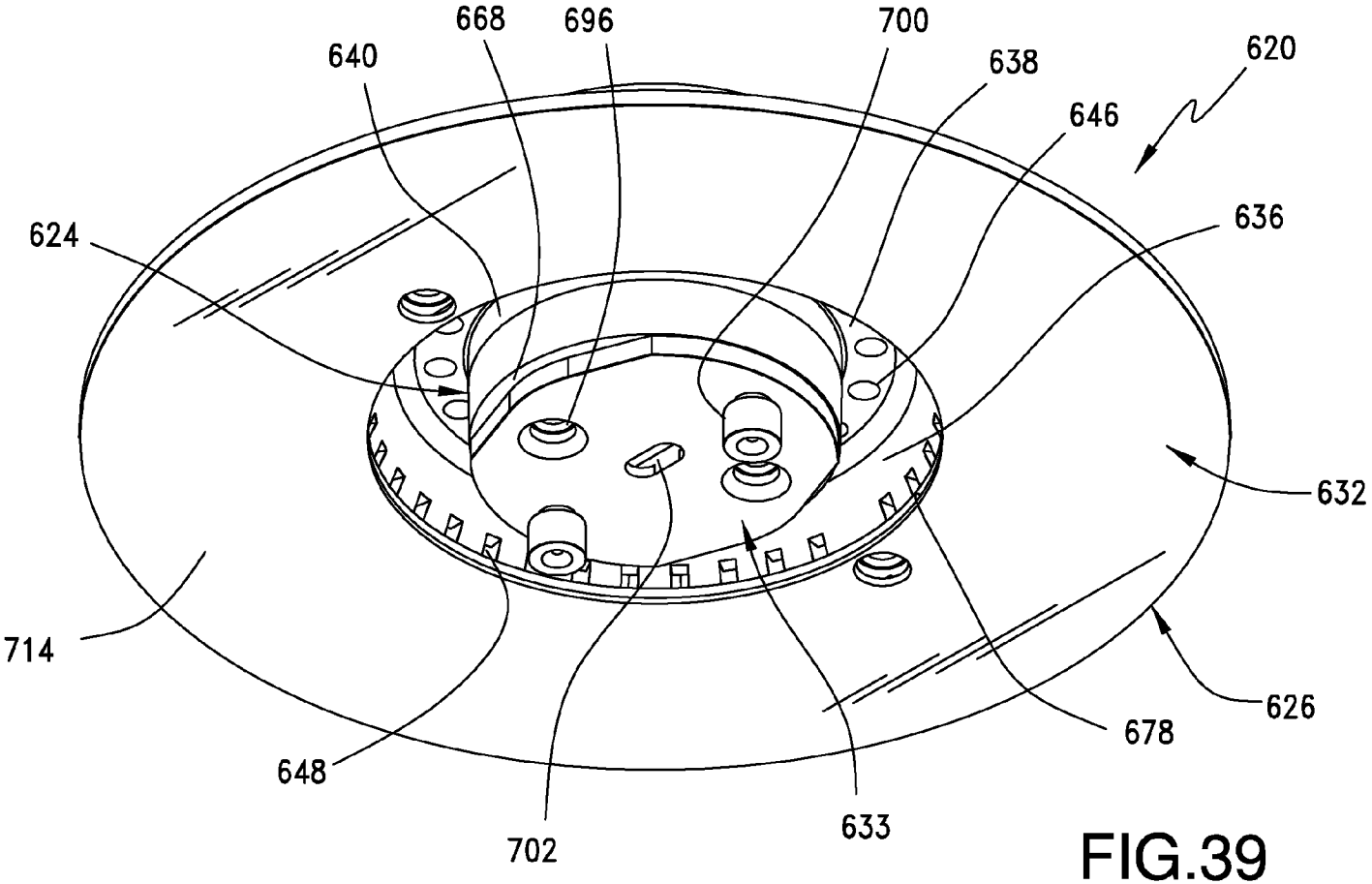
FIG. 39 is a bottom perspective view of the partially assembled light module of FIG. 34.

The heat sink 626, as best shown in FIGS. 38 and 39, includes a base 632 which has a plurality of fins 634 thereon. The base 632 is formed from an upright wall 636, an upper ring 638 that extends perpendicularly inwardly from an upper end of the upright wall 636, a skirt 640 that depends downwardly a predetermined distance from the upper ring 638 at its inner end, and a lower ring 642 that extends perpendicularly outwardly from a lower end of the upright wall 636. A passageway 644 is provided through the center of the heat sink 626 and is defined by the skirt 640 and the upright wall 636. As shown, the upright wall 636 is circular, however, it may take a variety of forms. A plurality of spaced apart channels 646 are provided through the upper ring 638 and are in communication with the passageway 644. The channels 646 are only open to the upper and lower surfaces of the base 632. That is to say, the walls which form the sides of the channels 646 are uninterrupted.

The fins 634 are spaced apart from each other. The fins 634 extend radially outwardly from the upright wall 636 and extend upwardly from the lower ring 642. As depicted, the fins 634 have an upper edge which tapers from the upper ring 638 downwardly and outwardly to the lower ring 642. As can be appreciated, however, other shapes of fins can be used as desired. A plurality of apertures 648 are provided through the upright wall 636 between adjacent ones of the fins 634.

Figure 35:
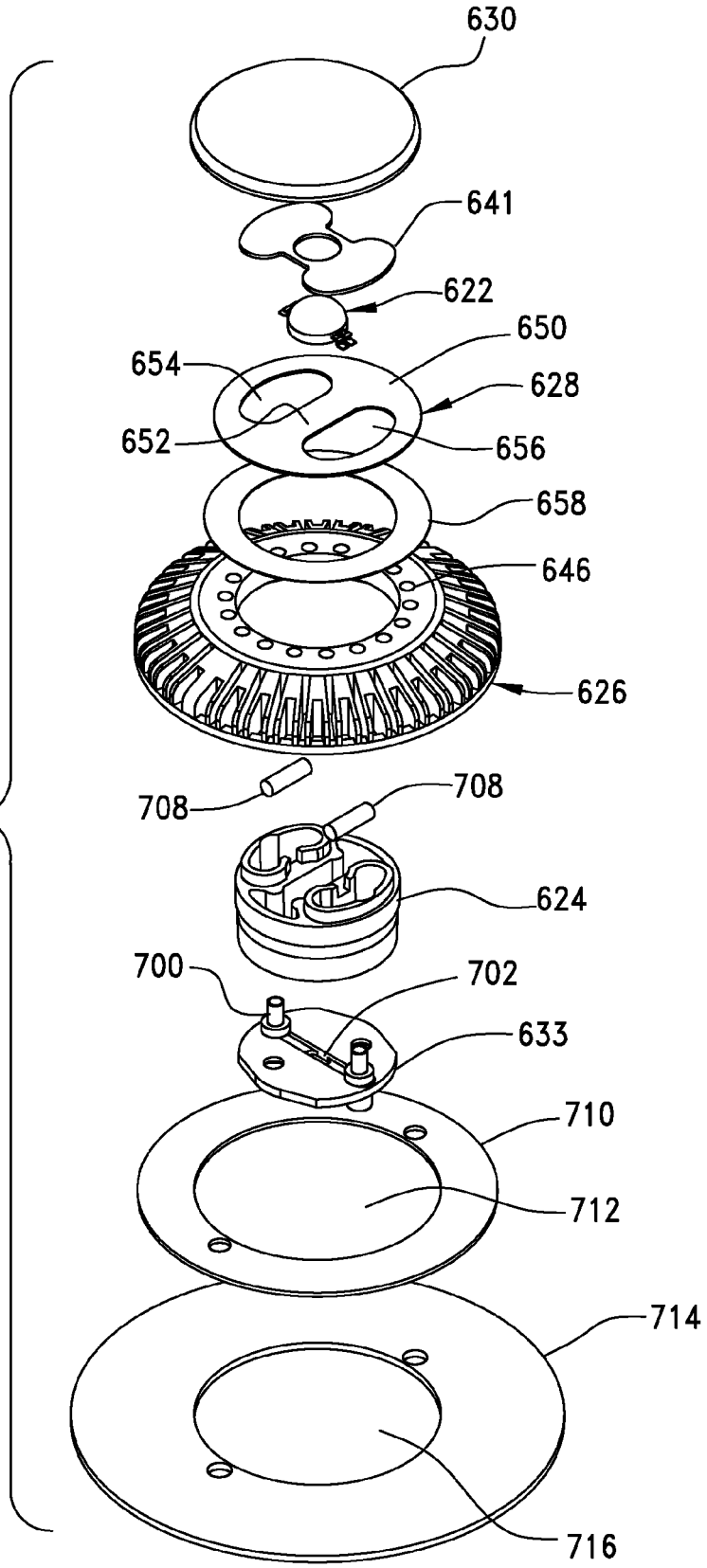
FIG. 35 is an exploded perspective view of the components of the light module of FIG. 34.
Figure 42:
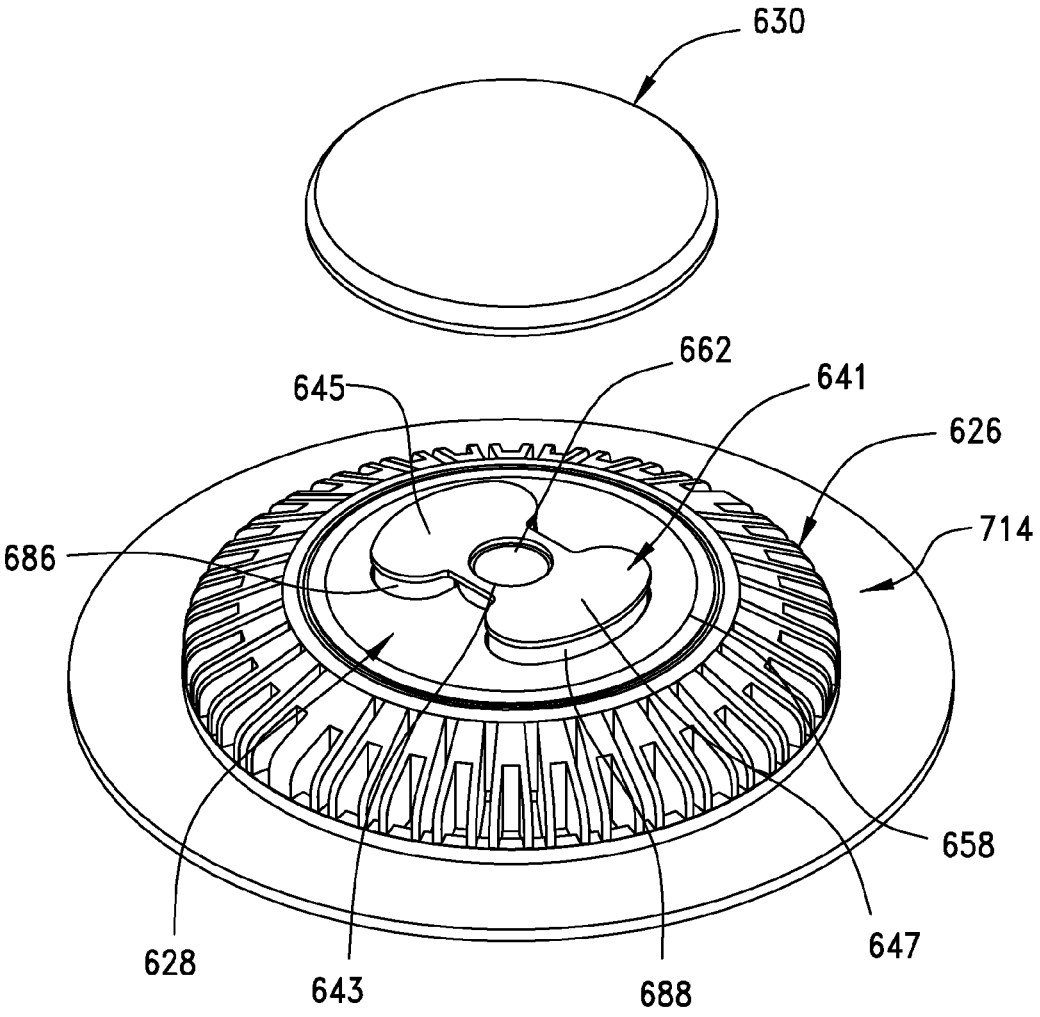
FIG. 42 is another partially exploded perspective view of the light module of FIG. 34.
Figure 43:
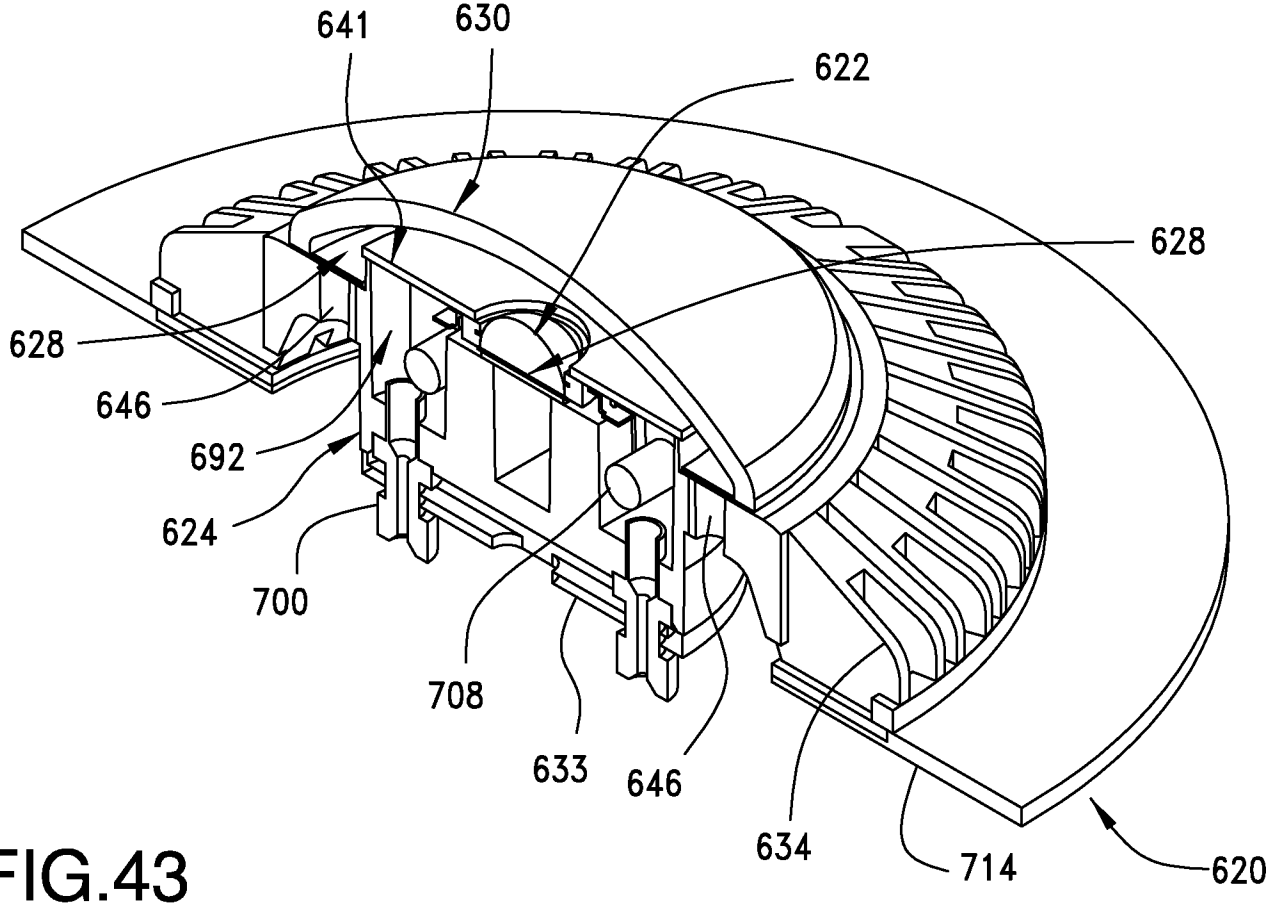
FIG. 43 is a cross-sectional view of the light module taken along line 43-43 in FIG. 34.
Figure 44:
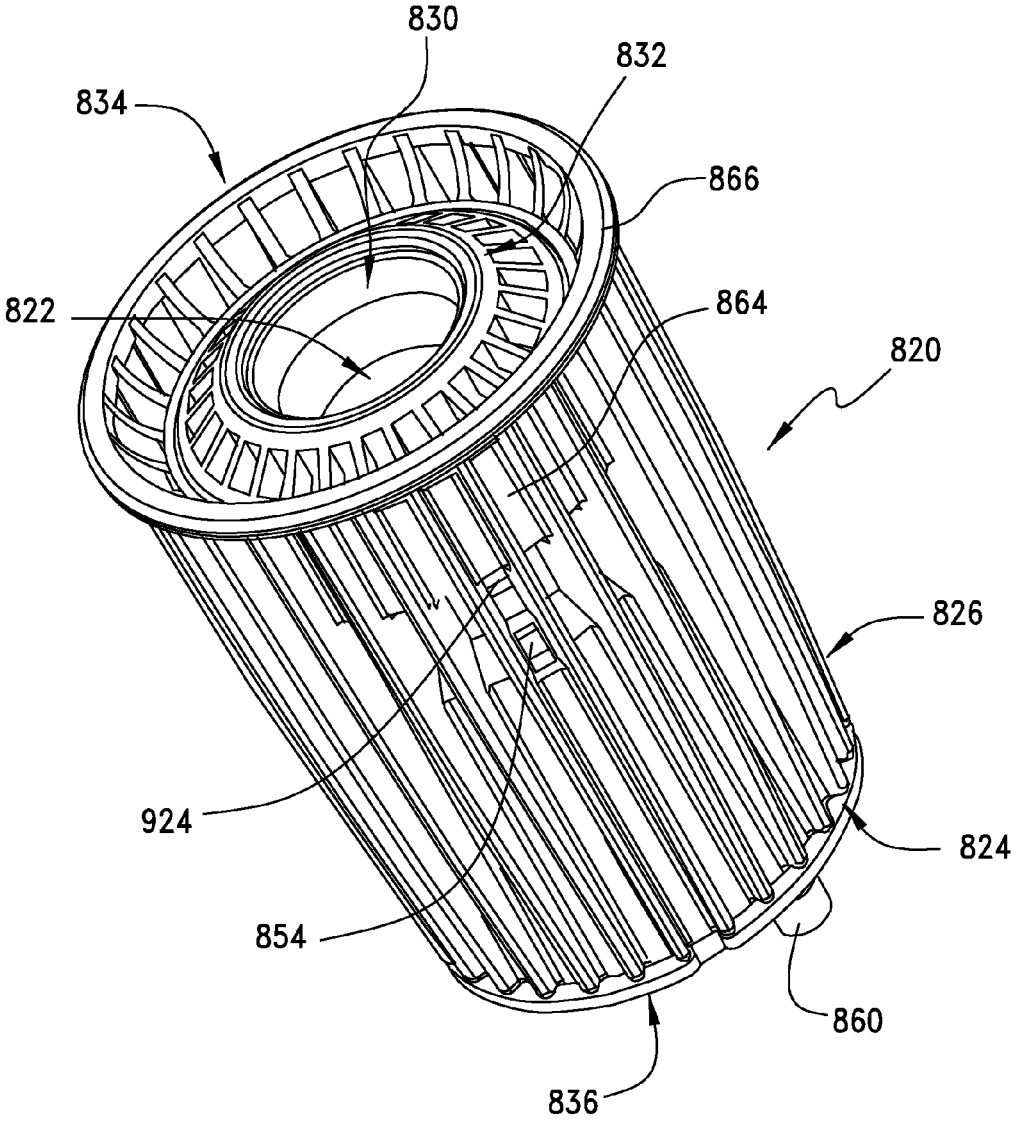
FIG. 44 is a top perspective view of a light module which incorporates the features of the invention.
Figure 45:
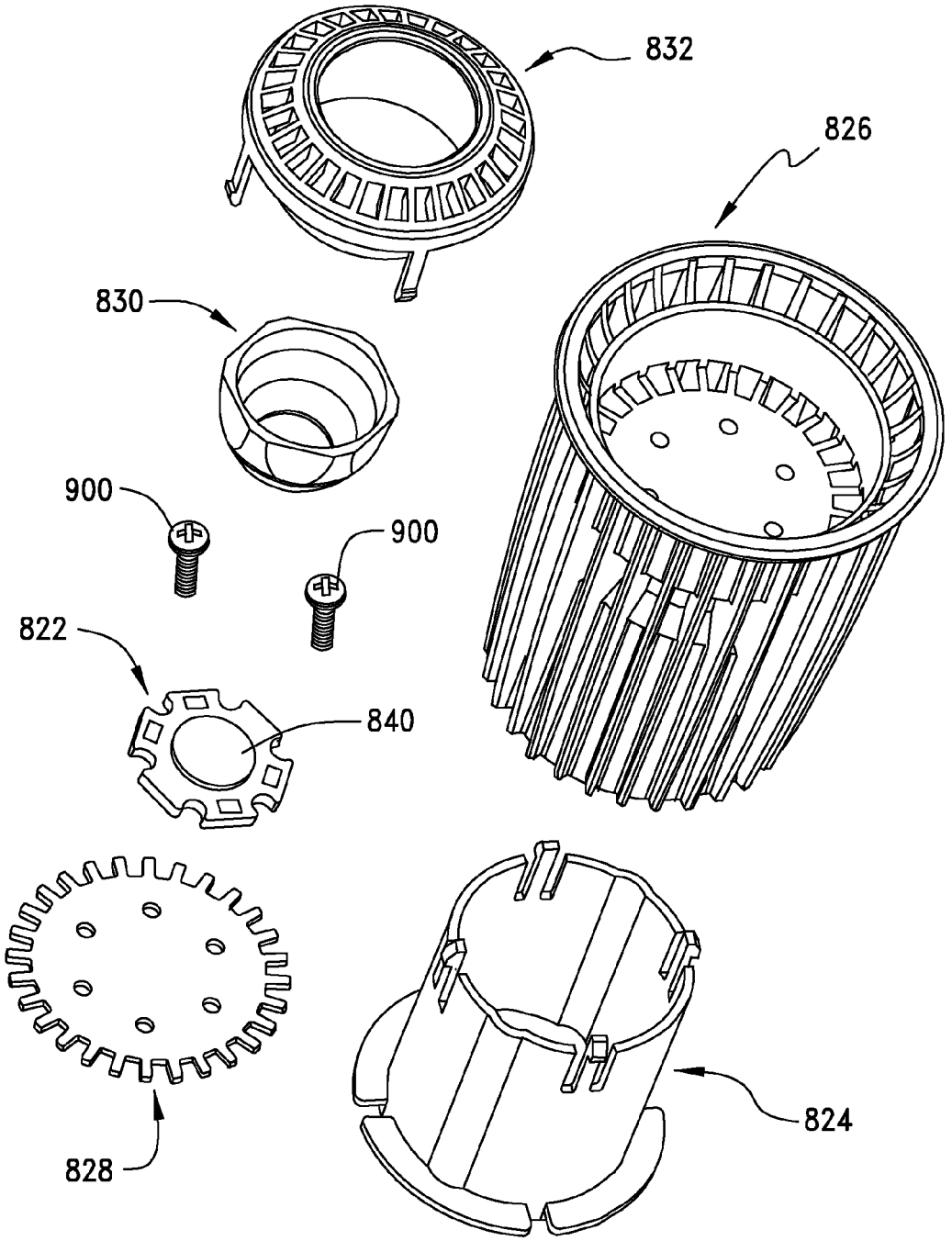
FIG. 45 is an exploded perspective view of the components of the light module of FIG. 44.

An adhesive gasket 658, see FIGS. 35 and 42, which takes the form of a ring, is seated on the upper ring 638 of the heat sink 626. The adhesive gasket 658 secures the lens cover 630 to the heat sink 626. The lens cover 630 is sized such that the channels 646 are inwardly of the outer periphery of the lens cover 630.

As can be appreciated from FIG. 35, the heat spreader 628 can be formed as discussed above. The heat spreader 628 includes an outer ring 650 which has a central bar 652 extending there across. This defines first and second apertures 654, 656 in the heat spreader 628. The outer ring 650 is seated partially on the adhesive gasket 658 and partially on the upper ring 638 of the heat sink and covers the channels 646. The central bar 652 bisects the passageway 644 in the heat sink 626.

The LED module 622 includes an insulative base 660, a LED array 662, an anode 664 and a cathode 666. The base 660 houses electronics and the LED 662, which may a single LED or a LED array. The anode 664 and the cathode 666 extend from the base 660. A thermal pad (not shown) may be provided on the underside of the base 660. The thermal pad may be a thermally conductive element that is mounted on the LED module 622. In an alternative embodiment, the thermal pad can be a dispensed conductive material, such as (without limitation) a thermally conductive epoxy or solder.

An insulative cover 641, which can be reflective, is mounted over the LED module 622, see FIG. 42. The cover 641 has a generally rectangular central portion 643 with an enlarged portion 645, 647 at either end thereof. An aperture 649 is provided through the central portion 643. The LED 662 extends through the aperture 649 and the enlarged portions 645, 647 seat over the anode 664 and the cathode 666 to protect these components.

Figure 40:
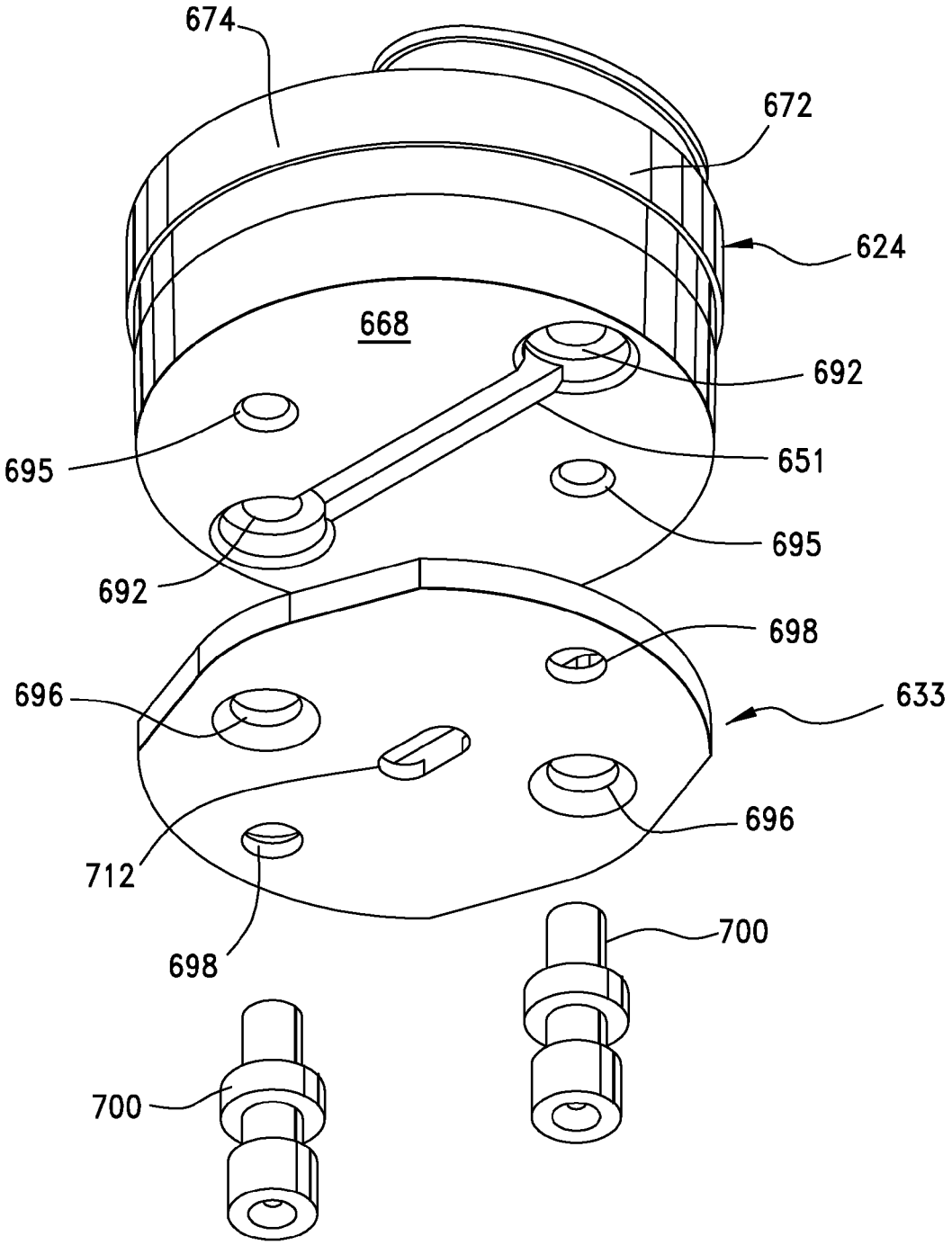
FIG. 40 is a partially exploded bottom perspective view of some components of the light module of FIG. 34.
Figure 41:
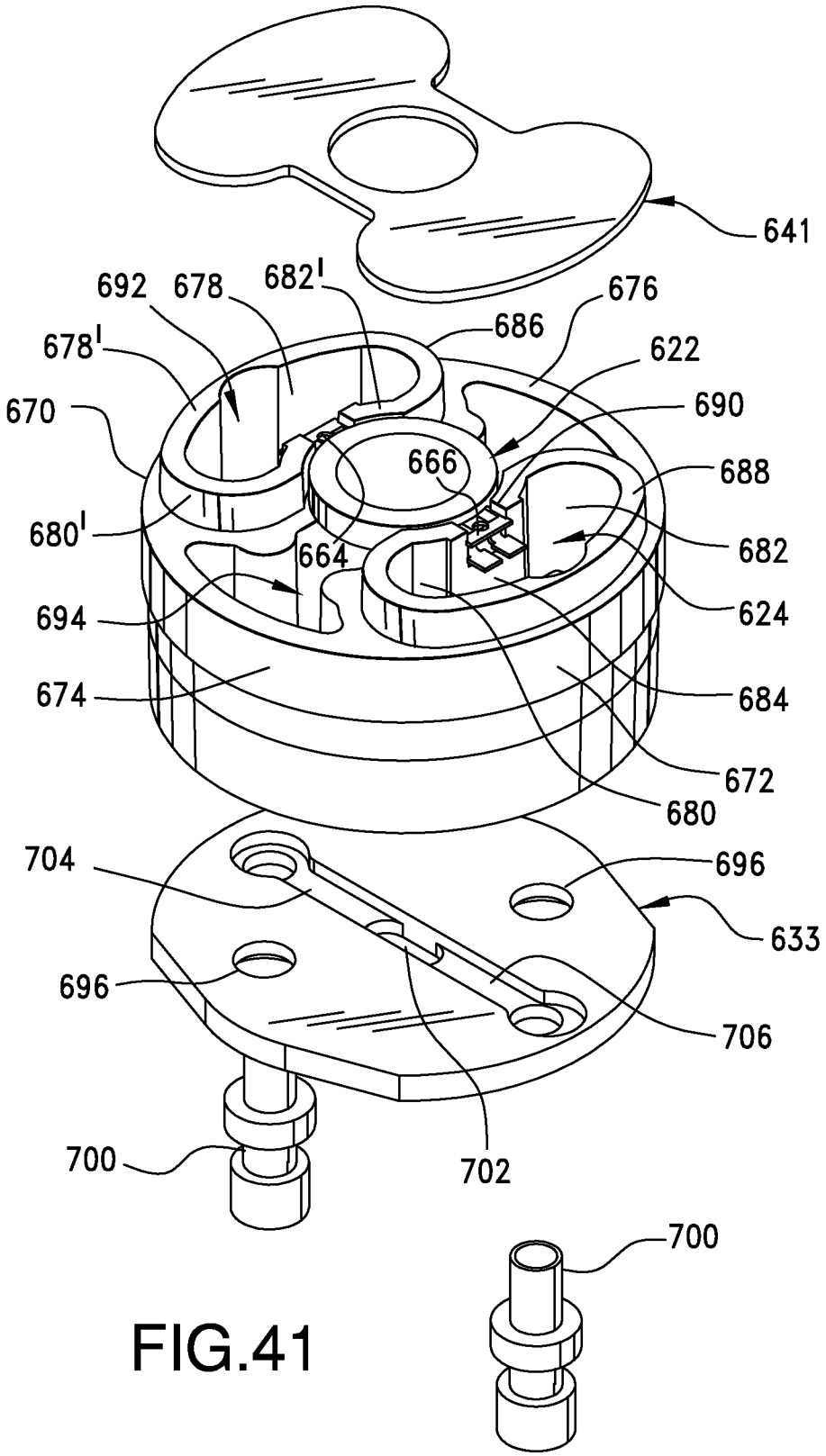
FIG. 41 is a partially exploded top perspective view of some components of the light module of FIG. 34.

As best shown in FIGS. 40 and 41, the housing 624 has a plate 668 from which first and second extensions 670, 672 extend upwardly. First and second wall portions 674, 676 extend upwardly from the plate 668 along the periphery of the plate 668 and between the extensions 670, 672.

Figure 36:
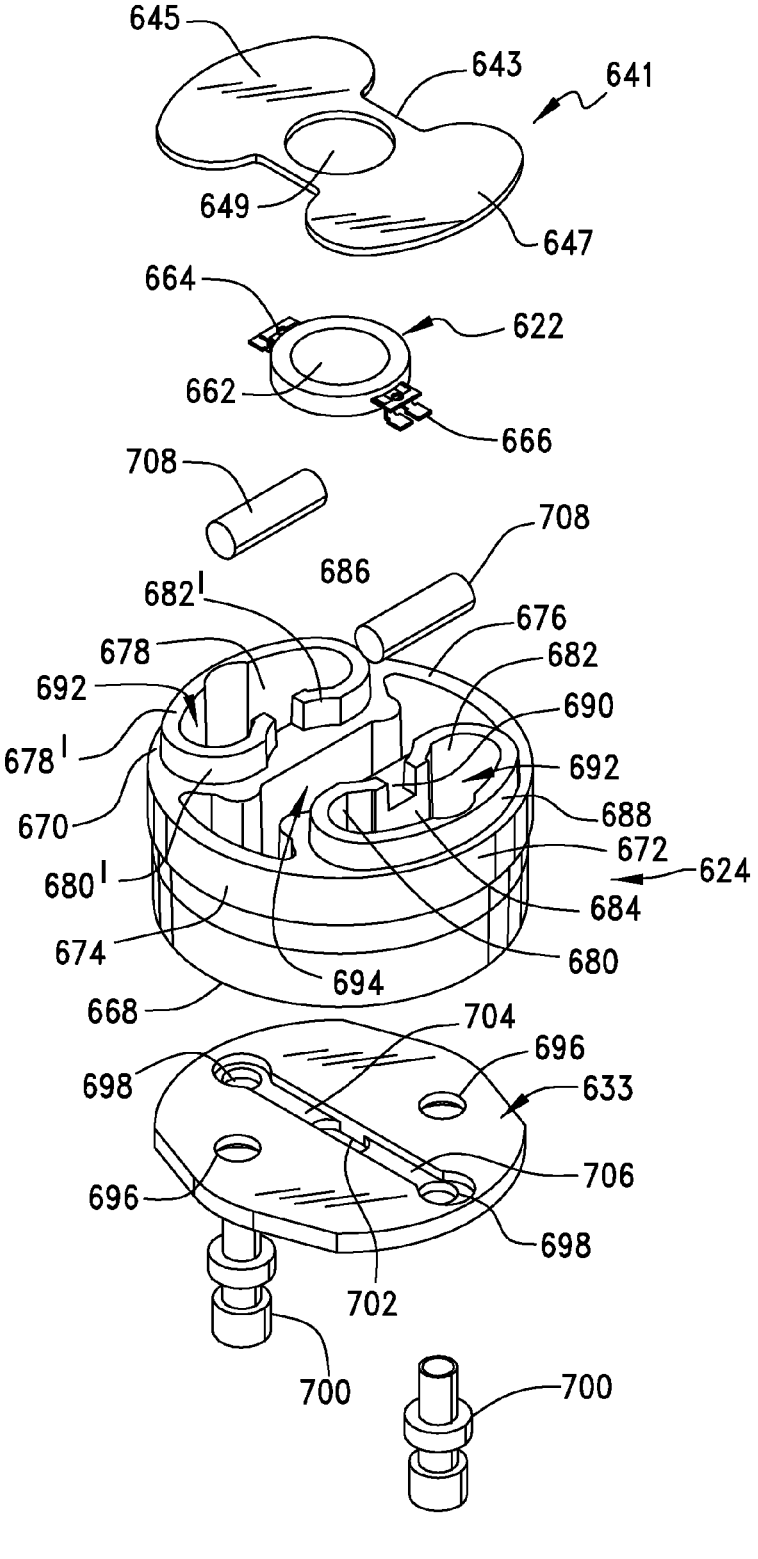
FIG. 36 is an exploded perspective view of some of the components of the light module of FIG. 34.
Figure 37:
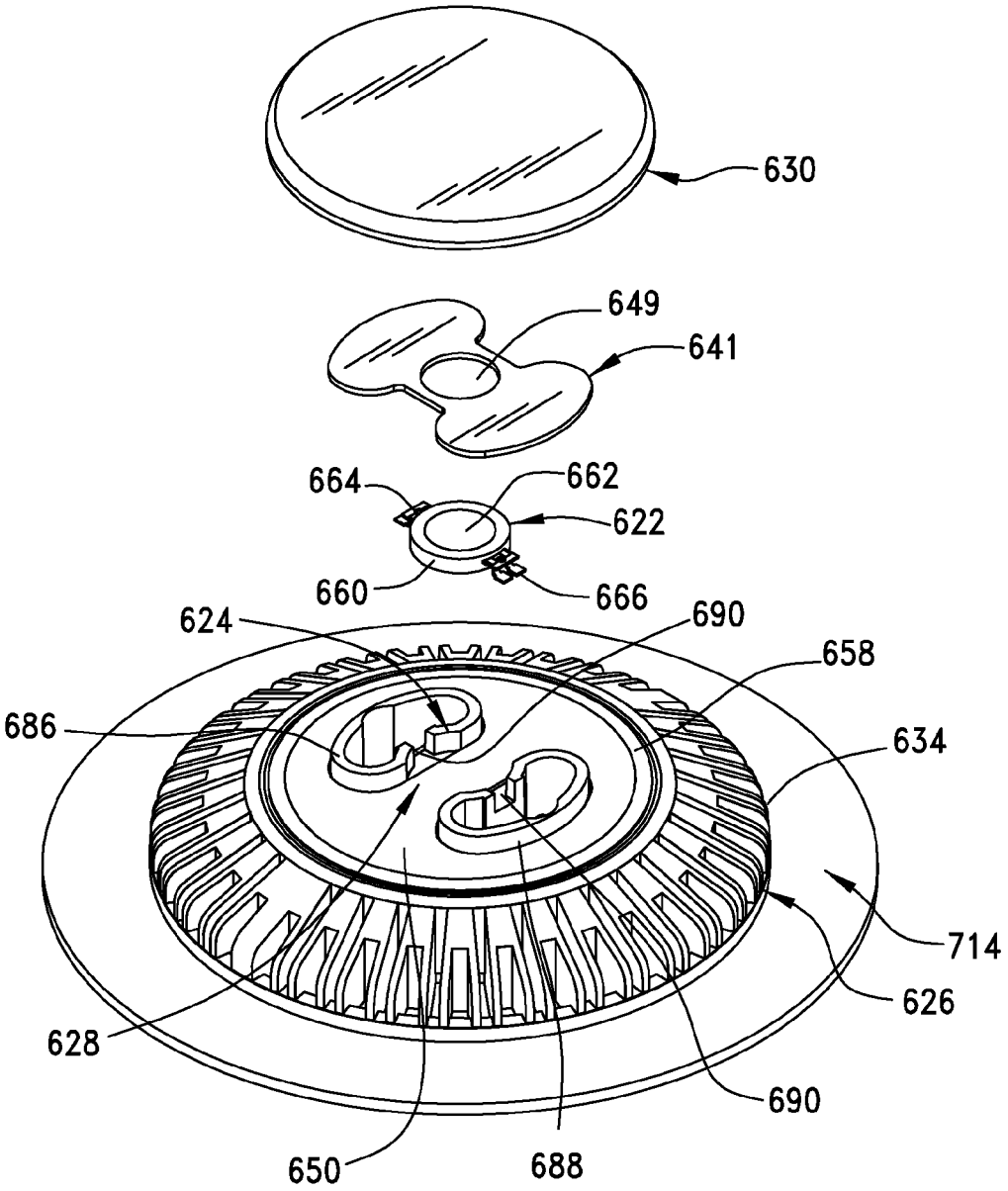
FIG. 37 is a partially exploded perspective view of the light module of FIG. 34.

As best shown in FIGS. 36 and 41, each extension 670, 672 has an outer concave wall section 678 which extends along the periphery of the plate 668, a first inner convex wall section 680 which is attached to one end of the outer concave wall section 678, a second inner convex wall section 682 which is attached to the other end of the outer concave wall section 678 and an inner flat wall section 684 which is between the ends of the inner convex wall sections 680, 682. The inner flat wall sections 684 face each other. Each extension 670, 672 has a flange 686, 688 extending upwardly from therefrom. Each flange 686, 688 approximates the shape of the extension 670, 672 and has a concave wall portion 678' which extends along the concave wall section 678 of the respective extension 670, 672, a first convex wall section 680' which extends along the convex wall section 680 of the respective extension 670, 672, a second convex wall section 682' which extends along the convex wall section 680 of the respective extension 670, 672. A notch 690 is formed between the ends of the convex wall sections 680', 682' of each flange 686, 688 and the notches 690 are aligned with each other. A passageway 690 extends through each of the flanges 686, 688, the extensions 670, 672 and the plate 668.

A recess 694 is defined between the extensions 670, 672 and the first and second wall portions 674, 676. As shown in FIG. 40, a pair of spaced-apart apertures 695 are provided through the plate 668 and are in communication with the recess 694 to allow connection of fasteners (not shown) therethrough.

The housing 624 seat within the passageway 644 in the heat sink 626. The flanges 686, 688 extend upwardly of the upper surface of the upper ring 638 of the heat sink 626 and extend through the apertures 654, 656 in the heat spreader 628 which are sized to conform thereto. The central bar 652 of the heat spreader 628 covers the recess 694 in the housing 624 and is seated against the inner flat wall sections 684 of the extensions 670, 672.

As shown in FIG. 41, the anode 664 of the LED module 622 is positioned within the notch 690 of the first extension 670 and extends over the passageway 692. The cathode 666 is positioned within the notch 690 of the second extension 672 and extends over the passageway 692. The notches 690 align the LED module 622 with the housing 624 and aid in positioning the anode 664 and the cathode 666 in the desired locations. The base 660 of the LED module 622 is proximate to the central bar 652 of the heat spreader 628 and the thermal pad is in thermal contact with the central bar 652 (the heat spreader 628 is removed from FIG. 41). The enlarged portions 645, 647 of the cover 641 seat over the anode 664 and the cathode 666 and the open ends of the passageways 692.

A wire retaining recess 651, see FIG. 40, like that of the other embodiments, may be provided in the lower surface of the plate 668. The wire retaining recess 651 provides a channel between the lower ends of the passageways 692.

The base cover 633 is formed as a plate. A first set of apertures 696 are provided through the base cover 633, which align with the apertures 695 in the plate 668, to allow fasteners to extend therethrough to connect the base cover 633 to the housing 624. A second set of apertures 698 may be provided through the base cover 633 and are aligned with the passageways 692 in the housing 624. The second set of apertures 698 permit entry of conductive members 700, which may be GU 24 pins, therethrough such that the conductive members 700 extend into the passageways 692. Alternatively, a central wire opening 702 may be provided and wires would then be routed along the base cover 633 along recesses 704, 706 to the passageways 692. In practice, it is contemplated that either the wire opening 702 or the second set of apertures 698 will be provided as they provide substitute functionality. If a wire opening 702 is used, the wire may be sealed to the base cover 633 so as to minimize moisture ingression. In that regard, the conductive element 700 can be also be sealed to the base cover 633 so as to minimize moisture ingression.

As depicted, a resistive element 708, see FIG. 36, is housed within the passageway 692 of each extension 670, 672. In order to provide a low profile nature for the light module 620, the resistive elements 708 are aligned sidewise in the housing 624. A wire extends from one end of each resistive element 708 for connection to the anode/cathode 664/666 of the LED module 622. A wire extends from the opposite end of each resistive element 708 for connection to the conductive member 700/through the wire opening 702. Two resistive elements 708 can be used, one coupled to the anode 664 and one coupled to the cathode 666 in a similar manner. While the use of two resistive elements 708 increases the number of parts used, it has been determined that such a configuration helps spread out the heat generated by the resistive elements 708 (which may be 1 watt resistors) and therefore provides a more thermally balanced design. The resistive elements 708 are positioned in series with the corresponding conductive element 700 and the anode 664 or cathode 666 of the LED module 622. It should be noted, however, that if DC powered LED array is used, the resistors may be omitted.

An adhesive gasket 710, FIG. 35, is mounted to the lower surface of the lower ring 622. The adhesive gasket 710 has a central aperture 712 therethrough that is sized to conform to the upright wall 636 of the heat sink 626.

A base ring 714 may be mounted to the lower surface of the adhesive gasket 710. The base ring 714 has a central aperture 716 therethrough that is sized to conform to the upright wall 636. The base ring 714 extends outwardly from the outer periphery of the lower ring 642 of the heat sink 626.

Heat from the LED module 622 conducts along the heat spreader 628 to the base 632. Heat then spreads outwardly to the fins 634. The channels 646 provide an effective heat channel to conduct heat to from the top surface of the heat sink 626 to the bottom surface of the heat sink 626 in the event that the heat sink is formed of a plated plastic. In addition, apertures 648 provide a heat channel to conduct heat to from the interior surface of the heat sink 626 to the exterior surface of the heat sink 626. As a result, when a plated plastic is used for the heat sink 626, the heat is effectively dissipated over the entire heat sink 626.

It should be noted that the heat spreader 628 is exposed to the lens 630 and therefore it can be beneficial that any exposed surface of the heat spreader 628 be reflective. In an embodiment the heat spreader 628 may have a reflective layer adhered to the exposed surface. In another embodiment, the exposed surface of the heat spreader 628 may be coated so as to provide the desired reflectivity.

The adhesive gasket 710 can secure the light module 620 to either the base ring 714 or some other surface. In an embodiment, the adhesive gasket 710 can include thermal conductivity properties, such as the 3M tape noted above. In any event, if an adhesive gasket is used it may be beneficial to ensure that the conductive element 700 extends sufficiently far from the lower surface of the plate 642 so that the light module 620 can be appropriately orientated before the gasket 710 secures the light module 620 to the corresponding surface. If the light module 620 is mounted to the base ring 714, the base ring 714, assuming its lower surface does not have an adhesive coating, can then be secured to an appropriate surface in a conventional manner.

Attention is finally invited to the embodiment of the light module 820 which is shown in FIGS. 44-60. As depicted, the light module 820 includes an illumination face 834 that is configured to emit light and a mounting face 836 that is configured to allow the light module 820 to be quickly mounted to a receptacle. The light module 820 includes a LED module 822, an insulative housing 824, a heat sink 826, a heat spreader 828, a reflector 830 and a lens cover 832.

Figure 46:
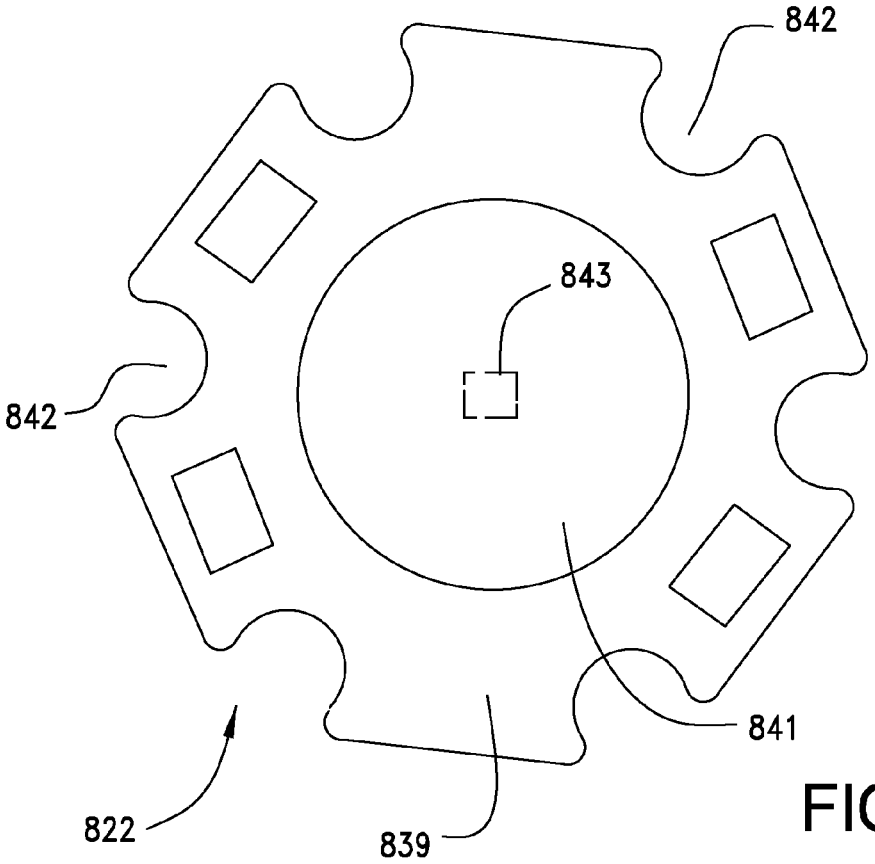
FIG. 46 is a top plan view of a LED module used in the light module of FIG. 44.

As best shown in FIG. 46, the LED module 822 includes a generally flat base 837 which can include the anode/cathode, and a LED array 843, which may be one or more LEDs, which extends upwardly from an upper surface thereof and is covered by a LED cover 841 (which could be a lens or could be phosphorous material). For example, an LED array mounted on an insulatively coated piece of aluminum could be utilized. The selection of the base shape and the type of LED array positioned on top will vary depending on user requirements. As illustrated, for example, the base 839 includes a plurality of cutouts 842 along its periphery. If desired, a thermal pad (not shown) may be provided on the underside of the base 839. In an alternative embodiment, the thermal pad can be a dispensed conductive material, such as (without limitation) a thermally conductive paste or epoxy or a type solder.

Figure 47:
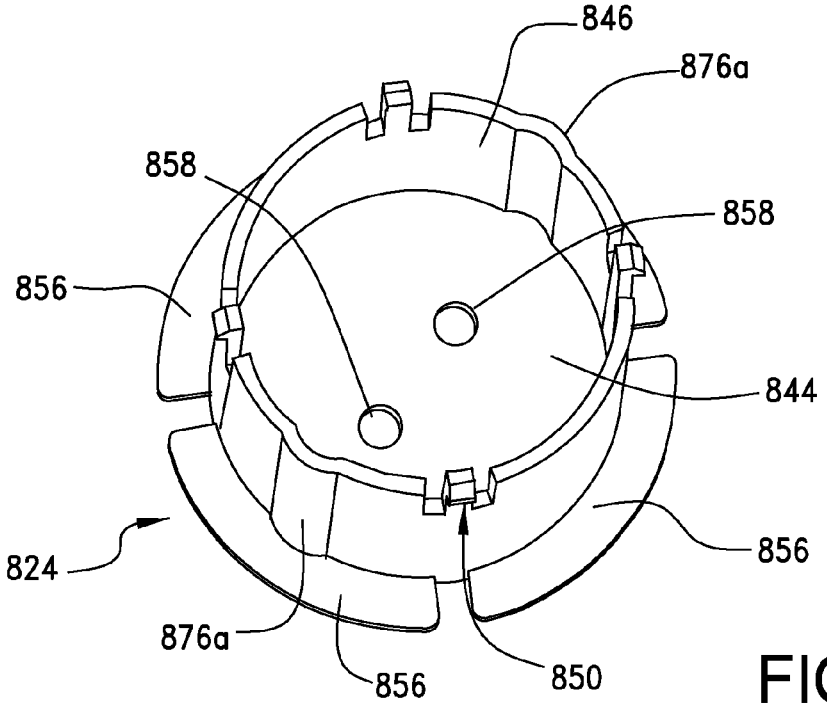
FIG. 47 is a perspective view of a housing used in the light module of FIG. 44.
Figure 48:
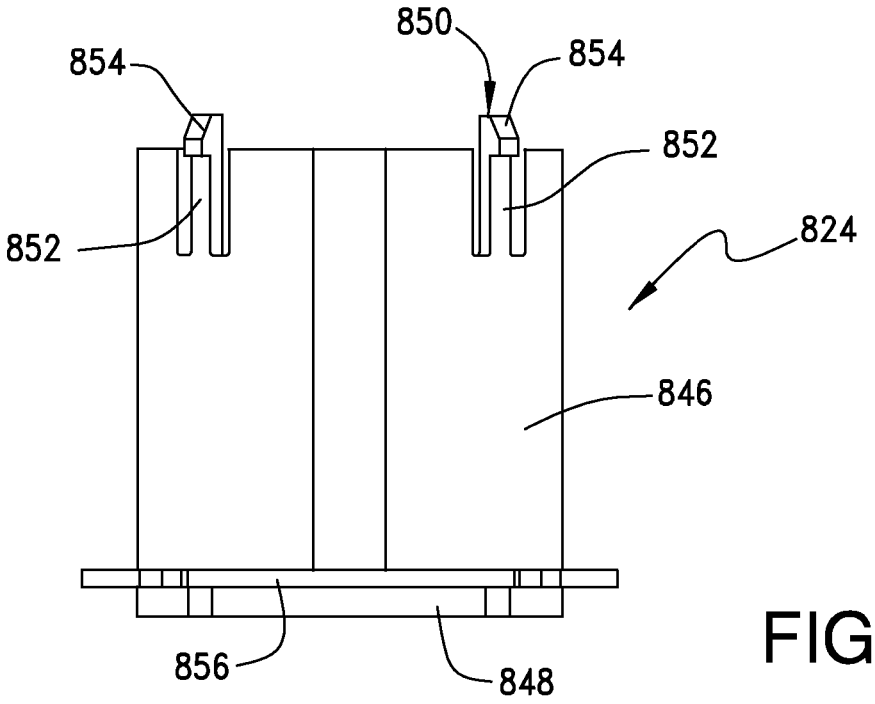
FIG. 48 is a side elevational view of the housing of FIG. 47.
Figure 49:
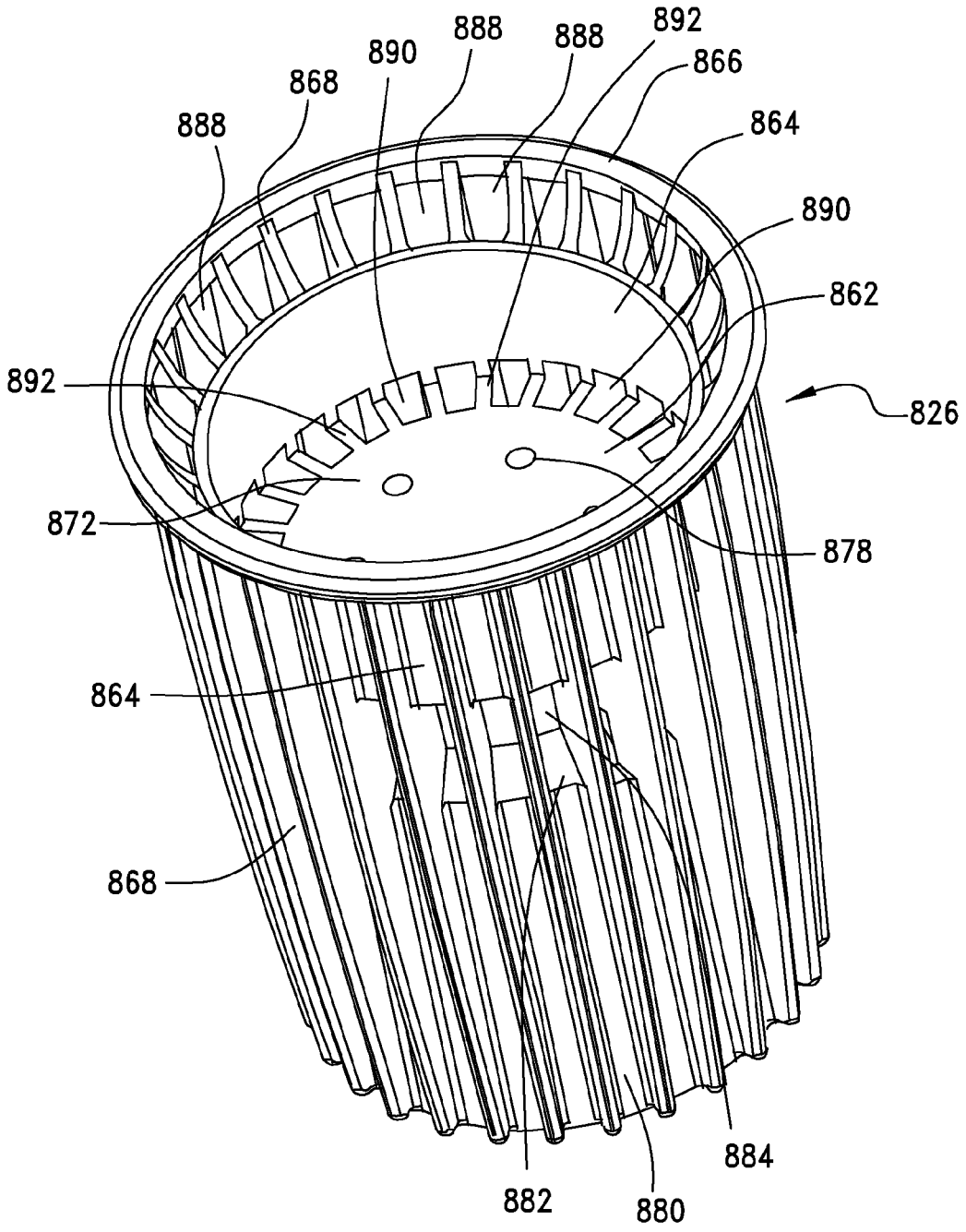
FIG. 49 is a top perspective view of a heat sink used in the light module of FIG. 44.
Figure 50:
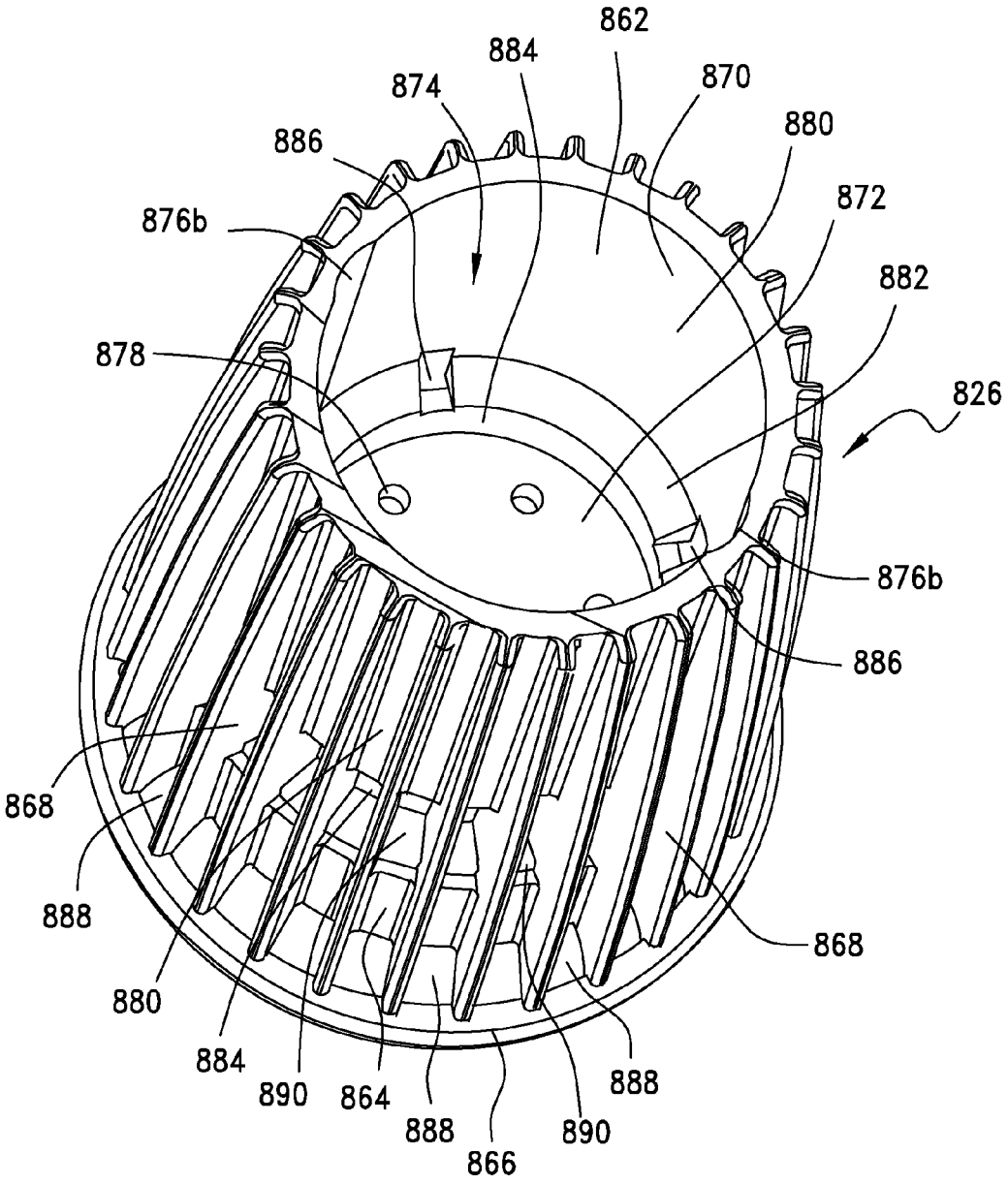
FIG. 50 is a bottom perspective view of the heat sink of FIG. 49.
Figure 51:
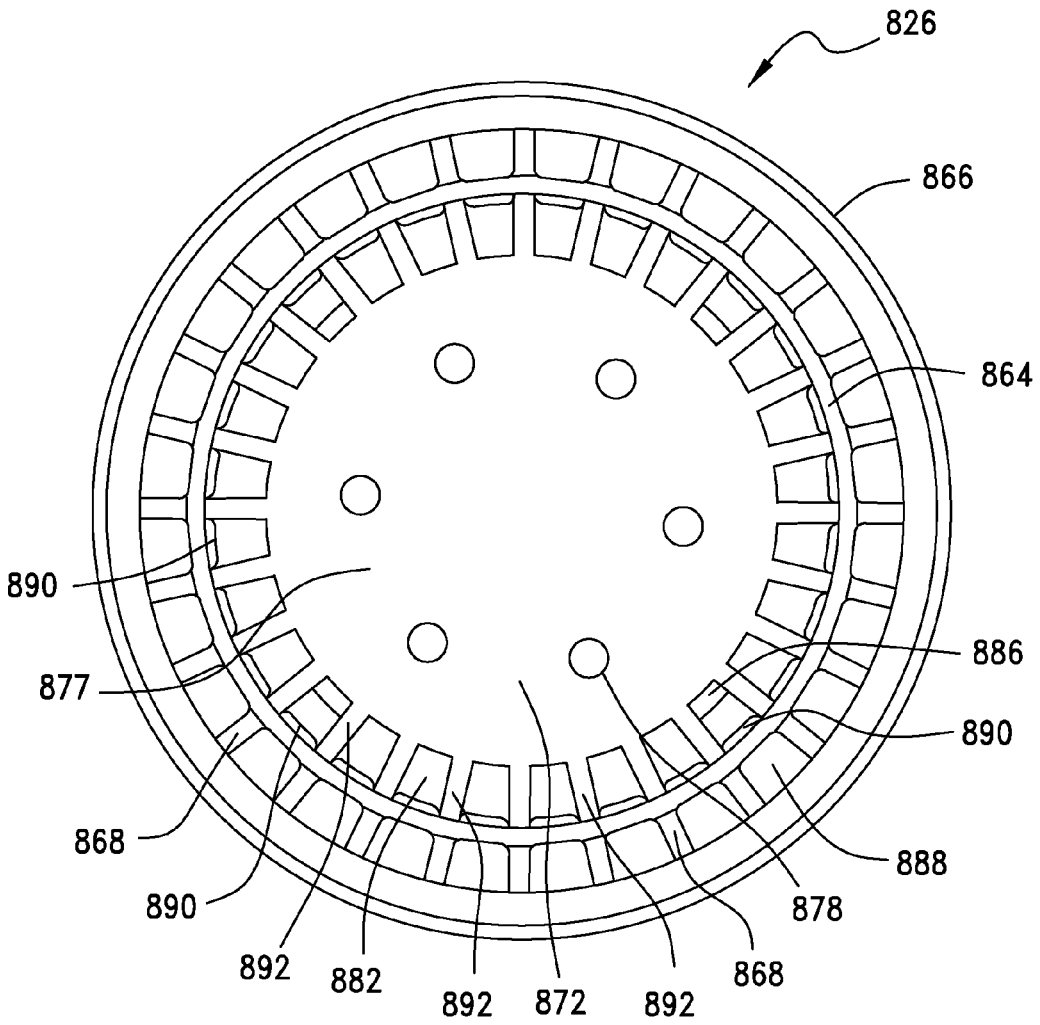
FIG. 51 is a top plan view of the heat sink of FIG. 49.
Figure 52:
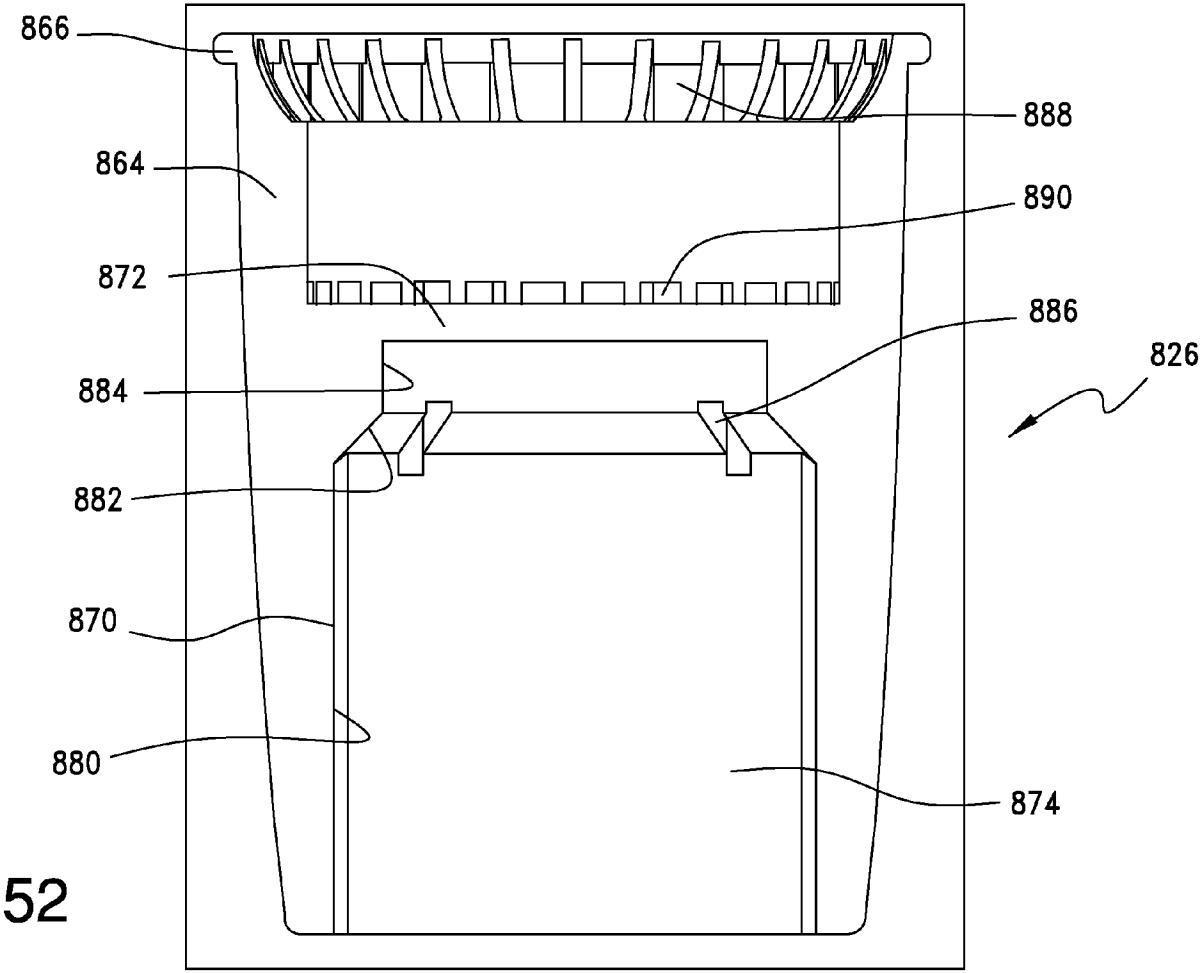
FIG. 52 is a cross-sectional view of the heat sink of FIG. 49.

As best shown in FIGS. 47 and 48, the housing 824 includes a plate 844 from which a circular extension 846 extends upwardly and a circular wall 848 extends downwardly. At the upper of the wall 848, a plurality of equidistantly spaced holding projections 850, each of which takes the form of a flexible arm 852 with a head 854 at the end thereof, are provided for attaching the housing 824 to the heat sink 826 as discussed herein. The heads 854 of the holding projections 850 extend above the upper end of the extension 846. A plurality of flanges 856 extend radially outwardly from the extension 846 and wall 848 and are aligned with the plate 844. The plate 844 has apertures 858 provided therethrough to allow connection of conductive members 860, such as pins used in GU 24 interfaces, thereto.

As best shown in FIGS. 49-52, the heat sink 826 includes a base 862, an outer ring 866, and a plurality of spaced-apart, elongated fins 868. The base 862 and the outer ring 866 are spaced apart from each other, but are connected together by the fins 868.

The base 862 includes a horizontal base wall 872 which has a circular skirt 870 depending downwardly therefrom. As a result, a recess 874 is provided in the lower end of the base 862. On the interior surface which forms the recess 874, the skirt 870 has a cylindrical lower portion 880 which has a first diameter, an angled intermediate portion 882 which tapers inwardly from the lower portion 880 to a cylindrical upper portion 884. The upper portion 884 has a diameter that is smaller than the lower portion 880. The lower portion 880 of the recess 874 is shaped to conform to the shape of the extension 846 of the housing 824 which is inserted therein. As shown, the lower portion 880 and the extension 846 have a plurality of convex sections 876*a*, 876*b* which ensure proper alignment between the heat sink 826 and the housing 824. The flanges 856 of the housing 824 seat against and substantially cover the lower end of the skirt 870. A plurality of apertures 886 are provided through the intermediate portion 882 for providing a space through which the heads 854 of the holding projections 850 are engaged to attach the housing 824 to the heat sink 826 as further described herein.

The base wall 872 includes a main body portion 877 which is circular and a plurality of spoke-like fingers 892 which extend radially outwardly from the main body portion 877. A plurality of apertures 878 are provided through the main body portion 877 which are used to attach the LED module 822 and the heat spreader 828 to the heat sink 826, and to route electrical components from the housing 824 to the LED module 822, as described herein.

The base 862 further includes an outer wall 864 extending upwardly from the outer ends of the spoke-like fingers 892. As a result, a plurality of channels 890 are formed between the main body portion 877, the fingers 892 and the outer wall 864. The channels 890 are only open to the upper and lower surfaces of the base 862. That is to say, the walls which form the sides of the channels 890 are uninterrupted. The outer ring 866 has a diameter which is greater than the diameter of the outer wall 864 of the base 862. As shown, the lower and upper portions 880, 874, the outer wall 864 and the upper ring 866 are cylindrical, although they may take other shapes.

The fins 868 extend from the base 862 to the outer ring 866. The fins 868 extend outwardly from the base 862. As depicted, the heat sink 826 includes radial fins 868, however, as can be appreciated, other shapes of fins can be used as desired. The fins 868 are aligned with the fingers 892. The outer surfaces of the fins 868 do not extend beyond the outer surface of the outer ring 866. As a result, a plurality of apertures 888 are provided between the outer ring 866 and the outer wall 864 which are spaced apart from each other by the fins 868.

Apertures 886 are aligned with predetermined ones of the apertures 888 and channels 890. The holding projections 850 on the housing 824 enter into the apertures 886 and the heads 854 engage the lower section 880 to mate the housing 824 to the heat sink 826, and to prevent removal of the housing from the heat sink 826.

Figure 53:
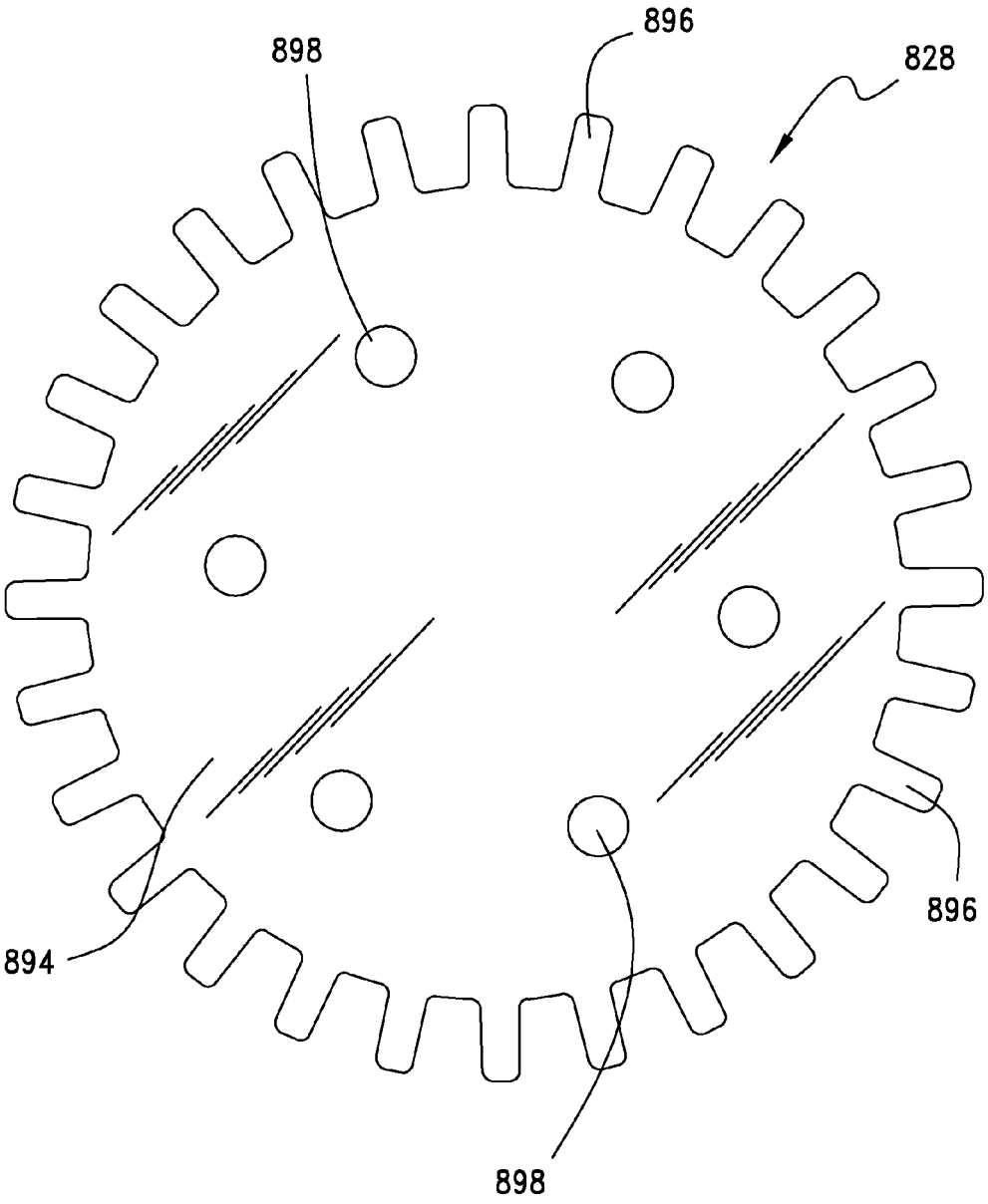
FIG. 53 is a top plan view of a heat spreader used in the light module of FIG. 44.

The heat spreader 828, see FIG. 53, can be as discussed above. The heat spreader 828 includes a central section 894 which is shaped to conform to the shape of the upper surface of the main body portion 877 of the heat sink 826 and a plurality of optional, spoke-like, spaced-apart fingers 896 which conform to the shape of the spoke-like fingers 892. The heat spreader 828 is positioned on top of the upper surface of the main body portion 877 and the fingers 892, and the fingers 896 of the heat spreader 828 align with the fingers 892 of the heat sink 826. The central section 894 has a plurality of apertures 898 therethrough which align with the apertures 878 through the main body portion 877.

Figure 54:
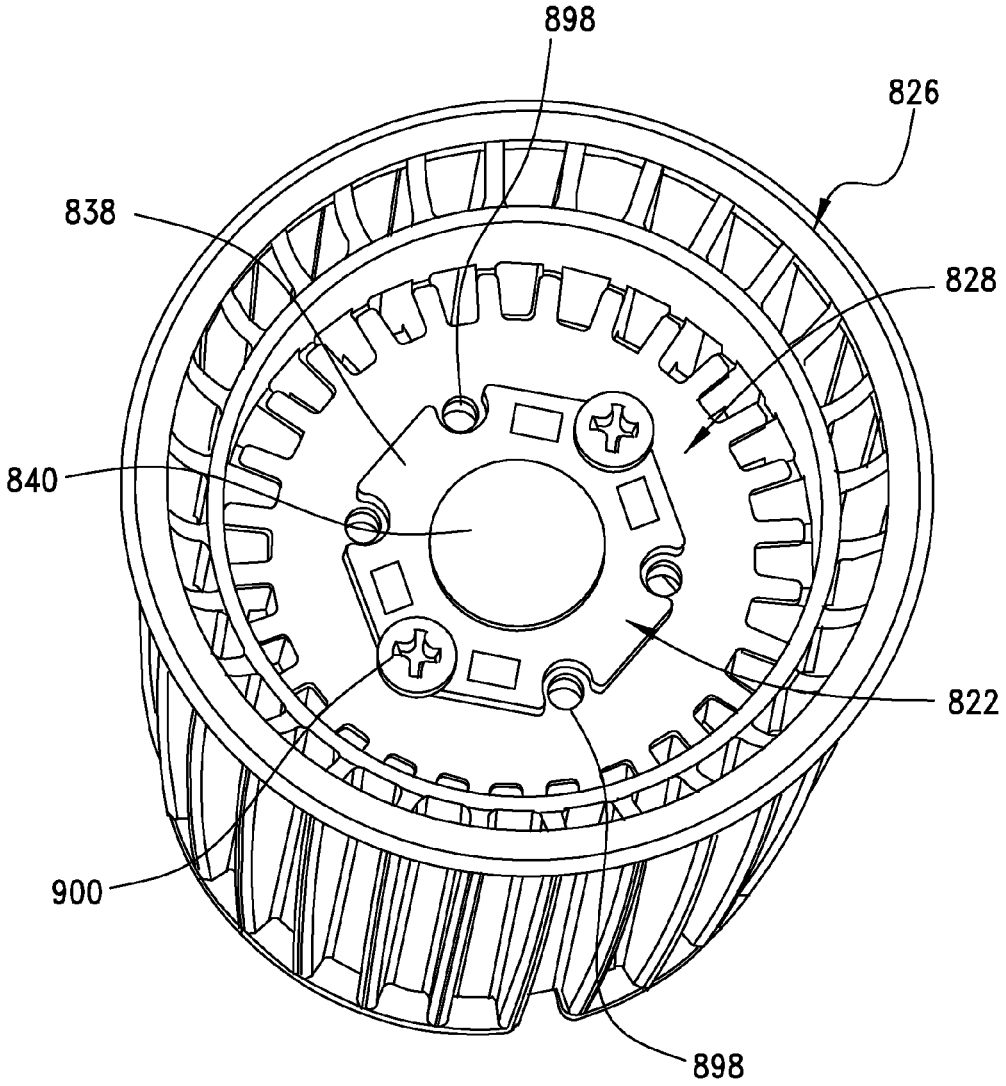
FIG. 54 is a top perspective view of the light module of FIG. 44 in a partially assembled state.

As shown in FIG. 54, the base 838 of the LED module 822 seats on the heat spreader 828 and is in thermal communication with the heat spreader 828. Fasteners 900 are passed through predetermined ones of the cutouts 842 of the LED module 822 and the apertures 898, 878 in the heat spreader 828 and the heat sink 826. The remaining cutouts 842 and the apertures 898, 878 are used to route electrical components housed in the housing 824 from the conductive members 860 to the LED module 822. If the LED module 822 used AC LED(s) (e.g., LEDs that do not require conversion from AC to DC), it may beneficial to include a resistive element within the housing 824 between one or both of the conductive members 860 and the LED module 822 so that the voltage can be maintained at a desirable level. The resistive elements, if included, and the electrical connection extend along the housing 824 between the conductive members 860 and the anode/cathode of the LED module 822. It should be noted that the conductive members 860 may be configured to be different sizes so as to provide a polarized fit. If the LED module uses DC LED(s), then AC to DC conversion circuitry can be positioned in the housing 824.

Figure 55:
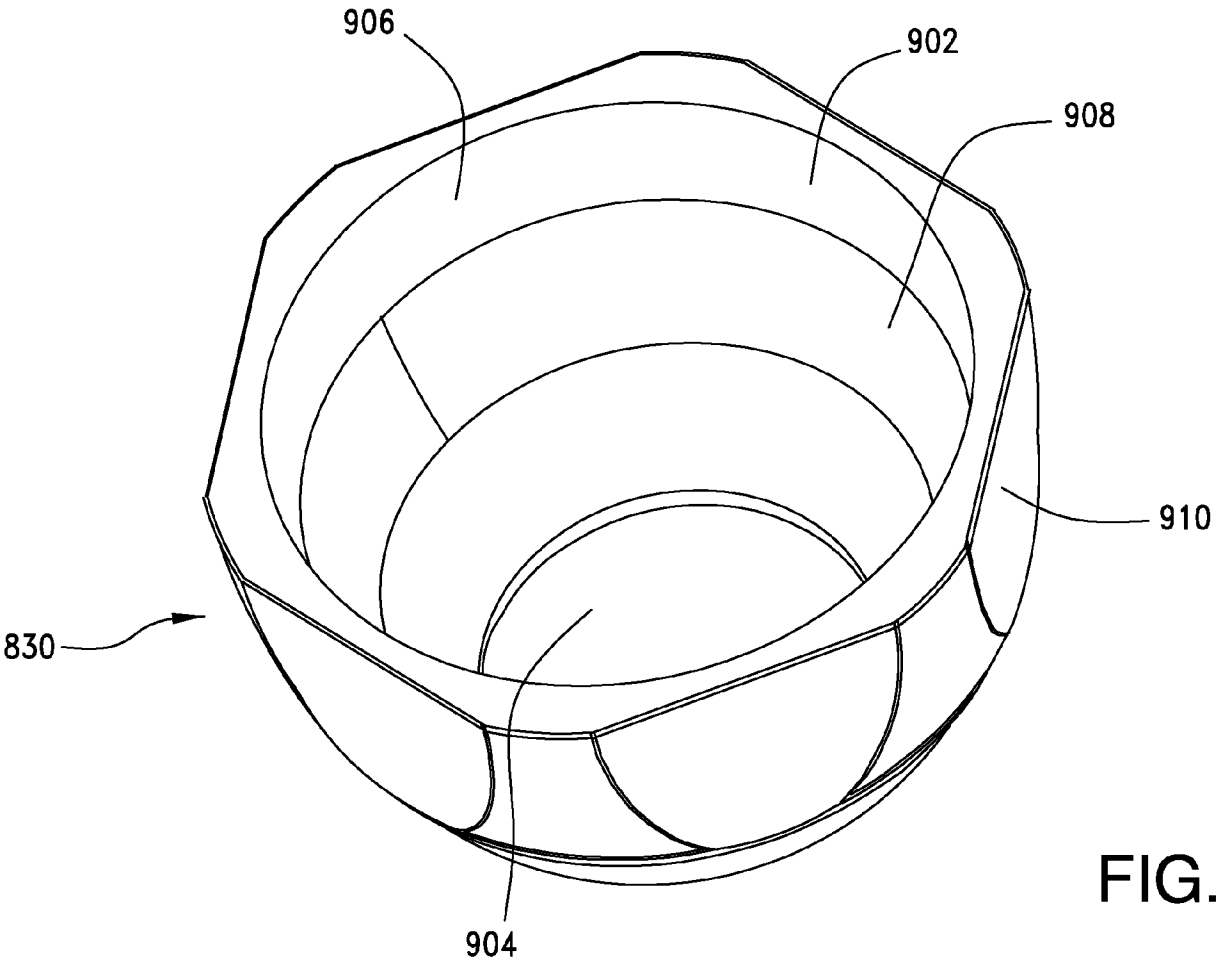
FIG. 55 is a top perspective view of a reflector used in the light module of FIG. 44.
Figure 56:
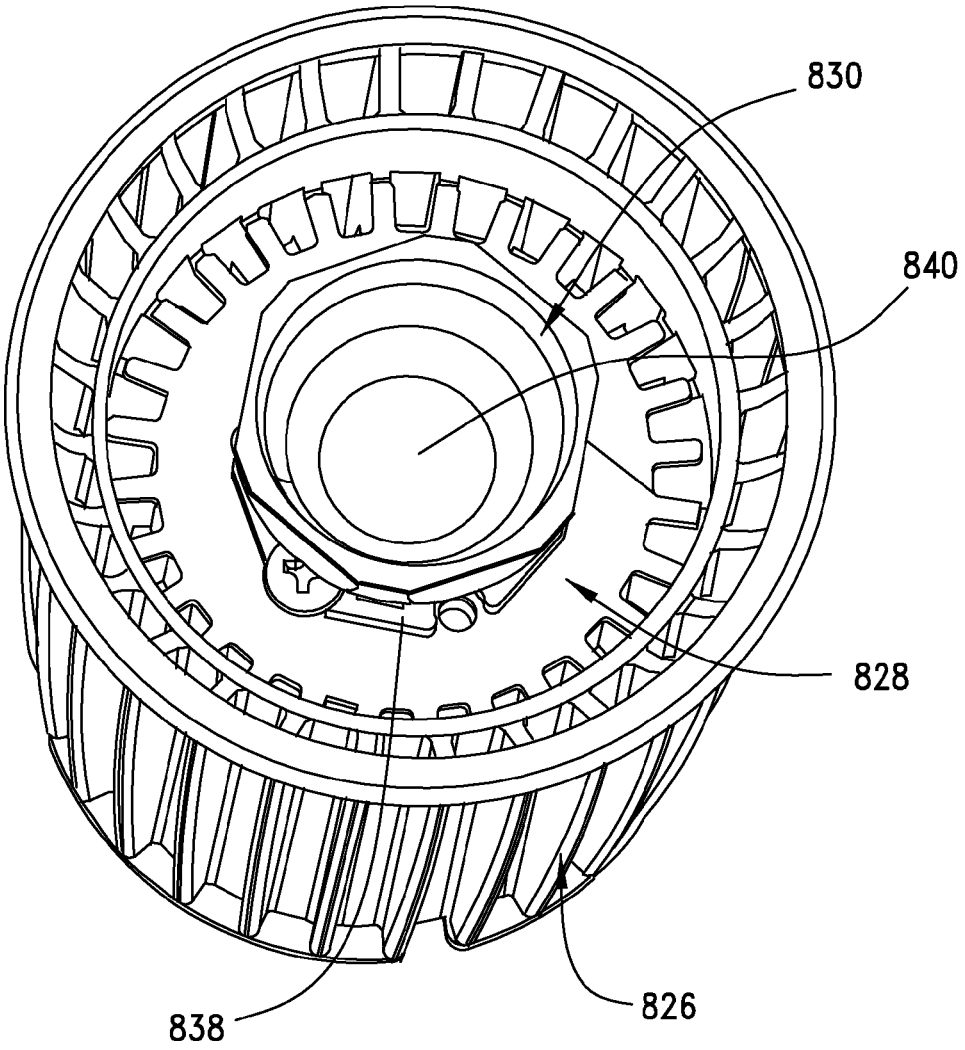
FIG. 56 is a top perspective view of the light module of FIG. 44 in a further partially assembled state.

The reflector 830, see FIG. 55, is formed by an open-ended wall 902 having a lower aperture 104 and an upper aperture 906. The lower aperture 904 is shaped like the LED 40. The wall 902 includes an inner surface 908 and an outer surface 910. The inner surface 908 is angled and has its largest diameter at its upper end and tapers inwardly. As shown in FIG. 56, the reflector 830 is mounted on the base 839 of the LED module 822 by suitable means such that the LED cover 841 is positioned within the lower aperture 904 of the reflector 830.

Figure 57:
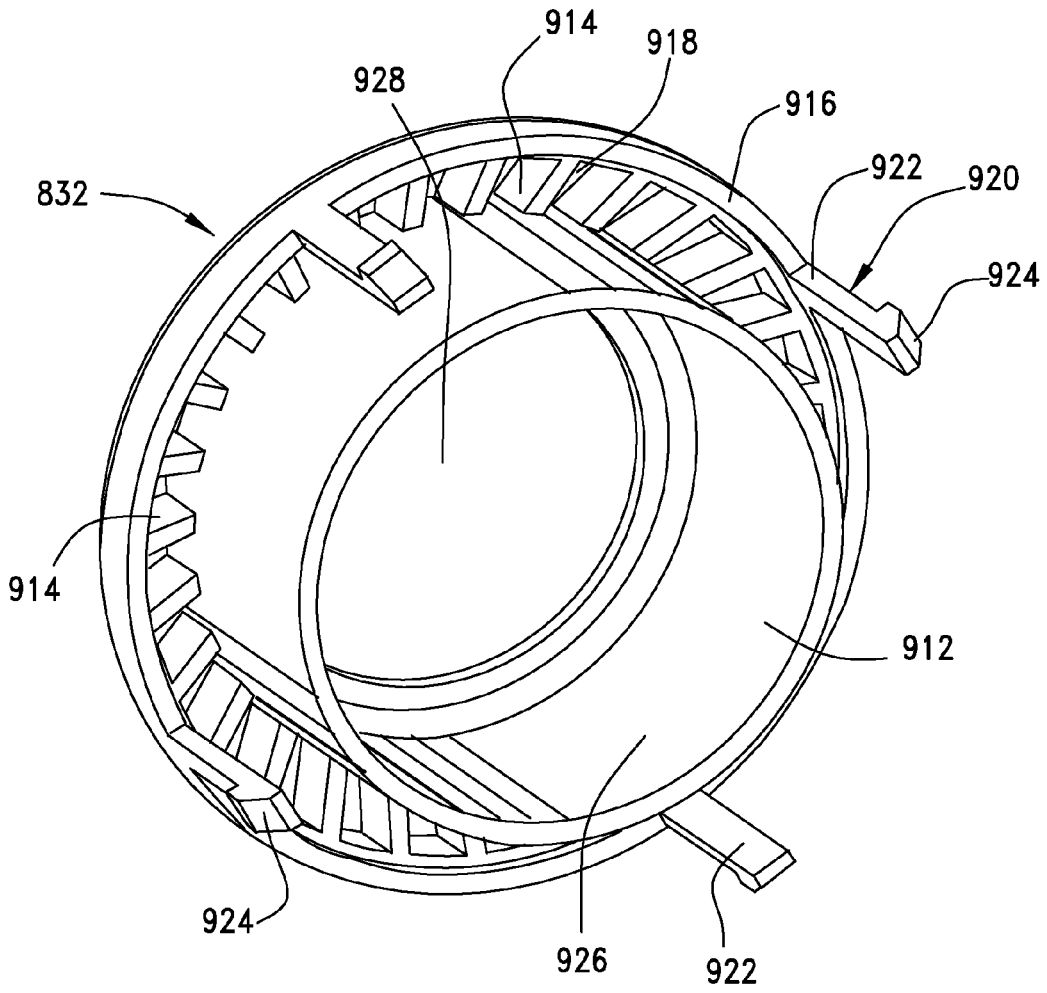
FIG. 57 is a bottom perspective view of a cover used in the light module of FIG. 44.
Figure 58:
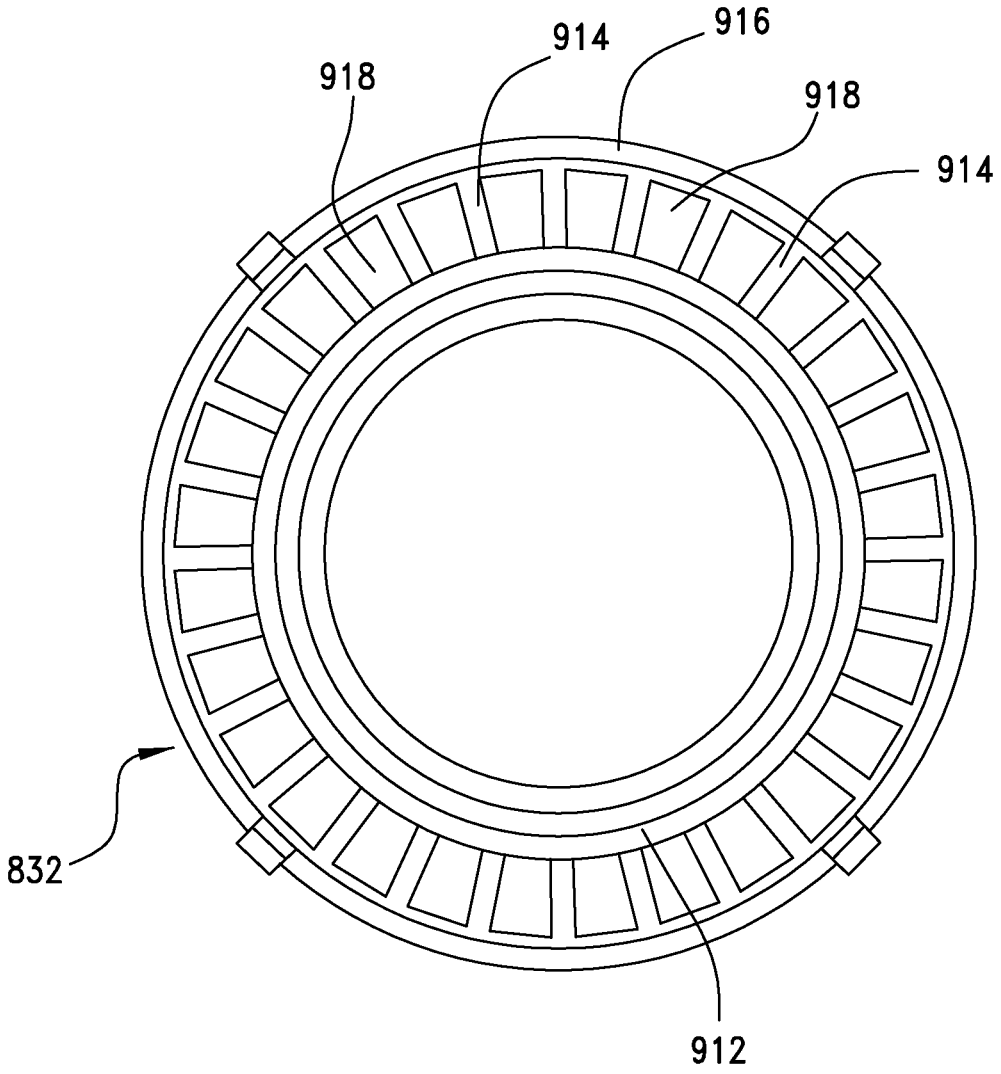
FIG. 58 is a bottom plan view of the cover of FIG. 57.
Figure 60:
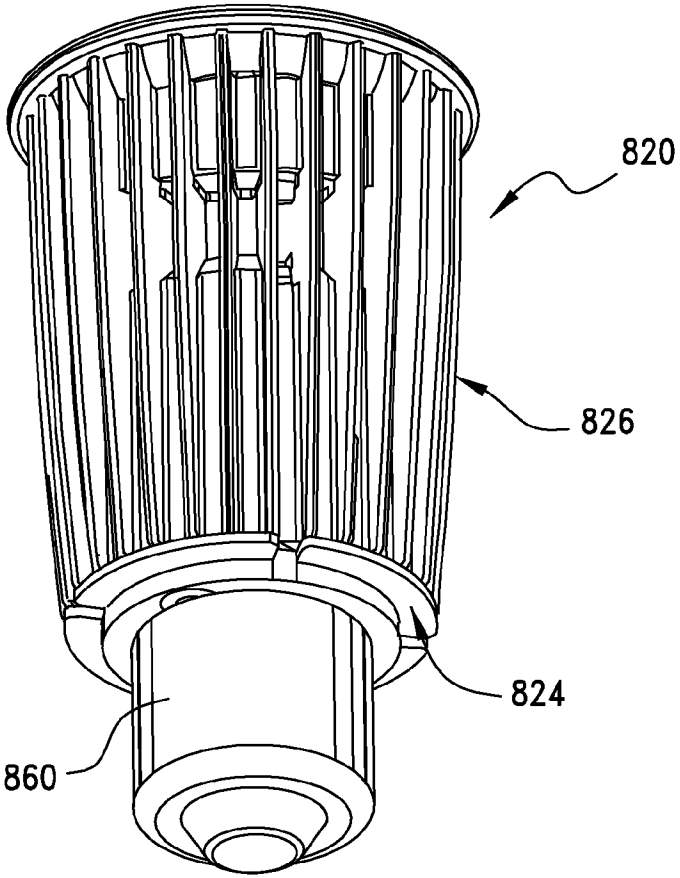
FIG. 60 is a bottom perspective view of the light module of FIG. 44 with a second type of conductive member provided thereon.

As best shown in FIGS. 57 and 58, the lens cover 832 has an open-ended circular base wall 912 which has a plurality of flanges 914 extending outwardly from the upper end thereof to a circular outer ring 916. As a result, a plurality of spaced apart apertures 918 are provided between the flanges 914. A plurality of holding projections 920, each of which takes the form of a flexible arm 920 with a head 924 at the end thereof, extend downwardly from the outer ring 916 for attachment to the heat sink 26. The base wall 912 has a diameter which is larger than the largest diameter of the reflector 830. The outer ring 916 has a diameter which is smaller than the diameter of the outer wall 864 of the base 862. A lower aperture 926 is provided at the bottom end of the base wall 912 and an upper aperture which is covered by a lens 928 is provided at the upper end of the base wall 912. To mount the lens cover 832, the lower end of the base wall 912 seats against the heat spreader 828 and the holding projections 920 seat within predetermined ones of the channels 890 of the heat sink 826 such that the heads 924 engage the lower end of the outer wall 864. The LED cover 843 seats within the lower aperture 926. As a result, the lens cover 832 protects the electrically live portions of the light module 820 that are used to power LED module 822. The lens cover 832 is preferably conductive.

Since the LED module 822 is in thermal communication with the heat spreader 828, heat generated by the LED module 822 can conduct along the heat spreader 828 to the main body portion 877, along the fingers 892, through the channels 890, along the outer wall 864 and to the fins 868, thus helping to ensure the temperature of the LED module 822 can be kept at a desirable level. The channels 890 provide an effective heat channel to conduct heat to from the upper surface of the heat sink 826 to the lower surface of the heat sink 826. As a result, when a plated plastic is used for the heat sink 826, the heat is effectively dissipated over the entire heat sink 826. In addition, any heat absorbed by the lens cover 832 as a result of the light rays from the LED module 822 can be transmitted to the heat sink 826 via the connection of the lens cover 832 to the heat sink 846. In addition, the flanges 914 and apertures 918 aid in allowing the heat to dissipate from the LED module 822.

In an alternate embodiment, the heat spreader 828 can be formed as a circular plate without the fingers 896. As a result, the heat conducting channels 890 are covered by the heat spreader 828. The heat is conducted through the channels 890 so that heat can be effectively transferred to the upper and lower ends of the fins 868.

Figure 59:
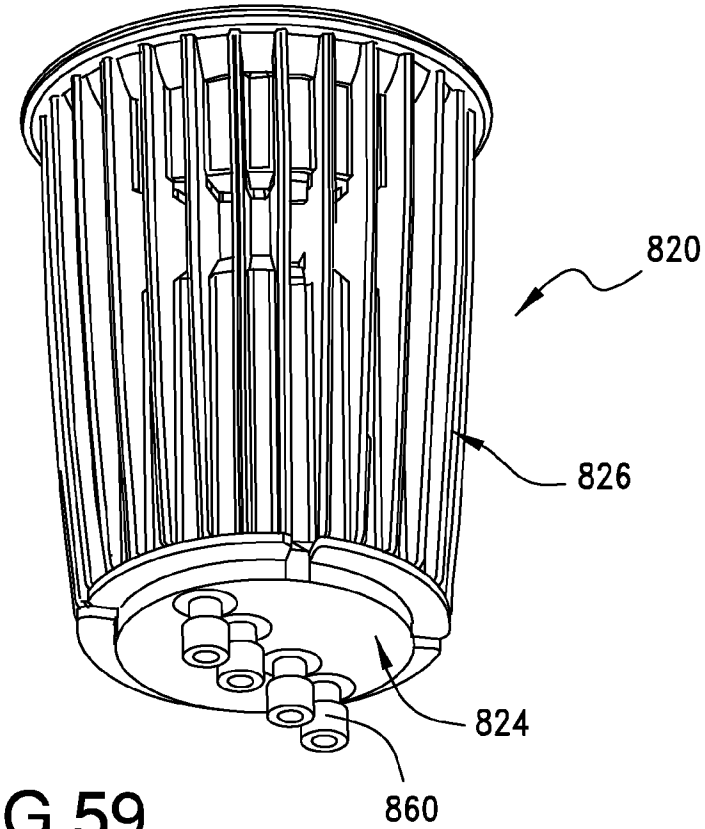
FIG. 59 is a bottom perspective view of the light module of FIG. 44 with a first type of conductive member provided thereon.

While the conductive members 860 are shown as pins and four pins are shown in FIG. 59, in practice two pins would be typically used (for example, either the inner pair or the outer pair could be used, depending on whether the intended configuration was GU 24 or GU 10 or some other desired configuration). In addition, as can be appreciated from FIG. 60, the conductive member 860 can be a conventional Edison base.

In each embodiment, as can be appreciated, with a plated plastic heat sink, one issue that exists is that there is a need to get thermal energy to the exterior surfaces as heat tends to transfer more efficiently through the plating. Therefore, the channels 114, 116, 646, 890 and apertures 648 provide thermal channels to improve the heat transfer from the heat spreader to the underside or exterior surface of the heat sink 26, 626, 826 and significantly reduced resistivity to heat transfer from the LED module 22, 622, 822 to the underside or exterior surface of the heat sink 26, 626, 826. The heat transfer to the underside of the heat sink 26, 626, 826 allows for more efficient heat transfer to occur along the external plated surface of the heat sink 26, 626, 826. In particular, there are two paths, which lowers the resistivity to heat transfer between the LED module 22, 622, 822 and the plated fins 108, 634, 868 of the heat sink 26, 626, 826.

It should be noted that for certain applications, it may be desirable to provide a heat spreader or heat sink that includes a vapor chamber so that heat can be even more effectively conducted away from the LED. Such applications include high powered LED arrays. For other applications, however, a material with a high thermal conductivity may be sufficient. Vapor chambers for use with heat sinks/heat spreaders are known in the art, as shown for example in U.S. Pat. Nos. 5,550,531 and 6,639,799, which disclosures are herein incorporated by reference in their entirety.

Figure 61A:
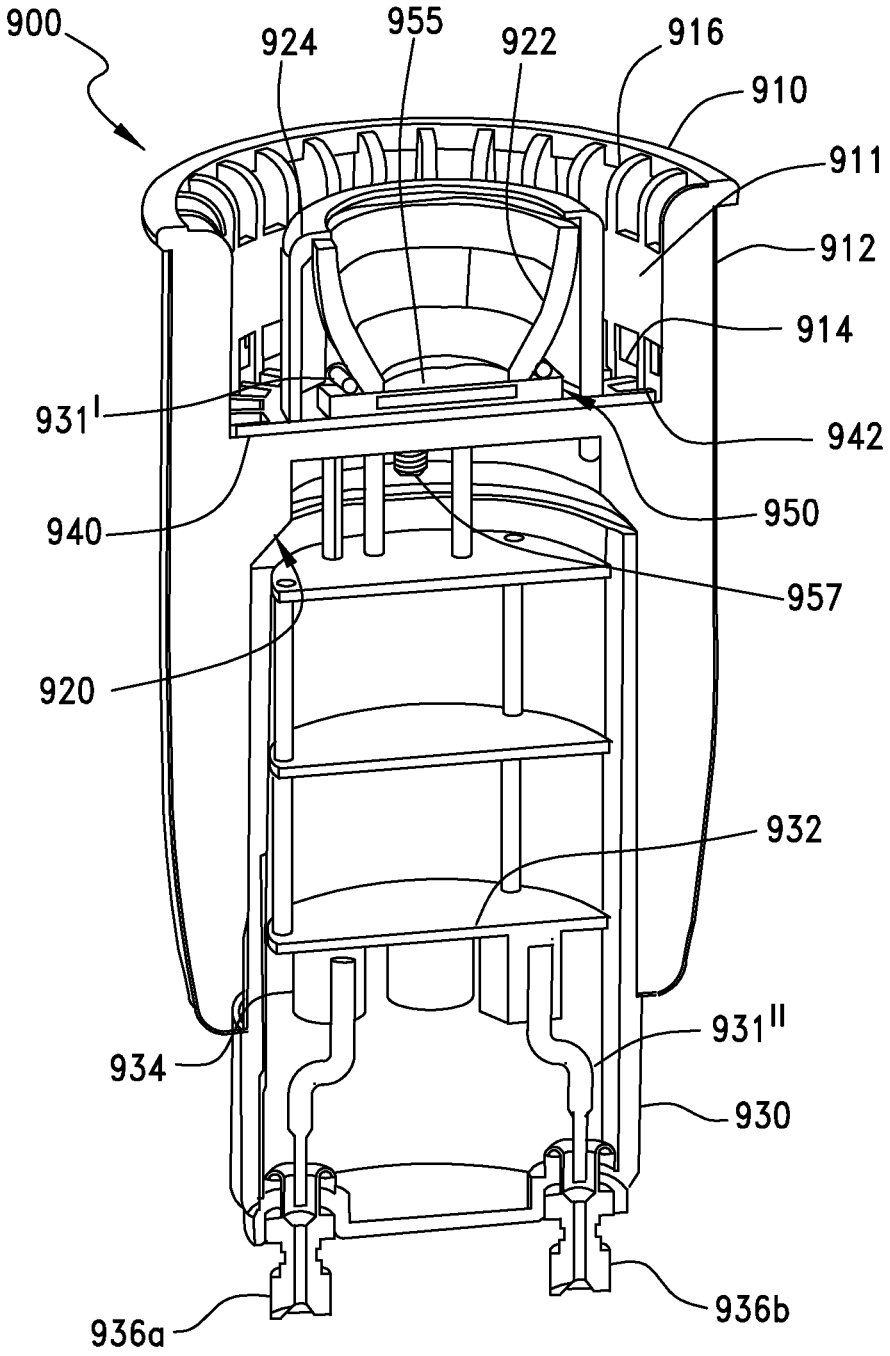
FIG. 61A is a perspective view of a cross-section of another embodiment of a light module similar that illustrated in FIG. 44.
Figure 61B:
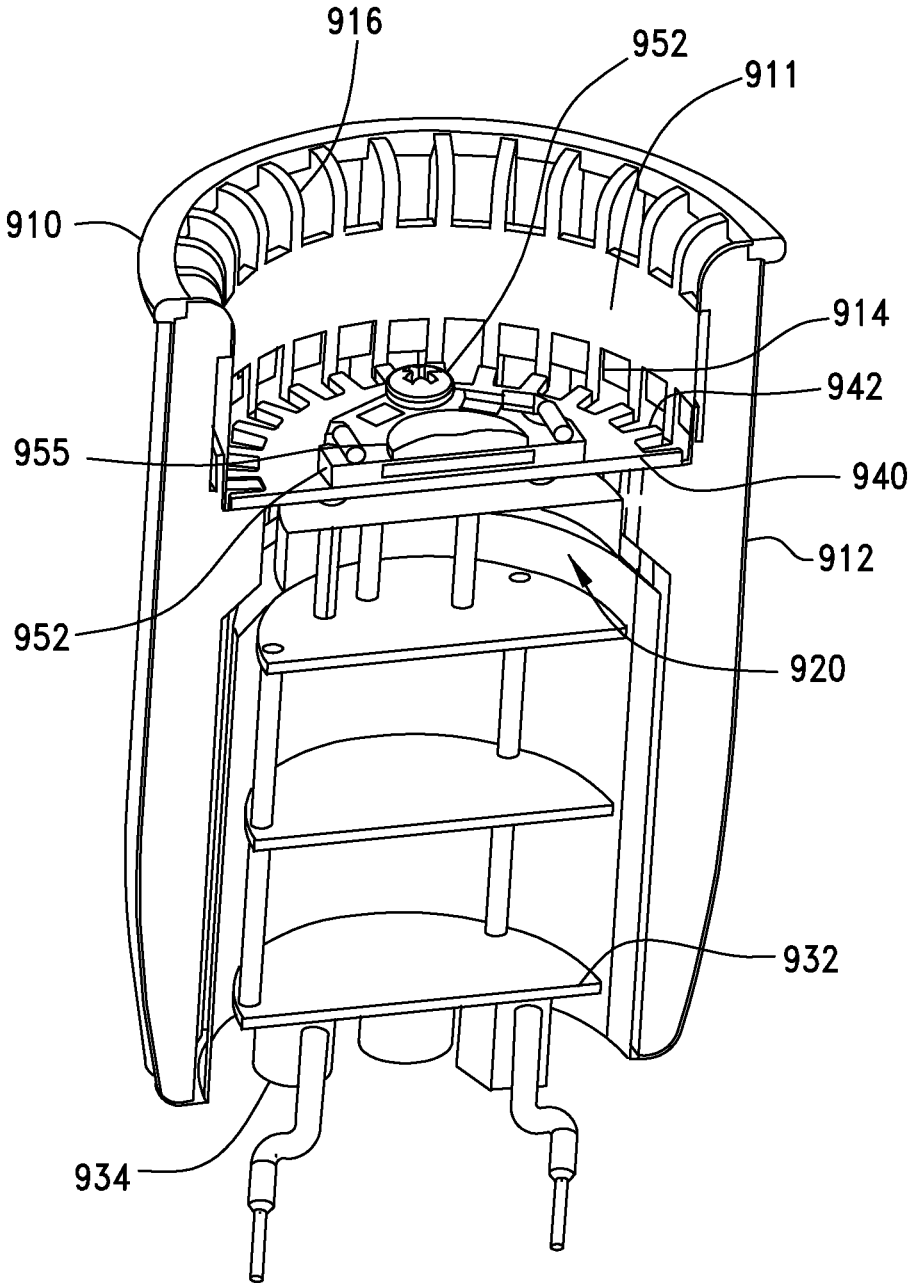
FIG. 61B is a simplified perspective view of the cross-section depicted in FIG. 61A.

Turning to FIGS. 61A and 61B, another embodiment is depicted. A light module 900 includes a heat sink 910 that receives a housing 930. As noted above, the heat sink can be a plated plastic so as to reduce the weight of the design. The depicted design of the heat sink could also be used with an electrically conductive material such as aluminum, although such a shape might be more expensive to form. Furthermore, the design would also be suitable for use with highly conductive plastics (e.g., plastics with a thermal conductivity of greater than 25 W/m-K).

In an embodiment, the heat sink 910 includes a first side 911 and a second 912 that are both plated but the bulk of a heat sink 910 is made of material that has a thermal conductivity of less than 20 and potentially less than 5 W/m-K. Thus, to reduce the thermal resistance of the path between the LED array and fins 916 (and thus decrease thermal resistance), thermal channels 914 are provided that extend between the two sides 911, 912. The thermal channels 914 are plated, as noted previously, and allow for efficient transfer of heat between the first side 911 and the second side 912, thus reducing the thermal resistance to the fins 916.

To further help reduce thermal resistance, a heat spreader 940 is mounted under a LED module 950. As depicted, the LED module includes a base 952 that is thermally coupled to the heat spreader 940 and, as noted above, include an LED array with a phosphorous covering 955 and mounted on the LED module is a reflector 922 and a cover 924, which together helps protect powered portions of the LED module from being touched by a person (thus helping to provide a system that can meet UL creep and clearance requirements). The heat spreader, being substantially thicker than a plating on the heat sink 910 and potentially having a thermal conductivity above 100 W/m-K, can provide for transfer of thermal energy towards it edges with little thermal resistance. Positioned within a cavity 920 in the heat sink 910 is a housing 930 (which could be a plastic housing or could be provided via a potting material) that supports electronics 934, which can be mounted on a circuit board 932. The electronics, which can be AC to DC conversion electronics or can also be simple resistors in the event the LED array is designed for AC power, allows the module 900 to be mounted in a receptacle so that its two contacts 936*a*, 936*b* can be powered in a conventional manner. Furthermore, the housing 930 provides electrical separation between circuitry 934 that is used to modify the power input and the heat sink 910.

As can be appreciated, the LED module 950 is fastened down tightly to the heat spreader 940 via a fastener 957. This can be useful if the base 952 cannot be thermally coupled to the heat spreader with an adhesive or solder or if there is a desire to be able to remove the LED module 950. As can be appreciated, if a fastener is used, a thermal pad may be provided between various interfaces to help ensure a corresponding good thermal connection.

As depicted, fingers 942 are provided on the heat spreader 940. As depicted, the fingers 942 are aligned with the fins 916. This allows the heat spreader 940 to extend further while minimizing exposure of the heat spreader 940 to being touched through one of the thermal channels (thus helping the device to meet UL creep and clearance requirements). Thus, the depicted configuration of the module 900 helps provide for good thermal performance in a desirable manner.

It should be noted that in general, thermal resistance along a path can be considered as the thermal resistance of each component and interface being in series with the other components and interfaces in the same path. Therefore, to provide a desired total thermal resistance, each component can be optimized separately. It should be noted that due to the series nature, selecting one component that is inefficient can prevent the entire systems from working as intended. Therefore, it can be beneficial to ensure each component is optimized for the intended performance level. Furthermore, if desired, certain components can be made integral so as to avoid an interface (which tend to increase the thermal resistance. For example, the heat spreader and the base of the LED module could be integrated (e.g., the LED array could be mounted on a larger base that was equivalent to the heat spreader).

As can be appreciated, each embodiment of the light module 20, 220, 620, 820, 900 is aesthetically pleasing. Other configurations with different appearances, such as square or some other shape light modules, as well as with different heights and dimensions are possible.

While preferred embodiments of the present invention are shown and described, it is envisioned that those skilled in the art may devise various modifications of the present invention without departing from the spirit and scope of the appended claims.

The invention claimed is:

1. A light module comprising:

a light emitting diode (LED) array defining a first area, the LED array including an anode and a cathode;

a heat spreader including a support region with a second area that supports and is thermally coupled to the LED array, the heat spreader having an outer edge and further including an aperture positioned between the outer edge and the support region, the heat spreader defining a third area;

a conductor extending through the aperture, the conductor configured to be coupled to one of the anode and the cathode, wherein the thermal resistance between the LED array and the heat spreader is less than two (2) degrees Celsius per watt (C/W).

2. The light module of claim 1, wherein the aperture is sized so that the third area is at least twice as large as the first area.

3. The light module of claim 1, wherein the heat spreader has a contact area configured to engage a heat sink that is at least two times the first area.

4. The light module of claim 3, wherein the heat spreader has a thickness greater than 0.5 mm and has a thermal conductivity of greater than 50 W/m-K.

5. The light module of claim 3, further including a heat sink and a thermal pad thermally coupled to the heat spreader, the thermal pad having a thermal conductivity of at least 0.5 watts per meter Kelvin and a thickness of less than 1 mm, the heat transfer area being sufficient to provide a thermal resistivity of less than four (4) degrees Celsius per watt between the LED array and the heat sink.

6. The light module of claim 5, wherein the thermal resistance between the LED array and the heat sink is less than three (3) degrees Celsius per watt.

7. The light module of claim 5, wherein the thermal resistance between the LED array and the heat sink is less than two (2) degrees Celsius per watt.

8. The light module of claim 1, further comprising a base formed from an insulative material, the base supporting the heat spreader and LED array, the base including a first plated surface and a second plated surface that are separated by the insulative material, the insulative material having a thermal conductivity of less than ten (10) W/m-k.

9. The light module of claim 8, further comprising a thermal channel positioned in the base, the thermal channel being plated and configured so that the thermal channel extends from the first surface to the second surface.

10. The light module of claim 8, wherein the insulating material has a thermal conductivity of less than five (5) W/m-K.

11. The light module of claim 8, wherein the base portion is integral with the heat sink and the heat sink includes a plurality of fins with an outer edge arranged in a radial manner, wherein a thermal resistance between the LED array and the outer edge of the fin portion is less than three (3.0) degrees Celsius per watt.

12. The light module of claim 11, wherein the fin portion is formed of a plated plastic.

* * * * *